United States Patent [19]

Ogawa

[11] Patent Number: 4,946,772

[45] Date of Patent: Aug. 7, 1990

[54] SILVER HALIDE EMULSIONS AND PHOTOGRAPHIC MATERIALS

[75] Inventor: Tadashi Ogawa, Kanagawa, Japan

[73] Assignee: Fuji Photo Film Co., Ltd., Kanagawa, Japan

[21] Appl. No.: 189,268

[22] Filed: May 2, 1988

[30] Foreign Application Priority Data

Apr. 30, 1987 [JP] Japan ..... 62-106884

[51] Int. Cl.[5] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 4,063,951 | 12/1977 | Bogg | 430/569 |
| 4,386,156 | 5/1983 | Mignot | 430/567 |
| 4,399,215 | 8/1983 | Wey | 430/567 |
| 4,610,958 | 9/1986 | Matsuzaka et al. | 430/567 |
| 4,713,320 | 12/1987 | Maskasky | 430/567 |

*Primary Examiner*—Paul R. Michl

*Assistant Examiner*—Mark R. Buscher

*Attorney, Agent, or Firm*—Sughrue, Mion, Zinn, Macpeak & Seas

[57] ABSTRACT

A silver halide emulsion containing at least 20 wt %, on the basis of the total silver halide, of rod-like or needle-like crystal grains and/or crystal grains each formed by joining at least two of said rod-like or needle-like crystal grains at right angles or in paralle, said rod-like or needle-like crystal grains each being defined by the crystal planes consisting essentially of the (100) faces, wherein, when a ratio of length of the edges along which said planes intersect is taken as l:m:n in the order of from the smallest to the largest, m and n satisfy the following relationships (I) and (II):

$$1 \leqq m \leqq 7 \quad \text{(I)}$$

$$n \geqq 7m \quad \text{(II)}$$

45 Claims, 48 Drawing Sheets

SILVER HALIDE EMULSIONS AND PHOTOGRAPHIC MATERIALS

BACKGROUND OF THE INVENTION

1. Field of the Invention

This invention concerns silver halide emulsions and photographic materials which contain these emulsions. More precisely, the invention concerns emulsions which contain silver halide crystal grains which have a novel form and silver halide photographic materials in which these emulsions are used, and more precisely, the invention concerns emulsions which contain rod-like or needle-like silver halide crystal grains and silver halide photographic materials in which these emulsions are used.

2. Description of the Prior Art

Silver iodide, silver bromide, silver chloride and crystals consisting of mixtures of these halides are used as silver halides in photographic materials, and crystal forms ranging from so-called regular grains such as cubic, tetradecahedral, octahedral, rhombic dodecahedral, etc., through irregular grains such as tabular grains to grains of undefined form such as spherical grains are well known. Even rod-like grains have been observed. Rod-like grains and tabular grains are often observed in admixture in various proportions with grains of other forms. This is especially so in cases where the grains are formed under conditions such that the silver ion concentration changes during the precipitation and formation of the emulsion grains. Tabular grains are formed with a planar spread in two dimensions with respect to the thickness of the grain while rod-like grains are formed extending linearly in one direction. Tabular grains are known to be advantageous, when used in emulsions, in respect of the light scattering properties of the emulsion layer, the up-take of spectral sensitizing dyes due to their large surface area, and their covering power after development processing. Tabular silver halide grains of this type have been disclosed in U.S. Pat. Nos. 4,434,226, 4,439,520, 4,433,048, 4,386,156, 4,399,215 and 4,400,463, etc.

On the other hand, techniques for the formation of rod-like or needle-like silver halide grains and the characteristics of emulsions which contain crystal grains of this type are virtually unknown. More precisely, techniques in which such grains are formed at a high frequency and emulsions which contain such grains at high frequency are completely unknown.

The formation of needle-like grains has been described by C. R. Berry, S. J. Marino and C. F. Oster in *Photographic Science and Engineering,* 5, 332 (1961), but according to this work the rate at which grains of this type are formed is no more than about 2%, and the conditions of formation suggest that the formation of these grains is due simply to spiral displacement and no technique for forming such grains at high frequency as been presented to date. The assignment of the twinned crystal planes and crystal planes which are present in needle-like crystals have been described by E. Klein, H. J. Metz and E. Moisar in *Photographische Korrespondenz,* 99, 99 (1963) and by D. C. Skillman and C. R. Berry in *Photographic Science and Engineering,* 8, 65 (1964), respectively. The needle-like grains indicated in the former were formed when the twinned crystal plane was the (221) plane and the surface plane was the (111) plane. The needle-like grains indicated in the latter were formed when the twinned crystal planes were the (111) and (411) planes and the surface plane was the (100) plane. However, in these works the former only shows model diagrams of needle-like grains, and on looking at the photographs in the latter publication, only one or a few needle shaped grains can be seen in admixture with large numbers of non-needle-like grains and there is no report in practice of a technique for forming such grains at a high frequency and no emulsions of this type have been proposed.

Emulsions containing tabular silver halide crystal grains of which the aspect ratio defined as the ratio of the edge length to the thickness of the grain is from 1.5:1 to 7:1 and which are bounded by (100) planes, and a method for the preparation of these emulsions have been disclosed in U.S. Pat. No. 4,063,951. According to the definition shown here, essentially rod-like or needle-like grains are included at the upper limit of the claim, but it is clear from the title and the published photographs that the grains which are formed in practice are really tabular grains and certainly not rod-like or needle-like grains. The examples are of emulsions in which the average aspect ratio is 2:1, and even if the grains which have the highest aspect ratio are considered the value is still only 4:1 at the most. Moreover, it is not possible to form rod-like or needle-like silver halide crystal grains of the type disclosed in the present invention using the method disclosed in the aforementioned patent document.

In connection with tabular grains, (100) non-twinned crystal tabular grains have been reported by A. Mignot, E. Francois and M. Catinat in the *Journal of Crystal Growth,* 23, 207 (1974) where the formation of rod-like grains by spiral displacement has also been described. Photographs are also shown, but the rod-like grains have only been formed in admixture with many grains of other forms and it certainly cannot be said that the rod-like grains are formed at a high frequency, and, moreover, it cannot be said that conditions under which dilute solutions are added over long periods of time are specified for forming such grains at a high frequency and neither can it be said that these conditions are desirable from the point of view of their industrial usefulness. Tabular grains of a similar type have also been disclosed in U.S. Pat. No. 4,386,156 but these grains are completely different from those of the present invention.

Processing speeds of photographic materials have increased in recent years and techniques which enable even more rapid processing to be achieved will be required in the future. The development of techniques for the realization of new levels of performance and applications are also awaited.

SUMMARY OF THE INVENTION

One object of this invention is to provide silver halide emulsions which can be developed rapidly and which have a high covering power, and to provide silver halide emulsions which have a novel form in order to make this possible. Another object of this invention is to provide a method for the manufacture of emulsions of this type, and also silver halide photographic materials which contain emulsions of this type.

These objects of the invention are achieved by means of silver halide emulsions and photographic materials of the types indicated below.

(1) A silver halide emulsion containing at least 20 wt %, on the basis of the total silver halide, of rod-like or needle-like crystal grains and/or crystal grains each formed by at least two grains of said rod-like or needle-like crystal grains joined at right angles or in parallel, said rod-like or needle-like crystal grains each being defined by the crystal planes consisting essentially of the (100) faces, wherein, when a ratio of length of the edges along which said planes intersect is taken as 1:m:n in the order of from the smallest to the largest, m and n satisfy the following relationships (I) and (II).

$$1 \leqq m \leqq 7 \text{ (I)}$$

$$n \geqq 7m \text{ (II)}$$

(2) Silver halide emulsions as in (1) above, wherein m satisfies the following relationship.

$$1 \leqq m \leqq 3 \text{ (III)}$$

(3) Silver halide emulsions as in (1) above, wherein m satisfies the following relationship.

$$1 \leqq m \leqq 1.5 \text{ (IV)}$$

(4) Silver halide emulsions as in (1), (2) or (3) above wherein crystal grains which satisfy relationships (I) and (II) or relationship (III) or (IV) account for at least 40 wt % of all the silver halide.

(5) Silver halide emulsions as in (1), (2), (3) or (4) above, wherein the average length of the shortest edge of the crystal grains which satisfy relationships (I) and (II) or relationship (III) or (IV) is within the range from 0.05 μm to 1.5 μm.

(6) Silver halide emulsions as in (1), (2), (3) or (4) above, wherein the average length of the shortest edge of the crystal grains which satisfy relationships (I) and (II) or relationship (III) or (IV) is within the range from 0.1 μm to 1.0 μm.

(7) Silver halide emulsions as in (1), (2), (3), (4), (5) or (6) above, wherein the silver halide is an essentially silver iodide free silver chloride or silver chlorobromide.

(8) Silver halide emulsions as in (7) above, wherein the silver chlorobromide emulsion contains at least 10 mol % of silver chloride.

(9) Silver halide emulsions as in (7) above, wherein the silver chlorobromide contains at least 30 mol % of silver chloride.

(10) Silver halide emulsions as in any one of (1) to (9) above, wherein a crystal form controlling agent is used in the formation of the silver halide crystal grains.

(11) Silver halide emulsions as in (10) above, wherein the crystal form controlling agent is a nucleic acid or a degradation product thereof.

(12) Silver halide emulsions as in (10) above, wherein the crystal form controlling agent is an aminoazaindene compound.

(13) Silver halide photographic materials having, on a support, at least one photosensitive layer containing a silver halide emulsion according to any one of (1) to (12) above.

BRIEF DESCRIPTION OF THE DRAWINGS

FIGS. 38-1 and 38-2 are optical microscope photographs which show the structure of the developed silver crystals formed on processing an emulsion of this invention and a comparative emulsion.

FIG. 1: Electron micrograph showing the structure of the silver halide crystals of Emulsion 101-1 of this invention FIG. 2: Electron micrograph showing the structure of the silver halide crystals of Emulsion 101-2 of this invention FIG. 3: Electron micrograph showing the structure of the silver halide crystals of Emulsion 102-1 of this invention FIG. 4: Electron micrograph showing the structure of the silver halide crystals of Emulsion 102-2 of this invention FIG. 5: Electron micrograph showing the structure of the silver halide crystals of Emulsion 103 of this invention FIG. 6: Electron micrograph showing the structure of the silver halide crystals of Emulsion 104 of this invention FIG. 7: Electron micrograph showing the structure of the silver halide crystals of Comparative Emulsion 105-1

FIG. 8: Electron micrograph showing the structure of the silver halide crystals of Comparative Emulsion 105-2

FIG. 9: Electron micrograph showing the structure of the silver halide crystals of Comparative Emulsion 105-3

FIG. 10: Electron micrograph showing the structure of the silver halide crystals of Comparative Emulsion 105-4

FIG. 11: Electron micrograph showing the structure of the silver halide crystals of Comparative Emulsion 105-5

FIG. 12: Electron micrograph showing the structure of the silver halide crystals of Comparative Emulsion 105-6

FIG. 13: Electron micrograph showing the structure of the silver halide crystals of Emulsion 105-7 of this invention FIG. 14: Electron micrograph showing the structure of the silver halide crystals of Emulsion 105-8 of this invention FIG. 15: Electron micrograph showing the structure of the silver halide crystals of Comparative Emulsion 105-9

FIG. 16: Electron micrograph showing the structure of the silver halide crystals of Comparative Emulsion 105-10

FIG. 17: Electron micrograph showing the structure of the silver halide crystals of Comparative Emulsion 105-11

FIG. 18: Electron micrograph showing the structure of the silver halide crystals of Comparative Emulsion 105-12

FIG. 19: Electron micrograph showing the structure of the silver halide crystals of Emulsion 106-1 of this invention FIG. 20: Electron micrograph showing the structure of the silver halide crystals of Emulsion 106-2 of this invention FIG. 21: Electron micrograph showing the structure of the silver halide crystals of Emulsion 107-1 of this invention FIG. 22: Electron micrograph showing the structure of the silver halide crystals of Emulsion 107-2 of this invention FIG. 23: Electron micrograph showing the structure of the silver halide crystals of Comparative Emulsion 107-3

FIG. 24: Electron micrograph showing the structure of the silver halide crystals of Comparative Emulsion 107-4

FIG. 25: Electron micrograph showing the structure of the silver halide crystals of Emulsion 107-5 of this invention FIG. 26: Electron micrograph showing the structure of the silver halide crystals of Comparative Emulsion 107-6

FIG. 27: Electron micrograph showing the structure of the silver halide crystals of Emulsion 108-1 of this invention FIG. 28: Electron micrograph showing the structure of the silver halide crystals of Emulsion 108-2 of this invention FIG. 29: Electron micrograph showing the structure of the silver halide crystals of Emulsion 109-1 of this invention FIG. 30: Electron micrograph showing the structure of the silver halide crystals of Emulsion 109-2 of this invention FIG. 31: Electron micrograph showing the structure of the silver halide crystals of Emulsion 110-1 of this invention FIG. 32: Electron micrograph showing the structure of the silver halide crystals of Emulsion 110-2 of this invention FIG. 33: Electron micrograph showing the structure of the silver halide crystals of Comparative Emulsion 111-1

FIG. 34: Electron micrograph showing the structure of the silver halide crystals of Comparative Emulsion 111-2

FIG. 35: Electron micrograph showing the structure of the silver halide crystals of Emulsion 112 of this invention FIG. 36: Electron micrograph showing the structure of the silver halide crystals of Emulsion 113 of this invention FIG. 37: Electron micrograph showing the structure of the silver halide crystals of Emulsion 114-1 of this invention FIG. 38-1: Optical microscope photograph showing the structure of the developed crystal grains formed on processing Emulsion 114-1 of this invention FIG. 38-2: Optical microscope photograph showing the structure of the developed crystal grains formed on processing Comparative Emulsion 114-2

FIG. 39: Electron micrograph showing the structure of the silver halide crystals of Emulsion 118-1 of this invention FIG. 40: Electron micrograph showing the structure of the silver halide crystals of Emulsion 118-2 of this invention FIG. 41: Electron micrograph showing the structure of the silver halide crystals of Emulsion 118-3 of this invention FIG. 42: Electron micrograph showing the structure of the silver halide crystals of Emulsion 118-4 of this invention FIG. 43: Electron micrograph showing the structure of the silver halide crystals of Emulsion 118-5 of this invention FIG. 44: Electron micrograph showing the structure of the silver halide crystals of Emulsion 119-1 of this invention FIG. 45: Electron micrograph showing the structure of the silver halide crystals of Emulsion 119-2 of this invention FIG. 46: Electron micrograph showing the structure of the silver halide crystals of Emulsion 119-3 of this invention FIG. 47: Electron micrograph showing the structure of the silver halide crystals of Emulsion 119-4 of this invention FIG. 48: Electron micrograph showing the structure of the silver halide crystals of Emulsion 119-5 of this invention

DETAILED DESCRIPTION OF THE INVENTION

Figure 1:
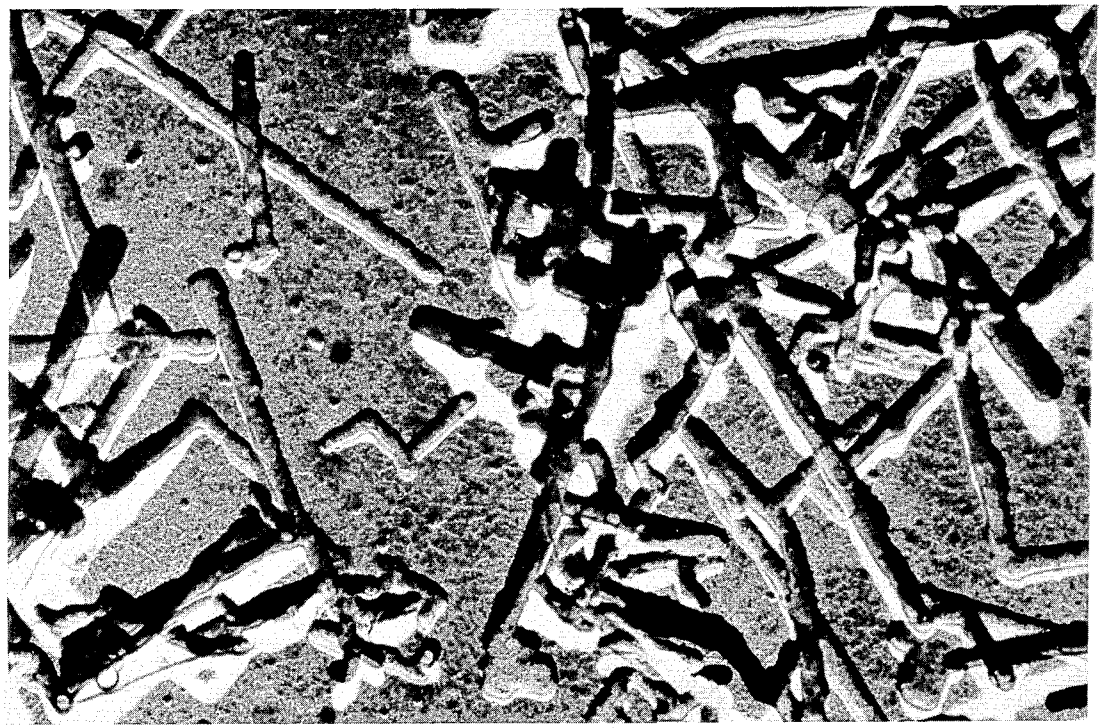
FIGS. 1 to 37 and 39 to 48 are electron micrographs which show the structures of the silver halide crystals in the emulsions of this invention or comparative emulsions which were prepared in the examples of the invention. The magnification is 30,000 times. Furthermore.

The silver halide emulsions and silver halide photographic materials which contain these emulsions of the present invention are described in detail below. The needle-like or rod-like crystal grains of the silver halide emulsions of this invention are typically formed when independent specific growth occurs in one direction or two opposite directions on a normal cubic or rectangular parallelopipedal crystal. It is thought that this specific growth starts when growth occurs on just one face of a cube or rectangular parallelopiped or when growth occurs in the same way on such a face and on the face on the opposite side. In general, when specific growth of this type occurs on two adjacent faces of a cube or rectangular parallelopiped, or on three or four adjacent faces which are arranged in a band, a tabular grain, not a rod-like crystal grain, is formed, and in cases where growth occurs on three or four faces which are not arranged in a band or on five or six faces, the crystal grain becomes a normal cubic or rectangular parallelopipedal crystal grain and the tabular form is not obtained. (See the aforementioned paper by A. Mignot et al., in the *Journal of Crystal Growth,* 23, 207 (1974)). However, with the crystal grains of the present invention, tabular grains are not formed when specific growth occurs on two faces which are not opposite to one another, which is to say on two adjacent faces, of a cube or rectangular parallelopiped and an L-shaped rod-like grain is formed. When the growth occurs on three adjacent faces which are arranged in a band, then a T-shaped rod-like grain, not a tabular grain, is formed. Similarly, if the growth occurs on four faces which are arranged in a band then a cross-shaped rod-like grain is formed. In cases where growth occurs on three, four, five or six faces which are not adjacent in the form of a band, then the grains will form crystal grains which resemble the axes of a rectangular coordinate system. Moreover, the grains distinguished in this invention include not only those in which specific growth of this type has occurred from a certain single grain, but also cases in which rod-like or needle-like crystals have grown in different directions from certain parts of specifically grown rod-like or needle-like crystals. In such cases the grains may have a complicated rod-like form such as an H-shape, an F-shape or a $\pi$-shape, for example. Moreover, the crystal parts which are not adjacent to one another can even form cubic crystal grains which are not on the same plane. Moreover, they can also form complex combination crystal grains, including the aforementioned L-shaped and T-shaped rod-like grains. In these rod-like grains, not all of the crystal parts which are joined together at right angles not necessarily satisfy the conditions for the rod-like or needle-like grains of this invention and they may be stopped short as short crystals which cannot properly be said to have a rod-like form. In such cases, if at least one part in a single grain is a crystal part which satisfies the conditions for the rod-like or needle-like grains of this invention, then the grain is a rod-like or needle-like grain of this invention. It has been concluded that the formation of grains which have a complex structure of this type is due to the action of factors which cause the silver ions and halide ions which are being added continuously to provide specific growth on a grain, such as a rod-like grain, which is undergoing specific growth on certain parts of the crystal surface to precipitate on crystal faces other than the crystal face in the direction of the specific growth, but in cases where the extent of this growth does not reach a rod-like length it is impossible to decide whether or not it is in fact specific growth.

In the present invention the terms "rod-like" or "needle-like grain" signify crystal grains which include grains of this type and crystal grains in which at least two or more crystal grains which have a rod-like or needle-like shape are joined together at right angles or in parallel.

Rod-like or needle-like grains of this invention mostly consist of grains in which growth has taken place in one direction and they have a form such that the extents of growth in the other two directions which are perpendicular to this direction are not necessarily the same, which is to say that the rectangular parallelopiped has been extended in a certain direction. If in this case the length of the shortest edge is taken to be 1 and the length of the longer edge is taken to be m, then m satisfies the following relationship:

$$1 \geqq m \geqq 7 \quad \text{(I)}$$

Furthermore, if the length of the edge in the direction in which the specific growth of this invention has occurred is n, then n satisfies the following relationship:

$$n \geqq 7m \quad \text{(II)}$$

With the rod-like grains of this invention m preferably satisfies the relationship shown by relationship (III), and more preferably m satisfies the following relationship (IV):

$$1 \leqq m \leqq 3 \quad \text{(III)}$$

$$1 \leqq m \leqq 1.5 \quad \text{(IV)}$$

The length of the shortest edge is preferably within the range from 0.05 μm to 1.5 μm and more preferably within the range from 0.1 μm to 1.0 μm.

The halogen composition of the silver halide crystal grains of this invention is that of an essentially silver iodide-free silver chloride, silver bromide or silver chlorobromide. The term "essentially silver iodide-free" signifies a silver iodide content of 3 mol % or less, and preferably of 1 mol % or less, with respect to the total silver halide content of the emulsion, and more preferably it signifies that no silver iodide is included at all. The inclusion of at least 30 mol % of silver chloride is preferred for the formation of rod-like or needle-like grains of this invention, but grains which have only a small silver chloride content can be obtained by replacement with bromides in the silver chlorobromide or silver chloride rod-like grains which have been formed, or by precipitating a phase which is of a high content of silver bromide, over the top of these grains.

The rod-like or needle-like grains of this invention can be formed under conditions in which crystal form controlling agents are used. The needle-like grains known in the past have been formed from silver bromide without the use of form controlling additives but, as mentioned earlier, the frequencies at which such grains have been formed have been low and moreover the frequencies at which the needle-like grains have been formed have been reduced even further by the presence of a trace of iodide ions or by the presence of chloride ions. In this invention it is easier to form rod-like grains in the presence of chloride ions under conditions in which the chloride ions are incorporated as silver chloride. This is a distinguishing feature of the invention. However, while the use of a crystal form controlling agent is not essential for forming rod-like grains at a high frequency as in the case of this invention, the use of such an agent is preferred and it can be said that the rod-like grains of this invention are formed more easily in the presence of a crystal form controlling agent. The crystal form controlling agents used in the formation of the rod-like grains of this invention may be any of those compounds with which rod-like grains of this invention as described earlier are formed when silver halide grains are formed from aqueous solutions of silver salts and water-soluble halides in their presence, and at the present time the general structures of the compounds which have such an action have not been specified. Some useful compounds can be mentioned. Aminoazaindenes are typical compounds of this type. The aminoazaindenes cited in this invention are azaindene compounds which have an amino group which is bonded to the ring at the position of the nitrogen atom as a substituent group. Azaindenes are compounds in which one or more of the carbon atom(s) in the aromatic ring of an indene is/are replaced by a nitrogen atom(s) and the compounds in which 3 to 5 carbon atoms have been replaced by the nitrogen atoms are useful for forming the rod-like grains of this invention. Specific examples of such compounds include adenine, guanine, aza-adenine, azaguanine, and adenosine and guanosine. There are many effective compounds among the nucleic acid degradation products or intermediate products of this type.

Emulsions which contain rod-like or needle-like grains of this invention can be prepared using compounds such as those indicated above and rod-like or needle-like grains are included at high frequencies in these emulsions.

These crystal form controlling agents may be present in the reaction vessel before the start of grain formation when the silver halide crystal grains are to be formed by reacting an aqueous solution of water-soluble silver salts with an aqueous solution of halide salts, or they may be added to the reaction vessel after the commencement of grain formation. If the crystal form controlling agent is added after the reaction brought about by the addition of the aqueous silver salt solution or aqueous halide salt solution has been completed and the grain formation has been completed, the rod-like grains of this invention will not be formed. In this invention the crystal form controlling agent is preferably present from the initial stages of grain formation. That is to say, it should be present in the reaction vessel prior to the reaction and it should preferably be present before 70% of all the silver halide which is to be formed has been formed. More preferably it should be present before 50% of all the silver halide which is to be formed has been formed, and most preferably it should be present before 30% of all the silver halide has been formed or it should be placed in the reaction vessel prior to reaction. Provided that it is present in the initial stage of grain formation, an appropriate amount of the crystal form controlling agent can be included in the later stages of grain formation and supplementary additions can be made without adverse effect on the invention, and this is rather desirable. This is because the crystal form controlling agent also has the effect of maintaining stable the form of the resulting grains which have a rod-like or needle-like form. Hence, in this invention the preferred methods for adding the crystal form controlling agent include those in which it is dissolved in, and added along with, the silver salt solution or the halide salt solution, those in which it is added as a third solution in parallel with the silver salt solution or the halide salt solution, and those in which the crystal form controlling agent is divided up and added on a number of occasions during the formation of the grains. In this context, these methods are preferred firstly because the frequency of formation of the rod-like or needle-like grains of this invention is high, and secondly because long rod-like or needle-like grains are obtained and the value of n in relationship (II) of the invention is large but, depending on the purpose and application of the silver halide emulsion which is being formed, it may be desirable to limit the frequency at which the rod-like grains are formed to some extent as long as the requirements are satisfied, and there are cases in which it is desirable that n should be below a certain value or in the vicinity of a certain value and no limit is imposed in such cases.

No particular limits are imposed on the amounts of the crystal form controlling agent which is used in this invention, and the appropriate amount varies considerably according to the type of crystal forming agent used and the conditions of use during the formation of the crystal grains, and according to the form of the rod-like grains which it is intended to obtain. If the amount used is too small, an emulsion of this invention is not obtained, and conversely, if too much is used the specific growth by which the rod-like grains are formed is inhibited and it is difficult to form rod-like grains or to obtain crystal grains of the desired size and this is undesirable. For example, when adenine is used from among the aforementioned crystal form controlling agents, the preferred amount to be added is of the order of from $10^{-6}$ mol to $10^{-1}$ mol per mol of silver halide and more preferably the amount used is within the range from $10^{-4}$ mol to $10^{-1}$ mol per mol of silver halide. The specific growth in this invention is achieved using a somewhat smaller quantity of guanine but the shape and characteristics of the resulting rod-like grains seem to be somewhat different. Furthermore, with the other aminoazaindene compounds, aza-adenine, azaguanine or adenosine, rod-like grains are formed with the addition of somewhat larger quantities.

The use of aminoazaindene compounds has been disclosed in U.S. Pat. Nos. 4,400,463 and 4,414,306 as an essential condition for the formation of tabular grains in which the principal crystal face of the silver chloride or silver chlorobromide is the (111) plane. However, there is no mention in these documents of the formation of rod-like or needle-like crystal grains of the type according to this invention using the aminoazaindene compounds nor is there any suggestion of this to be found.

No limits are imposed upon the use conditions when, in this invention, rod-like or needle-like grains are to be formed using aminoazaindene compounds, but the use of these compounds at a pH which is not too low is preferred. For example, the use of a pH of at least 4 is preferred. However, this is not a general rule and, for example, rod-like or needle-like grains of this invention can be formed easily at a lower pH with guanine than with adenine.

Compounds other than the crystal form controlling agents may also be used in this invention. Compounds of this type may be present if the specific growth in this invention has been initiated with a crystal form controlling agent, and if the rod-like grains have grown to a certain extent, they are preferred for retaining the form of the crystal grains.

Spectral sensitizing dyes are one example of compounds of this type.

Cyanine dyes, merocyanine dyes and complex merocyanine dyes, etc., are spectral sensitizing dyes which can be used in this invention. Complex cyanine dyes, holopolar cyanine dyes, hemicyanine dyes, styryl dyes and hemioxonol dyes can also be used. The use of simple cyanine dyes, carbocyanine dyes and dicarbocyanine dyes as the cyanine dyes is preferred. These cyanine dyes can be represented by general formula (I).

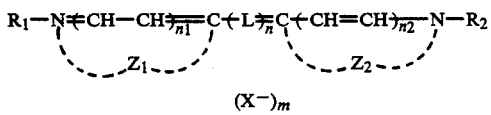

(I)

wherein L represents a methine group or a substituted methine group, $R_1$ and $R_2$ each represents an alkyl group or a substituted alkyl group, $Z_1$ and $Z_2$ each represents an atomic group which forms a 5- or 6-membered nitrogen-containing heterocyclic ring; X is an anion, n is 1, 3 or 5; $n_1$ and $n_2$ each is 0 or 1, and when n=5 then both $n_1$ and $n_2$ are 0; m is 0 or 1, and it is 0 when an intramolecular salt is formed. When n is 5 the L groups may be bonded to form a 5- or 6-membered, substituted or unsubstituted, ring.

Cyanine dyes which can be represented by general formula (I) are described in detail below.

The substituent group on the substituted methine group represented by L may be a lower alkyl group (for example, a methyl group, an ethyl group, etc.) or an aralkyl group (for example, a benzyl group, a phenethyl group, etc.).

The alkyl substituent represented by $R_1$ and $R_2$ may be a linear or branched chain alkyl group or a cycloalkyl group. No limit is imposed on the number of carbon atoms, but an alkyl group which has from 1 to 8 carbon atoms is preferred and that which has from 1 to 4 carbon atoms is more preferable. Furthermore, examples of a substituent group in the substituted alkyl group include a sulfonic acid group, a carboxylic acid group, a hydroxyl group, an alkoxy group, an acyloxy group and an aryl group (for example, a phenyl group, a substituted phenyl group, etc.). These groups may be bonded individually or in combination of two or more groups to the alkyl group. Moreover, the sulfonic acid group and carboxylic acid group may form a salt together with an alkali metal ion or the quaternary ion of an organic amine. Here "a combination of two or more groups" includes cases in which these groups are bonded individually to the alkyl group and cases in which the groups are connected together and then bonded to the alkyl group. Examples of the latter type include a sulfoalkoxyalkyl group, a sulfoalkoxyalkoxyalkyl group, a carboxyalkoxyalkyl group and a sulfophenylalkyl group.

Specific examples of $R_1$ and $R_2$ include a methyl group, an ethyl group, an n-propyl group, an n-butyl group, a vinylmethyl group, a 2-hydroxyethyl group, a 4-hydroxybutyl group, a 2-acetoxyethyl group, a 3-acetoxypropyl group, a 2-methoxyethyl group, a 4-methoxybutyl group, a 2-carboxyethyl group, a 3-carboxypropyl group, a 2-(2-carboxyethoxy)ethyl group, a 2-sulfoethyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)ethoxy]ethyl group, a 2-hydroxy-3-(3'-sulfopropoxy)propyl group, etc.

Specific examples of nitrogen-containing heterocyclic nuclei formed by $Z_1$ or $Z_2$ include the oxazole nucleus, the thiazole nucleus, the selenazole nucleus, the imidazole nucleus, the pyridine nucleus, the oxazoline nucleus, the thiazoline nucleus, the selenazoline nucleus, the imidazoline nucleus and nucleus each thereof which is condensed with a benzene ring, a naphthalene ring or other saturated or unsaturated carbon ring. Moreover, these nitrogen-containing heterocyclic nuclei may be substituted with a substituent (for example, an alkyl group, a trifluoromethyl group, an alkoxycarbonyl group, a cyano group, a carboxylic acid group, a carbamoyl group, an alkoxy group, an aryl group, an acyl group, a hydroxyl group, a halogen atom, etc.).

The anion represented by X may be a $Cl^-$, $Br^-$, $I^-$, $SO_4^{2-}$, $NO_3^-$ or $ClO_4^-$ ion, etc.

Other useful spectral sensitizing dyes have been disclosed in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77, etc.

From among the above-mentioned dyes, the use of those which have a benzothiazole nucleus or a benzooxazole nucleus is preferred in this invention, and the use of the simple cyanine dyes which have a benzothiazole nucleus, the carbocyanine dyes which have a benzooxazole nucleus and the dicarbocyanine dyes which have a benzothiazole nucleus is especially preferred.

Normally, the spectral sensitizing dyes are used by adsorption on the grain surface after the formation of the grains has been completed in order to spectrally sensitize the silver halide emulsion. On the other hand, U.S. Pat. No. 2,735,766 discloses a method in which merocyanine dyes are added during the precipitation and formation of the silver halide grains and describes it is possible to reduce the amount of unadsorbed dye in this way. Furthermore, a method in which the spectral sensitizing dye is added and adsorbed during the addition of the aqueous silver salt solution and aqueous halide salt solution with which the silver halide crystal grains are being formed is disclosed in Japanese Patent Application (OPI) No. 26589/80 (the term "OPI" as used herein refers to a "published unexamined Japanese patent application"). Thus, the addition of a spectral sensitizing dye may be carried out during the formation of the silver halide crystal grains, after forming the grains or before starting to form the grains, but in this invention it is difficult to form rod-like grains if the dye is present before or in the early stages of the formation of the grains and this is undesirable. Thus, the use of a method in which the spectral sensitizing dye is added and adsorbed after forming the rod-like or needle-like grains of this invention in order to preserve the form of the grains is preferred. In this context the expression "after forming the grains" includes all stages provided that the grains ultimately formed are grains as specified in this invention even if there is a stage in which grains which do not satisfy the specification of the invention are formed and, of course, after the formation of grains of the form specified in this invention.

After the grains of this invention have been formed, the use of a means such as lowering of the pH of the emulsion, for example, so as to desorb the crystal form controlling agent and adsorb the spectral sensitizing dye, and, moreover, the use of a crystal form controlling agent which is removed by water washing is preferred.

The silver halide emulsions of this invention may be chemically sensitized after grain formation has been completed. Moreover, the addition of a spectral sensitizing dye after grain formation can be made before the commencement of such chemical sensitization, during chemical sensitization or after chemical sensitization or it may be carried out when the emulsion is being coated. In this invention, as mentioned earlier, the addition and adsorption of the spectral sensitizing dye is preferably carried out in at least one process at any stage following the process in which the formation of the silver halide grains is essentially completed. It may be divided up and added in two or more processes as required. Furthermore, when the spectral sensitizing dye is added in a single process it may be added in a concentrated manner over a short period of time or it may be added continuously over a long period of time. Furthermore, the spectral sensitizing dye may be added using any combination of these methods of addition.

The spectral sensitizing dye which is added may be added in the form of crystals or a powder but it is preferably added using a method in which it is formed into a solution or a dispersion. Water-soluble solvents such as alcohols having from 1 to 3 carbon atoms, acetone, pyridine, methyl cellosolve, etc., or mixtures of such solvents can be used to form the solution. Moreover, the dye may be formed into a micell dispersion or some other types of dispersion using surfactants.

The amount of spectral sensitizing dye added is dependent on the purpose of the spectral sensitization and the details of the silver halide emulsion, but normally the dyes are added at a rate of from $1\times10^{-6}$ mol to $1\times10^{-2}$ mol, and preferably at a rate of from $1\times10^{-5}$ to $5\times10^{-3}$ mol, per mol of silver halide.

The spectral sensitizing dyes used in the invention may be used individually or in combination of two or more. Dyes which themselves have no spectral sensitizing effect or strong color sensitizing agents which have essentially no absorption in the visible region but which reinforce the sensitizing action of a spectral sensitizing dye may be included along with the spectral sensitizing dyes.

In this invention the aminostilbene based compounds which are substituted with nitrogen-containing heterocyclic groups (for example, those disclosed in U.S. Pat. Nos. 2,933,390 and 3,635,721) have the effect of lowering the residual color of the aforementioned cyanine dyes which have oxazole nuclei and raising the color sensitivity of the dicarbocyanine dyes which have a benzothiazole nucleus, and their combined use is especially preferred. Furthermore, apart from these, the use of azaindene compounds, especially hydroxyazaindene compounds and aminoazaindene compounds, is preferred. Hence, the aminoazaindene compounds not only function as crystal form controlling agents but also provide for both the retention of the grain form and strong color sensitization. Moreover, the aminostilbene compounds have a form retaining effect as well as a strong color sensitizing effect.

The aminostilbene compounds preferably used in the invention include 4,4'-bis(s-triazinylamino)stilbene-2,2'-disulfonic acid and 4,4'-bis(pyrimidinylamino)stilbene-2,2'-disulfonic acid and their alkali metal salts, etc. The s-triazine ring or the pyrimidine ring in these compounds is preferably substituted in one or two positions with substituted or unsubstituted arylamino groups, substituted or unsubstituted alkylamino groups, substituted or unsubstituted aryloxy groups, substituted or unsubstituted alkyloxy groups or hydroxyl groups or amino groups, etc.

The following compounds which have normally been used in order to prevent the occurrence of fogging during the manufacture of photographic materials, during the storage of photographic materials prior to development processing and during the development process, and also in order to raise the stability of the photographic performance of the photographic material can be mentioned as another example of compounds which are effective for retaining the grain form of the silver halide emulsions of this invention. Thus, firstly there are the heterocyclic mercapto compounds, for example, the mercaptothiadiazoles, mercaptotetrazoles, mercaptobenzimidazoles, mercaptobenzothiazoles, mercaptopyrimidines and the mercaptothiazoles, etc., secondly there are compounds in which the above-mentioned heterocyclic mercapto compounds are provided with water solubilizing groups such as carboxyl groups, sulfonic acid groups, etc., thirdly there are the azoles, for example, benzothiazolium salts, nitroindazoles, triazoles, benzotriazoles, benzimidazoles (especially, the nitro substituted or halogen substituted derivatives), fourthly there are the thioketo compounds, for example, oxazolidinethione, etc., and fifthly there are the azaindenes, for example, the tetraazaindenes mentioned earlier, and, more specifically, the hydroxyazaindenes, especially 4-hydroxy-1,3,3a,7-tetraazaindene, etc., and many compounds which are known as antifoggants or stabilizers, such as the benzenethiosulfinic acids, benzenesulfinic acids, etc., can be added. The use of the heterocyclic mercapto compounds and the azaindenes is especially preferred in this invention.

The crystal grains of a silver halide emulsion of this invention are not limited to those which have a uniform halogen composition, and differences in halogen composition may exist within the crystal grains or between crystal grains. In practice, one single silver halide emulsion can be prepared by consecutive addition using two solutions of water-soluble halide salts of different halogen type compositions to form rod-like or needle-like crystal grains of the type of this invention. At the present time, it is not clear how the silver halide grains which have different halogen compositions are formed, but it is thought that, when the solutions which have different halogen compositions are added, this causes new crystal nuclei to be formed, but part forms rod-like or needle-like grains in which silver halide crystals of different composition are joined together linearly. Some crystal grains which are joined together non-linearly (which is to say at right angles to the direction of the original crystal grain) are also formed. In cases where the original crystal grains are rod-like or needle-like grains, deposition in the direction along which the grains would become thicker has not been observed to occur to any extent under the preferred conditions of this invention, although recrystallization occurs as a result of the presence of silver halide crystals which have a different halide composition in the same emulsion, and crystal grains which have different halogen compositions within and on the surface of the rod-like grain can be formed. Furthermore, when silver halide crystals of different compositions are deposited, it is possible, by adjusting the action of the crystal form controlling agent, to form grains which have different halogen compositions in the surface and interior parts of the crystal grain of this type intentionally.

The silver halide crystal grains of an emulsion of this invention can be subjected to halogen exchange after the formation of the rod-like or needle-like grains and converted to rod-like or needle-like grains which have a different halogen composition from the original composition. In this invention it is possible to use water-soluble bromides and water-soluble iodides for this purpose. When the halogen exchange of this type is effected the form of the crystal grains is deformed, but beyond that the deformation of the crystal grains after the exchange is slight. The addition of iodides is especially effective from the point of view of retaining the form of the crystal grain, and 3 mol % or more of the iodide can be added.

Although, strictly speaking, it is not halogen exchange, a sparingly soluble halogen compound can be added in place of the above-mentioned water-soluble halogen compound and a silver salt which has a different halogen composition can be made to crystallize on the surface of the rod-like grains. That is to say, using fine crystals of silver bromide or silver iodide, or mixtures of these silver halides which also contain silver chloride, Ostwald ripening can be brought about with the rod-like grains, and similar non-uniform silver halide grains can be obtained in this way.

The crystal form retaining agents as typified by the spectral sensitizing dyes mentioned earlier can be used very effectively in the case of crystals of this type in which the halogen composition differs within the crystal grains or between grains.

Cadmium salts, zinc salts, lead salts, thallium salts, iridium salts or their complex salts, rhodium salts or their complex salts and iron salts or their complex salts, etc., may be present during the formation or physical ripening of the silver halide crystal grains of the emulsions of this invention.

Furthermore, silver halide solvents can be used. For example, grain formation or physical ripening may be carried out in the presence of ammonia, potassium thiocyanate or the thioethers and thione compounds disclosed in U.S. Pat. No. 3,271,157, Japanese Patent Application (OPI) Nos. 12360/76, 82408/78, 144319/78, 100717/79 and 155828/79, etc.

Noodle washing, flocculation precipitation methods or ultrafiltration, etc., can be used to remove the soluble salts from the emulsion after physical ripening. The lowering of the pH of the emulsion in the flocculation precipitation method changes the crystal form control or retaining effect of the crystal form controlling agent, and in such a case the use of a crystal form retaining agent of a type which can retain the form of the rod-like grains is especially preferred.

The silver halide emulsions of this invention can be chemically sensitized using the methods of sulfur sensitization or selenium sensitization, reduction sensitization, noble metal sensitization, etc., either individually or conjointly. That is to say, sulfur sensitization methods in which active gelatin or compounds which contain sulfur and can react with silver ions (for example, thiosulfates, thiourea compounds, mercapto compounds, rhodanine compounds, etc.) or reduction sensitization methods in which reducing substances (for example, stannous salts, amines, hydrazine derivatives, formamidinesulfinic acid, silane compounds, etc.) are used, and noble metal sensitization methods in which metal compounds (for example, gold complex salts, and complex salts of the metals in group VIII of the Periodic Table, such as platinum, iridium, palladium, rhodium and iron, etc.) are used, can be used individually or conjointly.

In this invention gelatin is preferred as the hydrophilic colloid which is used as a protective colloid or binder. Examples of the gelatin include a so-called alkali-treated gelatin in which treatment with an alkali such as lime is carried out during the process in which the gelatin is being produced from collagen, a so-called acid-treated gelatin which has been treated in a similar manner but with hydrochloric acid, etc., or the so-called enzyme-treated gelatins disclosed on page 30 of *Bull. Soc. Sci. Phot. Japan,* No. 16 (1966) which have been subjected to treatment with hydrolases, etc., and gelatins in which the amino groups, imino groups, hydroxyl groups or carboxyl groups which are the functional groups contained in the gelatin molecules have been treated with and modified by compounds which have groups which are able to react with the aforementioned groups, for example, phthalated gelatins, succinated gelatins, etc. Moreover, gelatin derivatives, graft polymers of gelatin and other polymeric compounds, proteins such as albumins, casein, etc., cellulose derivatives such as cellulose sulfate esters, carboxymethyl cellulose, hydroxyethyl cellulose, etc., sugars such as sodium alginate, starch derivatives, etc., and hydrophilic polymeric compounds such as homopolymers and copolymers, for example, poly(vinyl alcohol), partial acetal poly(vinyl alcohol), poly(N-vinylpyrrolidone), poly(acrylic acid), poly(methacrylic acid), polyacrylamide, polyvinylimidazole), polyvinylpyrazole, etc., can be used for this purpose.

No particular limits are imposed, the amount used of these binders in coated layers which contain silver halide emulsions of this invention is preferably from 0.1 to 50 parts by weight, and more preferably from 0.2 to 20 parts by weight, based on the silver halide content of the silver halide emulsion of this invention, calculated as the weight of silver. Moreover, the use of from 0.25 to 20 parts by weight is more preferable. If the amount of binder in an emulsion of this invention is too small, the silver halide grains are liable to contact one another, and moreover the silver filaments are liable to contact one another after development. This is certainly not a good arrangement in a normal silver halide photographic material but, on the other hand, use can be made of this point. In such a case, a smaller amount of binder is preferred and an amount of from 0.1 to 5 parts by weight with respect to the silver is preferred.

In addition to the silver halide emulsion and binder, etc., color couplers and the high boiling point organic solvents which are used in combination with these couplers can be included, as required, in the photographic materials of this invention. Such additives are described below. Color couplers such as cyan couplers, magenta couplers, yellow couplers, etc., and the compounds in which the couplers are dispersed can be included in the silver halide emulsions of this invention. The couplers are preferably rendered nondiffusible by incorporation of ballast groups or by polymerization. 2-Equivalent color couplers which are substituted by releasable groups can be coated at a lower rate than 4-equivalent couplers which have a hydrogen atom at the active coupling site and so they are preferred. Couplers of which the colored dye has suitable diffusion properties, colorless couplers, or DIR couplers which release a development inhibitor upon coupling reaction or couplers which release development accelerators can also be used.

Oil protected type acylacetamide based couplers are typical examples of yellow couplers which can be used in the invention. The specific examples are disclosed in U.S. Pat. Nos. 2,407,210, 2,875,057 and 3,265,506, etc. The use of 2-equivalent yellow couplers is preferred in this invention and typical examples of such couplers include the yellow couplers having the oxygen atom at the releasing site of the releasing group disclosed in U.S. Pat. Nos. 3,408,194, 3,447,928, 3,933,501 and 4,022,620, etc., and the yellow couplers having the nitrogen atom at the releasing site of the releasing group disclosed in Japanese Patent Publication No. 10739/83, U.S. Pat. Nos. 4,401,752, 4,326,024, RD 18053 (April, 1979), British Pat. No. 1,425,020 and West German Patent Application (Laid Open) Nos. 2,219,917, 2,261,361, 2,329,587 and 2,433,812, etc. The use of α-pivaloylacetanilide based couplers is preferred in view of the excellent fastness, especially light fastness, of the colored dye. On the other hand, the use of the α-benzoylacetanilide based couplers is preferred for obtaining a high color density.

Oil protected type indazolone or cyanoacetyl based couplers, and preferably 5-pyrazolone based couplers and pyrazoloazole based couplers such as the pyrazolotriazoles, etc., are preferred magenta couplers which are used in this invention. The use of 5-pyrazolone based couplers substituted in the 3-position with an arylamino group or an acylamino group is preferred from the point of view of the hue of the colored dye and the color density, and typical examples of such couplers are disclosed in U.S. Pat. Nos. 2,311,083, 2,343,703, 2,600,788, 2,908,573, 3,062,653, 3,152,896 and 3,936,015, etc. The releasing group having the nitrogen atom at the releasing site disclosed in U.S. Pat. No. 4,310,619 or the arylthio groups disclosed in U.S. Pat. No. 4,351,897 are preferred for the releasing groups of the 2-equivalent 5-pyrazolone based couplers. Furthermore, the 5-pyrazolone based couplers which have ballast groups disclosed in European Pat. No. 73,636 are preferred for obtaining high color densities. The pyrazolobenzimidazoles disclosed in U.S. Pat. No. 3,369,879, and preferably the pyrazolo[5,1-c][1,2,4]triazoles disclosed in U.S. Pat. No. 3,725,067, the pyrazolotetrazoles disclosed in *Research Disclosure,* 24220 (June, 1984) and the pyrazolopyrazoles disclosed in *Research Disclosure,*

24230 (June, 1984), can be used as pyrazoloazole based couplers. The imidazole[1,2-b]pyrazoles disclosed in European Pat. No. 119,741 are preferred in respect of their low yellow side absorption and their light fastness of the colored dye, and the use of the pyrazolo[1,5-b][1,2,4]triazole disclosed in European Pat. No. 119,860 is especially preferred.

The oil protected type naphthol based couplers and phenol based couplers can be used for the cyan couplers which are used in the invention, and typical examples of these include the naphthol based couplers disclosed in U.S. Pat. No. 2,474,293 and, preferably, the 2-equivalent naphthol based couplers which have the oxygen atom at the releasing site of the releasing group disclosed in U.S. Pat. Nos. 4,052,212, 4,146,396, 4,228,233 and 4,296,200. Furthermore, typical examples of phenol based couplers are disclosed in U.S. Pat. Nos. 2,369,929, 2,801,171, 2,772,162, 2,895,826, etc. The use of cyan couplers which are resistant to humidity and temperature is preferred in this invention, and typical examples of such couplers include the phenol based cyan couplers which have an alkyl group at least as high as an ethyl group in the meta position of the phenol ring, disclosed in U.S. Pat. No. 3,772,002, the 2,5-diacylamino substituted phenol based couplers disclosed in U.S. Pat. Nos. 2,772,162, 3,758,308, 4,126,396, 4,334,011, 4,327,173, 4,430,423 and 4,564,586 and West German Patent Laid Open No. 3,329,729, etc., and the phenol based couplers which have a phenylureido group in the 2-position and an acylamino group in the 5-position disclosed in U.S. Pat. Nos. 3,446,622, 4,333,999, 4,451,559 and 4,427,767, etc.

It is possible to improve granularity by combined use with couplers of which the colored dye has appropriate diffusion properties. Dye diffusing couplers of this type include the magenta couplers disclosed in U.S. Pat. No. 4,366,237 and British Pat. No. 2,125,570, and the yellow, magenta or cyan couplers disclosed in European Patent 96,570 and West German Patent Application (Laid Open) No. 3,234,533.

The dye forming couplers and special couplers mentioned above may be a polymeric substance consisting of at least two molecules. Typical examples of polymerized dye forming couplers have been disclosed in U.S. Pat. Nos. 3,451,820 and 4,080,211 and typical examples of polymerized magenta couplers are disclosed in British Pat. No. 2,102,173 and U.S. Pat. No. 4,367,282.

Two or more of the various types of couplers which can be used in the invention can be used in combination in the same photosensitive layer in order to satisfy the requirements of the photosensitive material and, moreover, the same compound can be used in two or more different layers.

The standard amount used of color coupler is within the range from 0.001 to 1 mol per mol of photosensitive silver halide, and the amount used is preferably within the range from 0.01 to 0.5 mol per mol of photosensitive silver halide in the case of the yellow couplers, within the range from 0.003 to 0.5 mol per mol of photosensitive silver halide in the case of the magenta couplers and within the range from 0.002 to 0.5 mol per mol of photosensitive halide in the case of the cyan couplers.

Photosensitive materials made according to this invention may also contain hydroquinone derivatives, aminophenol derivatives, amines, gallic acid derivatives, catechol derivatives, ascorbic acid derivatives, colorless couplers and sulfonamidophenol derivatives, etc., as anti-color foggants or color mixing preventing agents.

The known discoloration preventing agents can be used in photosensitive materials of this invention. Examples of organic discoloration preventing agents include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether and ester derivatives in which the phenolic hydroxyl groups of these compounds have been silylated or alkylated. Furthermore, metal complexes such as the (bissalicylaldoxymato)nickel complex and the (bis-N,N-dialkyldithiocarbamato)nickel complex can also be used for this purpose.

Compounds which have a two part structure including a hindered amine and a hindered phenol in the same molecule, such as those disclosed in U.S. Pat. No. 4,268,593, give good results when used to prevent deterioration of the yellow dye image due to heat, humidity and light. Furthermore, the spiroindanes disclosed in Japanese Patent Application (OPI) No. 159644/81 and the substituted chromans of hydroquinone diethers and monoethers disclosed in Japanese Patent Application (OPI) No. 89835/80 give good results when used to prevent deterioration, especially that caused by light, of magenta colored images.

The combined use of benzotriazole based ultraviolet absorbers is preferred in order to improve the storage properties, and especially the color fastness to light, of the cyan image. The ultraviolet absorber may be emulsified together with the cyan coupler.

The coated weight of the ultraviolet absorber is that required to render the cyan dye image stable to light, but if too much is used it can cause yellowing of the unexposed parts (white part) of the color photographic material and so it is normally coated at a rate within the range from $1\times10^{-4}$ mol/m$^2$ to $2\times10^{-3}$ mol/m$^2$ and preferably from $5\times10^{-4}$ mol/m$^2$ to $1.5\times10^{-3}$ mol/m$^2$.

Whiteners such as stilbene based whiteners, triazine based whiteners, oxazole based whiteners or coumarin based whiteners, etc., may be used in the emulsion layers or other hydrophilic colloid layers of the photographic materials of this invention. Water-soluble whiteners may be used and water-insoluble whiteners may be used in the form of a dispersion.

Similarly, the use of known water-soluble dyes (for example, oxonol dyes, anthraquinone dyes, azo dyes, merocyanine dyes, etc.) as filter dyes or for the prevention of irradiation and various other purposes in the emulsion layers or other hydrophilic colloid layers of the photographic materials of this invention is preferred. Specific examples of such dyes include the oxonol dyes having a pyrazolone nucleus or a barbituric acid nucleus disclosed in British Pat. Nos. 506,385, 1,177,429, 1,311,884, 1,338,799, 1,385,371, 1,467,214, 1,433,102 and 1,553,516, Japanese Patent Application (OPI) Nos. 85130/73, 114420/74, 161233/80 and 111640/84, and U.S. Pat. Nos. 3,247,127, 3,469,985 and 4,078,933, etc., other oxonol dyes disclosed in U.S. Pat. Nos. 2,533,472 and 3,379,533 and British Pat. No. 1,278,621, etc., the azo dyes disclosed in British Pat. Nos. 575,691, 680,631, 599,623, 786,907, 907,125 and 1,045,609, U.S. Pat. No. 4,255,326 and Japanese Patent Application (OPI) No. 211043/84, etc., the azomethine dyes disclosed in Japanese Patent Application (OPI) Nos. 100116/75 and 118274/79 and British Pat. Nos. 2,014,598 and 750,031, etc., the anthraquinone dyes disclosed in U.S. Pat. No. 2,865,752, etc., the arylidene dyes disclosed in U.S. Pat. Nos. 2,538,009, 2,688,541 and 2,538,008, British Pat. Nos. 584,609 and 1,210,252, Japanese Patent Application (OPI) Nos. 40625/75, 10927/76 and 118247/79 and Japanese Patent Publication Nos. 3286/73 and 37303/84, etc., the styryl dyes disclosed in Japanese Patent Publication Nos. 16594/69 and 28898/84, etc., the triarylmethane dyes disclosed in British Pat. Nos. 446,583 and 1,335,422 and Japanese Patent Publication No. 228250/84, etc., the merocyanine dyes disclosed in British Pat. Nos. 1,075,653, 1,284,730, 1,475,228 and 1,542,807, etc., and the cyanine dyes disclosed in U.S. Pat. Nos. 2,843,486 and 3,294,539, etc.

The provision, as required, of auxiliary layers, such as protective layers, intermediate layers, antihalation layers, filter layers, backing layers, etc., as well as the silver halide emulsion layers is preferred in the silver halide photographic materials of this invention.

In the layer construction of a color photographic material, protective layers are normally provided on the outermost emulsion layer and matting agents which have an appropriate particle size, slipping agents, and dispersions of poly(vinyl alcohol) based homopolymers or copolymers and high boiling point organic solvents, etc., which are used for adjusting the physical and mechanical properties of the coated film, for example, are included in the uppermost protective layer, while ultraviolet absorbers (especially 2-[2'-hydroxyphenyl]benzotriazoles, etc.) and mordants and the same polymers and high boiling point organic solvents as mentioned above are preferably included in the lower protective layer.

The emulsion layer which contains a silver halide emulsion of this invention may be a single layer, double layers or multilayers. The silver halide emulsions of this invention mixed each other or mixed with other silver halide emulsions may be used. These emulsion layers may be split-up and coated as two or more layers which have different speeds or spectral sensitivities, for example, and they can be built up in any order.

The provision of intermediate layers containing color mixing preventing agents between emulsion layers of different color sensitivities is preferred. Various reducing agents, notably the hydroquinones, can be used as color mixing preventing agents in this invention. Most typical are the alkyl hydroquinones disclosed in U.S. Pat. Nos. 2,360,290, 2,419,613, 2,728,659, 2,732,300, 3,960,570 and 3,700,453, etc.

Baryta paper, resin coated paper, triacetate film, polyethylene terephthalate film, poly(vinyl chloride) film, other types of plastic film, synthetic papers made of these materials or polypropylene, etc., and, moreover, glass plates, metal plates and metal laminated bases, etc., can all be used as supports for the above-mentioned emulsion layers and auxiliary layers. Any of the known methods and known processing baths such as those disclosed on pages 28 to 30 of *Research Disclosure,* No. 176 (RD 17643), for example, can be used for processing the photographic materials of this invention. This photographic processing may be of the type which results in the formation of a silver image (a black-and-white photographic process) or of the type which results in the formation of a silver image (a color photographic process), depending on the intended purpose of the processing operation. The processing temperature is normally selected within the range from 18° C. to 50° C., but it can be set to a temperature below 18° C. or to a temperature exceeding 50° C.

Known developing agents such as dihydroxybenzenes (for example, hydroquinone), 3-pyrazolidones (for example, 1-phenyl-3-pyrazolidone) and aminophenols (for example, N-methyl-p-aminophenol), etc., can be used either individually or in combination in a black-and-white development bath.

The color development baths which can be used in the development process of this invention preferably consist of an aqueous alkaline solution containing a primary aromatic amine color developing agent as a principal component. A p-phenylenediamine based compound is preferably used for the color developing agent and specific examples include 3-methyl-4-amino-N,N-diethylaniline, 3-methyl-4-amino-N-ethyl-N-(β-hydroxyethyl)aniline, 3-methyl-4-amino-N-ethyl-N-(β-methanesulfonamidoethyl)aniline, 3-methyl-4-amino-N-ethyl-N-(β-methoxyethyl)aniline and sulfates, hydrochlorides, phosphates or p-toluenesulfonates, tetraphenylborates, p-(t-octyl)benzenesulfonates thereof.

Examples of aminophenol based derivatives include, for example, o-aminophenol, p-aminophenol, 4-amino-2-methylphenol, 2-amino-3-methylphenol, 2-oxy-3-amino-1,4-dimethylbenzene, etc.

Those disclosed on pages 226 to 229 of *Photographic Processing Chemistry* by L. F. A. Mason (Focal Press, 1966) and in U.S. Pat. Nos. 2,193,015 and 2,592,364 and, moreover, in Japanese Patent Application (OPI) No. 64933/73 can also be used. Combinations of two or more color developing agents can be used as required.

The processing temperature of the color development bath is preferably within the range from 30° C. to 50° C. and more preferably it is within the range from 33° C. to 45° C.

Furthermore, benzyl alcohol can be used as a development accelerator, but its use should be avoided as far as possible from the point of view of preventing pollution. Other types of compound can be used in place of benzyl alcohol. Examples of such compounds include various pyridinium compounds and other cationic compounds disclosed, for example, in U.S. Pat. No. 2,648,604, Japanese Patent Publication No. 9503/69 and U.S. Pat. No. 3,171,247, etc., cationic dyes such as phenosafranin, neutral salts such as thallium nitrate and potassium nitrate, poly(ethylene glycol) and derivatives thereof disclosed in Japanese Patent Publication No. 9304/69 and U.S. Pat. Nos. 2,533,990, 2,531,832, 2,950,970 and 2,577,127, etc., nonionic compounds such as polythioethers, thioether based compounds disclosed in U.S. Pat. No. 3,201,242, etc., and the other compounds disclosed in Japanese Patent Application (OPI) Nos. 156934/83 and 220344/85.

In rapid development processing, techniques for the prevention of development fog are as important as the means used to accelerate the development process. The use of alkali metal halides such as potassium bromide, sodium bromide and potassium iodide, and organic antifoggants is preferred as antifoggants. Examples of compounds which can be used as organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindene and aminoazaindene, mercapto substituted heterocyclic compounds such as 1-phenyl-5-mercaptotetrazole, 2-mercaptobenzimidazole and 2-mercaptobenzothiazole and, moreover, mercapto substituted aromatic compounds such as thiosalicylic acid. The use of the halides is especially preferred. These antifoggants may be dissolved out of the photosensitive material during processing and may accumulate in the color development bath.

The color development baths may also contain, in addition to the compounds indicated above, pH buffers such as alkali metal carbonates, borates or phosphates; preservatives such as hydroxylamine, N,N-diethylhydroxylamine, triethanolamine, 1,4-diazabicyclo[2,2,-2]octane, the compounds disclosed in West German Patent Application (OLS) No. 2,622,950, sulfites or bisulfites; organic solvents such as diethylene glycol; dye forming couplers; competitive compounds; nucleating agents such as sodium borohydride; auxiliary developing agents such as 1-phenyl-3-pyrazolidone; viscosity imparting agents; and chelating agents such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the aminopolycarboxylic acids typified by the compounds disclosed in Japanese Patent Application (OPI) No. 195845/83, 1-hydroxyethylidene-1,1'-disulfonic acid, aminophosphonic acids such as the organic phosphonic acids disclosed in *Research Disclosure,* No. 18170 (May, 1979), aminotris(methylenephosphonic acid), ethylenediamine-N,N,N',N'-tetramethylenephosphonic acid, etc., and the phosphonocarboxylic acids disclosed in Japanese Patent Application (OPI) Nos. 102726/77, 42730/78, 121127/79, 4024/80, 4025/80, 126241/80, 65955/80 and 65956/80 and in *Research Disclosure,* No. 18170 (May, 1979).

The color development bath can be divided into two or more baths as required, color developer replenisher can be replenished from the first bath or the last bath, and the development time can be shortened and the amount of replenishment can be reduced.

Usually, the color photographic material is bleached after color development. Moreover, the bleaching process may be carried out simultaneously with the fixing process in a so-called bleach-fix process or the bleaching process can be carried out separately. Compounds of multivalent metals such as iron(III), cobalt(III), chromium(VI), copper(II), etc., peracids, quinones, and nitroso compounds, etc., can be used as bleaching agents. For example, ferricyanides, dichromates, organic complex salts of iron(III) or cobalt(III), for example, complex salts with aminopolycarboxylic acids such as ethylenediaminetetraacetic acid, diethylenetriaminepentaacetic acid, nitrilotriacetic acid, 1,3-diamino-2-propanoltetraacetic acid, etc., or with organic acids such as citric acid, tartaric acid, malic acid, etc., persulfates, manganates and nitrosophenols can all be used for this purpose. Of these compounds potassium ferricyanide, (ethylenediaminetetraacetato) iron(III) sodium salt and (ethylenediaminetetraacetato) iron(III) ammonium salt, (triethylenetetraminepentaacetato) iron(III) ammonium salt and the persulfates are especially useful. (Ethylenediaminetetraacetato) iron(III) complex salts can be used in an independent bleach bath or in a single bleach-fix bath.

Various accelerators can be used conjointly as required in the bleach bath or bleach-fix bath. For example, use can be made of bromine ions and iodine ions, and use can also be made of the thiourea based compounds such as those disclosed in U.S. Pat. No. 3,706,561, Japanese Patent Publication Nos. 8506/70 and 26586/74 and Japanese Patent Application (OPI) Nos. 32735/78, 36233/78 and 37016/78, or the thiol based compounds such as those disclosed in Japanese Patent Application (OPI) Nos. 124424/78, 95631/78, 57831/78, 32736/78, 65732/78 and 52534/79 and U.S. Pat. No. 3,893,858, etc., or the heterocyclic compounds disclosed in Japanese Patent Application (OPI) Nos. 59644/74, 140129/75, 28426/78, 141623/78, 104232/78 and 35727/79, etc., or the thioether based compounds disclosed in Japanese Patent Application (OPI) Nos. 20832/77, 25064/80 and 26506/80, etc., or the quaternary amines disclosed in Japanese Patent Application (OPI) No. 84440/73, etc., or the thiocarbamoyls disclosed in Japanese Patent Application (OPI) No. 42394/74.

Thiosulfates, thiocyanates, thioether based compounds, thioureas, large amounts of iodides, etc., can be used as fixing agents, but the use of the thiosulfates is preferred. The use of sulfite or bisulfite salts, or, alternatively, of carbonyl bisulfite addition compounds, as a preservative is preferred in the bleach-fix and fixing baths.

Usually a washing process is carried out after the bleach-fix or fixing process. A variety of known compounds can be added to prevent precipitation and to economize on water usage in the water washing process. For example, water softening agents such as inorganic phosphoric acid, aminopolycarboxylic acids, organic phosphoric acids, etc., can be used to prevent precipitation from occurring, disinfectants and biocides can be added to prevent the growth of various bacteria, algae and fungi, gelatin hardening agents as typified by magnesium salts and aluminum salts, and surfactants for reducing the drying load and preventing the occurrence of uneven drying, etc., can be added as required. Furthermore, the compounds disclosed by L. E. West in *Photographic Science and Engineering,* 9, 344 (1965) can also be added. The addition of chelating agents and disinfectants is especially preferred. Furthermore, water saving can be accomplished by adopting a multistage (for example, with 2 to 5 stages) counter-flow system for the water washing process. The use of a multistage counter-flow stabilization process as disclosed in Japanese Patent Application (OPI) No. 8543/82 (a so-called stabilization process) before, after, or in place of, the water washing process is preferred in this invention. Hence, in this invention it is preferred to use only the so-called "stabilization process" in place of the conventional "water washing process", without providing a substantial water washing process.

The amount of wash water in this invention differs according to the number of baths in the multistage counter-flow water washing process and the carry-over of components of the previous bath by the photosensitive material, and so it is difficult to establish a definite rule, but a volume ratio of the bleach-fix bath components in the final water washing bath to the amount of the final wash water should be less than $1\times10^{-4}$:1. For example, in the case of a three-bath counter-flow water washing system the use of at least about 1,000 cc of water per square meter of photosensitive material is preferred, and the use of at least 5,000 cc of water per square meter of photosensitive material is more preferable. Furthermore, in cases where water economy is being practiced, the use of from 100 cc to 1,000 cc of water per square meter of photosensitive material is preferred. Furthermore, in cases where the aforementioned stabilization process is being used, a volume ratio of the bleach-fix bath components in the final bath to the amount of the final bath solution should be less than $5\times10^{-2}$:1 and preferably less than $1\times10^{2}$:1.

The water washing temperature employed is between 15° C. and 50° C., and preferably between 20° C. and 45° C.

Various compounds may be added to the stabilizing bath in order to stabilize the images. For example, various buffers (for example, borates, metaborates, borax, phosphates, carbonates, potassium hydroxide, sodium hydroxide, aqueous ammonia, monocarboxylic acids, polycarboxylic acids, etc., either alone or in combination) for adjusting the photosensitive material film pH (for example, to a pH within the range from 3 to 8) and aldehydes such as formalin are typical additives. Various additives such as chelating agents (for example, inorganic phosphoric acid, aminopolycarboxylic acids, organophosphonic acids, aminopolyphophonic acids, phosphonocarboxylic acids, etc.), disinfectants (for example, thiazoles, isothiazoles, halogenated phenols, sulfanilamide, puroxel, benzotriazole, etc.), surfactants, fluorescent whiteners, and gelatin hardening agents, etc., may also be used and two or more compounds for different purposes may be used in combination.

Furthermore, ammonium salts such as ammonium chloride, ammonium nitrate, ammonium sulfate, ammonium phosphate, ammonium sulfite, ammonium thiosulfate, etc., are preferably added as post-processing film pH adjusting agents.

Various additives including those aforementioned may be added during the preparation or manufacture of the silver halide emulsions and photographic materials of this invention and these include those disclosed in *Research Disclosure,* Vol. 176, No. 17643 (December, 1978) and *Research Disclosure,* Vol. 187, No. 18716 (November, 1979). Actual disclosures are made in the places indicated below in these documents.

| Type of Additive | RD 17643 | RD 18716 |
|---|---|---|
| Chemical Sensitizer | Page 23 | Page 648, right column |
| Speed Increasing Agents | | As above |
| Spectral Sensitizers, Supersensitizers | Pages 23–24 | Pages 648, right column to 649, right column |
| Whiteners | Page 24 | |
| Antifoggants and Stabilizers | Pages 24–25 | Page 649, right column |
| Couplers | Page 25 | |
| Organic Solvents | Page 25 | |
| Light Absorbers, Filter Dyes, UV Absorbers | Pages 25–26 | Pages 649, right column to 650, left column |
| Antistaining Agents | Page 25, right column | Page 650 left to right columns |
| Dye Image Stabilizers | Page 25 | |
| Film Hardening Agents | Page 26 | Page 651, left column |
| Binders | Page 26 | As above |
| Plasticizers, Lubricants | Page 27 | Page 650, right column |
| Coating Aids, Surfactants | Pages 26–27 | As above |
| Antistatic Agents | Page 27 | As above |

Examples of the invention are described below, but the invention is not limited by these examples.

EXAMPLE 1

Thirty grams of lime-treated gelatin was added to 1 liter of distilled water and dissolved at 40° C., after which 6.5 g of sodium chloride, 0.65 g of sodium hydroxide, 0.02 g of N,N-dimethylethylenethiourea and 0.27 g of adenine were added and the temperature was raised to 52.5° C. A solution obtained by dissolving 62.5 g of silver nitrate in 750 cc of distilled water and a solution obtained by dissolving 21.5 g of sodium chloride in 500 cc of distilled water were added to and mixed with the above-mentioned solution over a period of 40 minutes while maintaining the temperature of 52.5° C. The emulsion so obtained was examined using an electron microscope, and it was found that the emulsion contained rod-like silver halide crystals as shown in FIG. 1. (Emulsion 101-1 of this invention)

Figure 2:
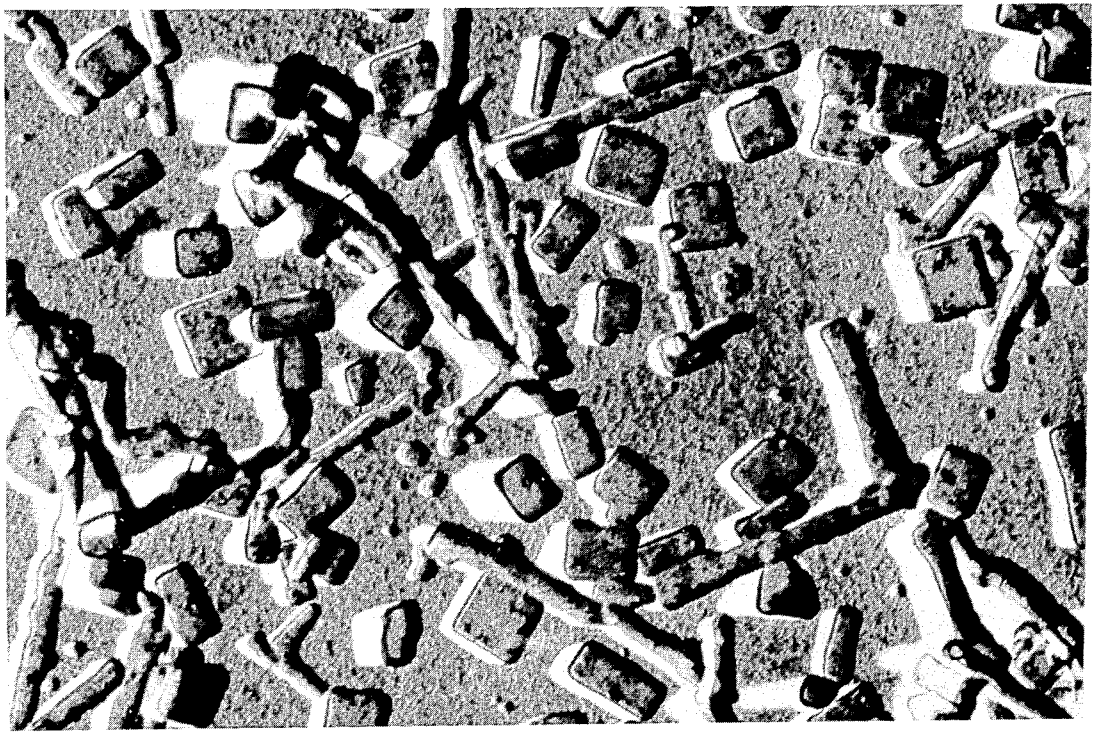

Moreover, a solution of 62.5 g of silver nitrate in 500 cc of distilled water and a solution of 21.5 g of sodium chloride in 300 cc of distilled water were added to and mixed with this emulsion over a period of 20 minutes at a temperature of 52.5° C. The emulsion so obtained was examined using an electron microscope and it was found that the emulsion contained rod-like silver halide crystals as shown in FIG. 2. (Emulsion 101-2 of this invention)

EXAMPLE 2

Figure 3:
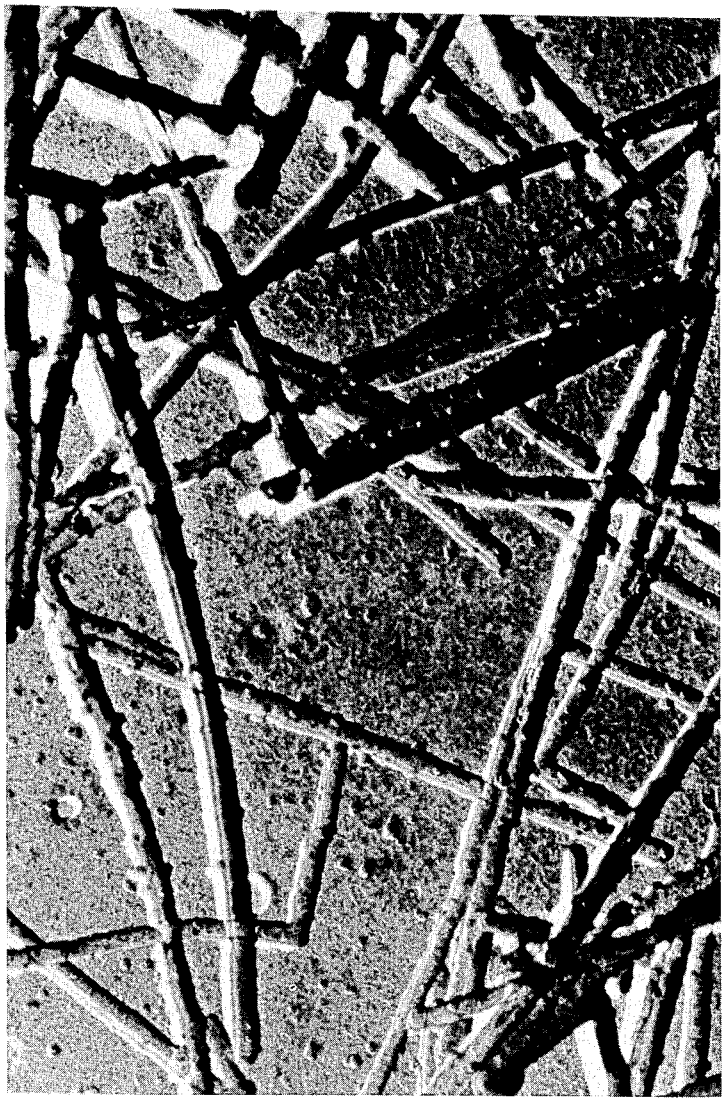

Thirty grams of lime-treated gelatin was added to 1 liter of distilled water and dissolved at 40° C., after which 6.5 g of sodium chloride, 0.65 g of sodium hydroxide, 0.02 g of N,N'-dimethylethylenethiourea and 0.27 g of adenine were added, and the temperature was raised to 65° C. A solution of 62.5 g of silver nitrate in 750 cc of distilled water and a solution of 21.9 g of potassium bromide and 10.8 g of sodium chloride in 500 cc of distilled water were added to and mixed with the above-mentioned solution over a period of 40 minutes while maintaining the temperature of 65° C. The emulsion so obtained was examined using an electron microscope and it was found that the emulsion contained rod-like silver halide crystals as shown in FIG. 3. (Emulsion 102-1 of this invention)

Figure 4:
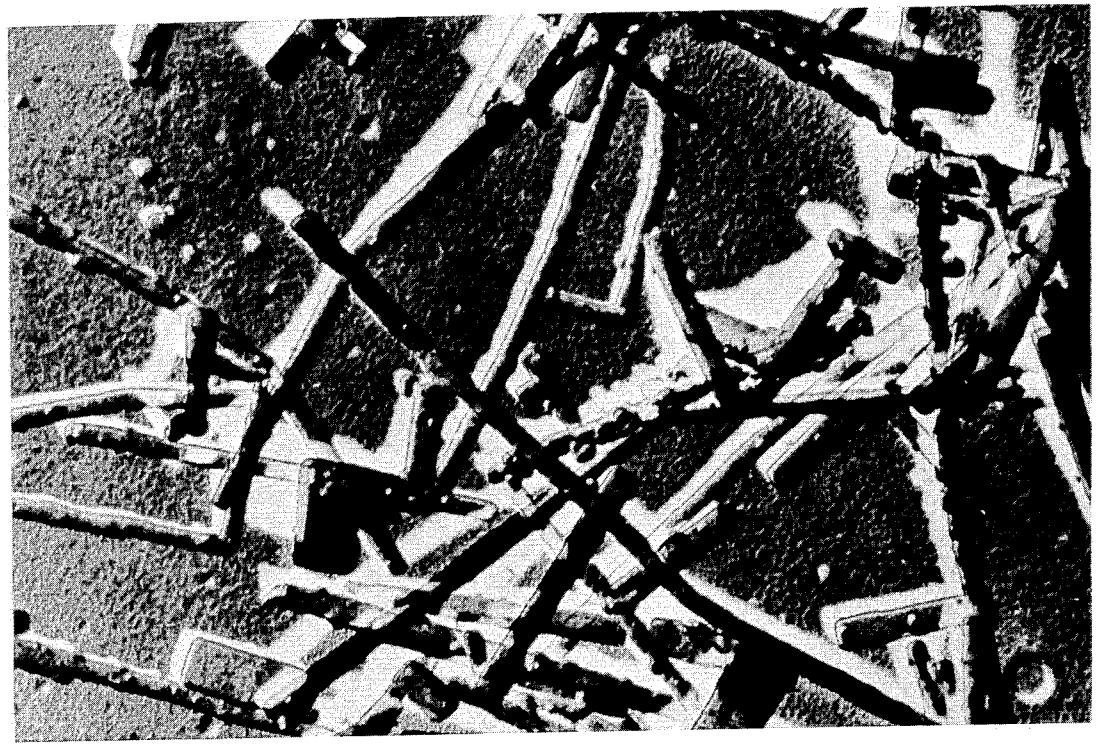

Moreover, a solution of 62.5 g of silver nitrate in 500 cc of distilled water and a solution of 21.9 g of potassium bromide and 10.8 g of sodium chloride in 300 cc of distilled water were added to and mixed with this emulsion over a period of 20 minutes at a temperature of 65° C. The emulsion so obtained was examined using an electron microscope, and it was found that the emulsion contained rod-like silver halide crystals as shown in FIG. 4. (Emulsion 102-2 of this invention)

EXAMPLE 3

Figure 5:
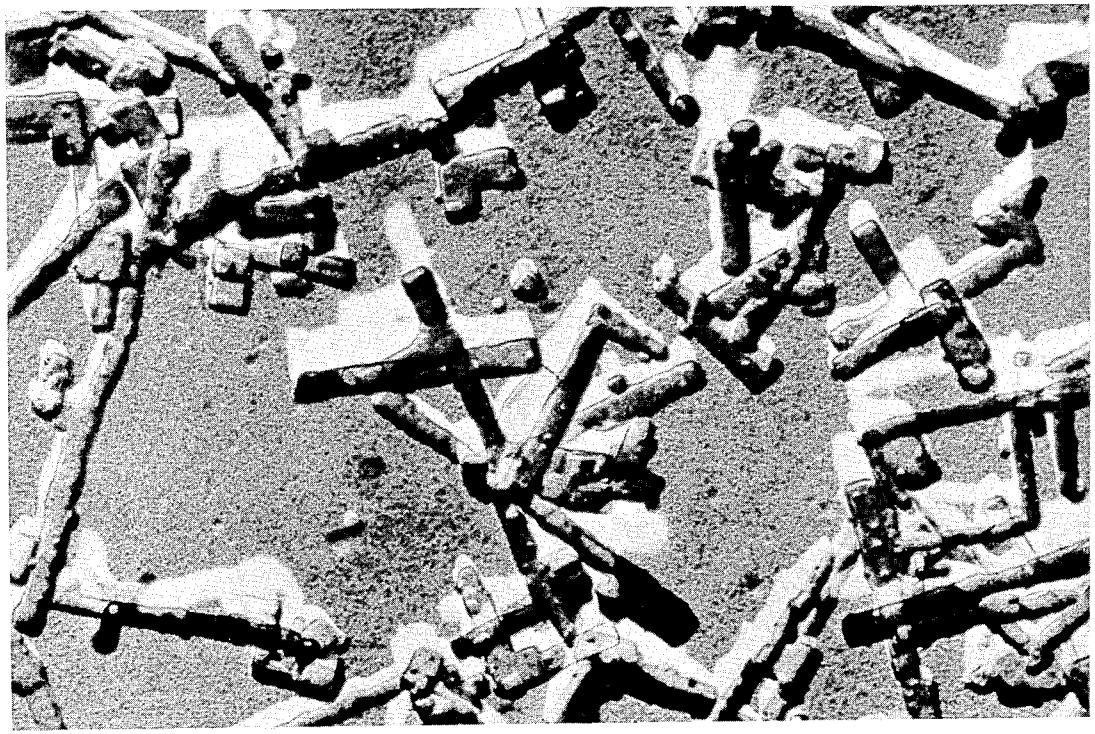

Moreover, a solution of 62.5 g of silver nitrate in 500 cc of distilled water and a solution of 21.9 g of potassium bromide and 10.8 g of sodium chloride in 300 cc of distilled water were added to and mixed with Emulsion 101-1 of this invention as prepared in Example 1 over a period of 20 minutes while maintaining the temperature of 65° C. The emulsion so obtained was examined using an electron microscope, and it was found that the emulsion contained rod-like silver halide crystals as shown in FIG. 5. (Emulsion 103 of this invention)

EXAMPLE 4

Figure 6:
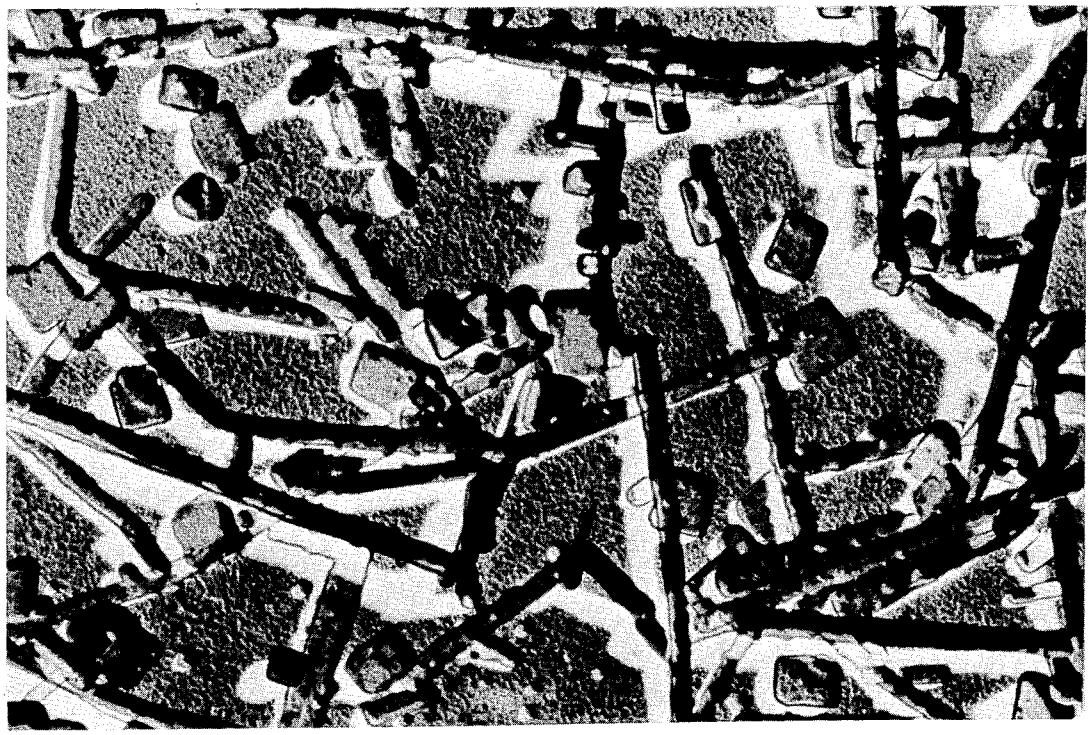

Moreover, a solution of 62.5 g of silver nitrate in 500 cc of distilled water and a solution of 21.5 g of sodium chloride in 300 cc of distilled water were added to and mixed with Emulsion 102-1 of this invention prepared in Example 2 over a period of 20 minutes while maintaining a temperature of 52.5° C. The emulsion so obtained was examined using an electron microscope, and it was found that the emulsion contained rod-like silver halide crystals as shown in FIG. 6. (Emulsion 104 of this invention)

EXAMPLE 5

In this example, the emulsions described below were prepared in order to clarify one of the conditions for the formation of the rod-like emulsion of this invention.

Figure 7:
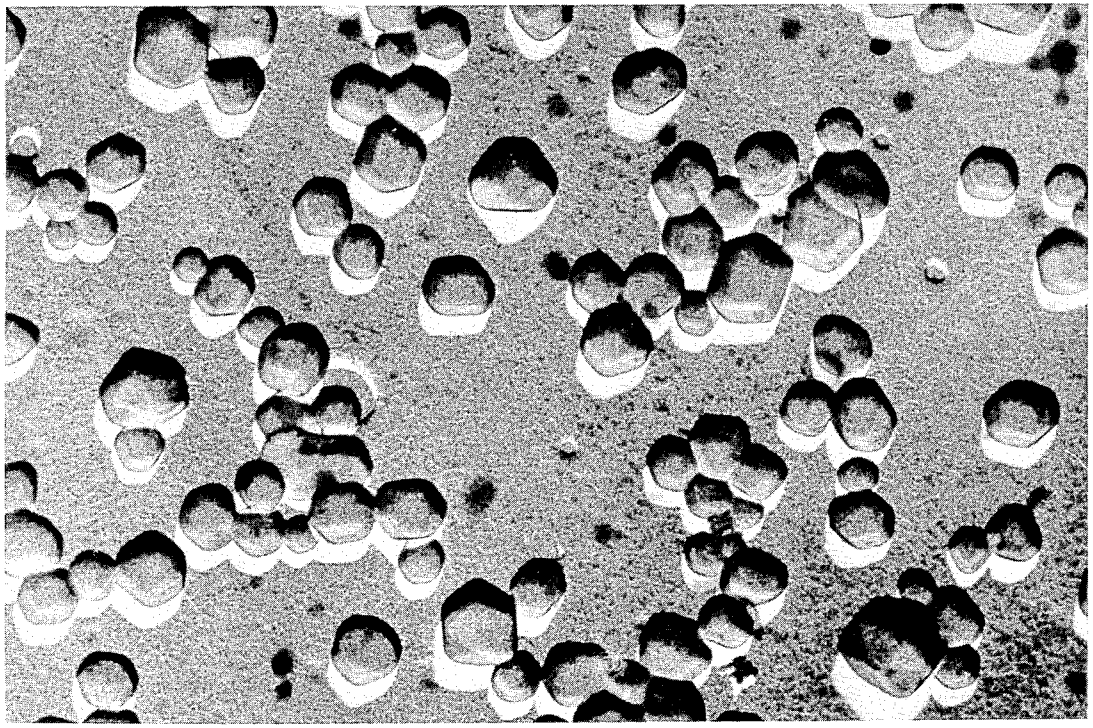

Thirty grams of lime-treated gelatin was added to 1 liter of distilled water and dissolved at 40° C., after which 6.5 g of sodium chloride, 24 cc of 1N sulfuric acid, 0.02 g of N,N'-dimethylethylenethiourea and 0.27 g of adenine were added and the temperature was raised to 52.5° C. A solution of 62.5 g of silver nitrate in 750 cc of distilled water and a solution of 21.5 g of sodium chloride in 500 cc of distilled water were added to and mixed with the above-mentioned solution over a period of 40 minutes while maintaining the temperature of 52.5° C. The emulsion so obtained was examined using an electron microscope, and it was found that the emulsion contained rhombic dodecahedral silver halide grains with in the main a (110) face as shown in FIG. 7. (Comparative Emulsion 105-1)

Figure 8:
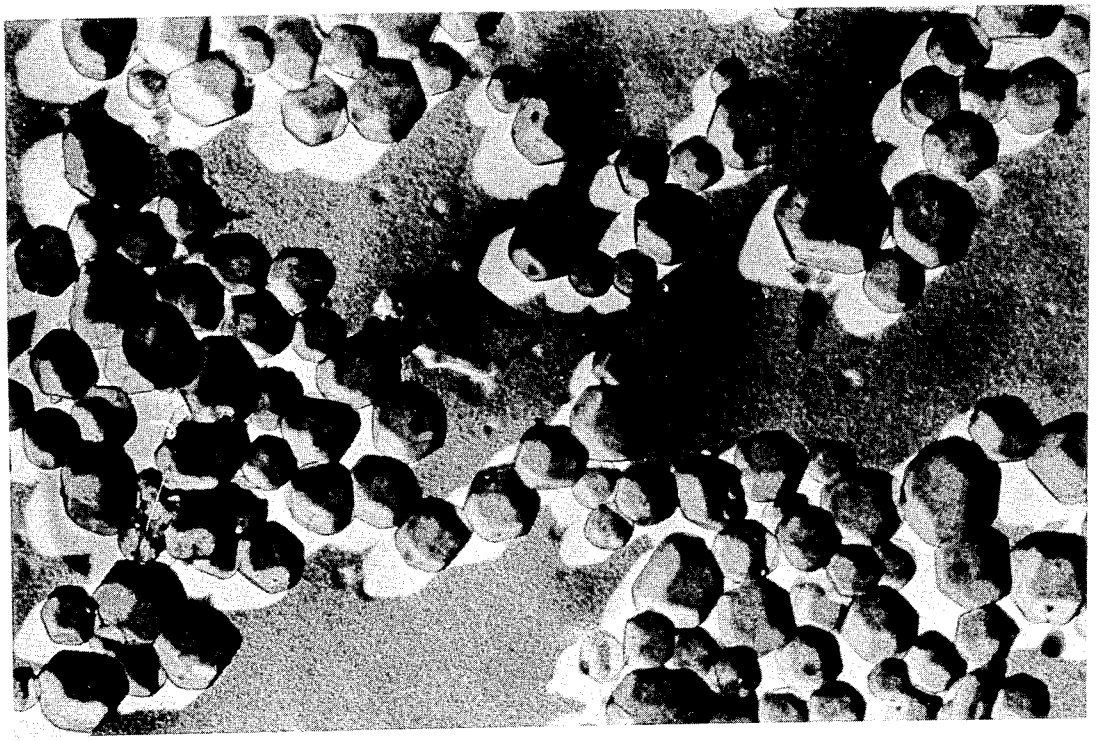

A solution of 62.5 g of silver nitrate in 500 cc of distilled water and a solution of 21.5 g of sodium chloride in 300 cc of distilled water were added to and mixed with this emulsion over a period of 20 minutes while maintaining the temperature of 52.5° C. The emulsion so obtained was examined using an electron microscope, and it was found that the emulsion contained rhombic dodecahedral silver halide crystals formed mainly from the (110) face as shown in FIG. 8. (Comparative Emulsion 105-2)

Figure 9:
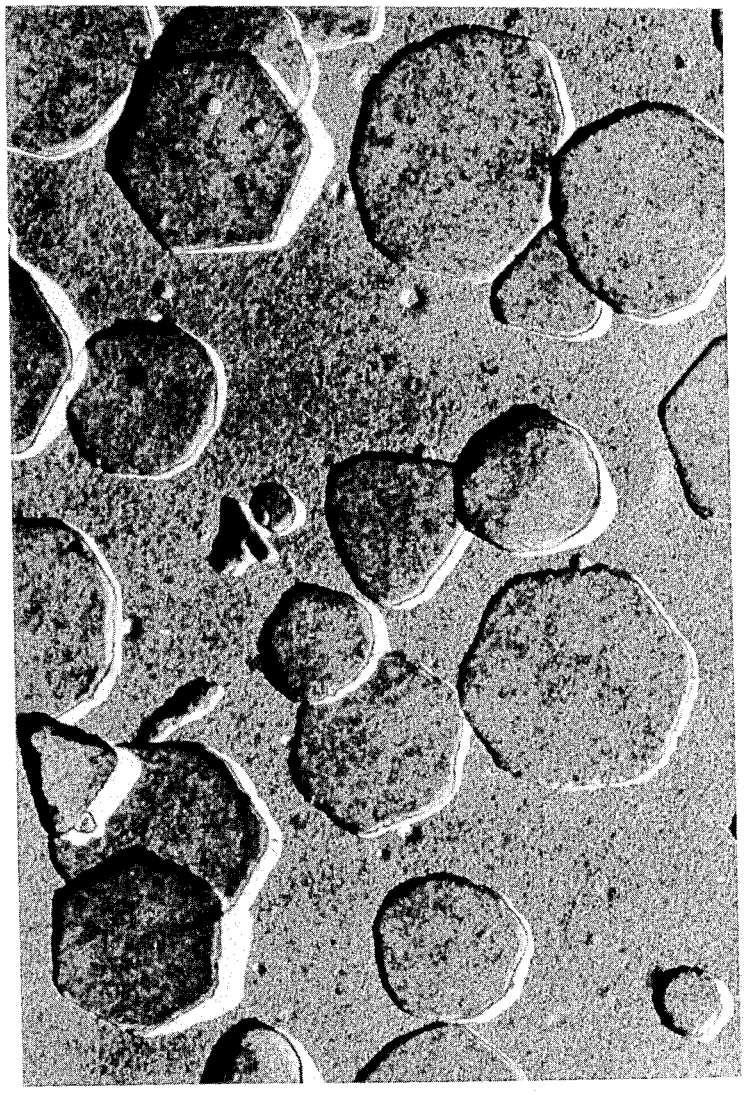
Figure 10:
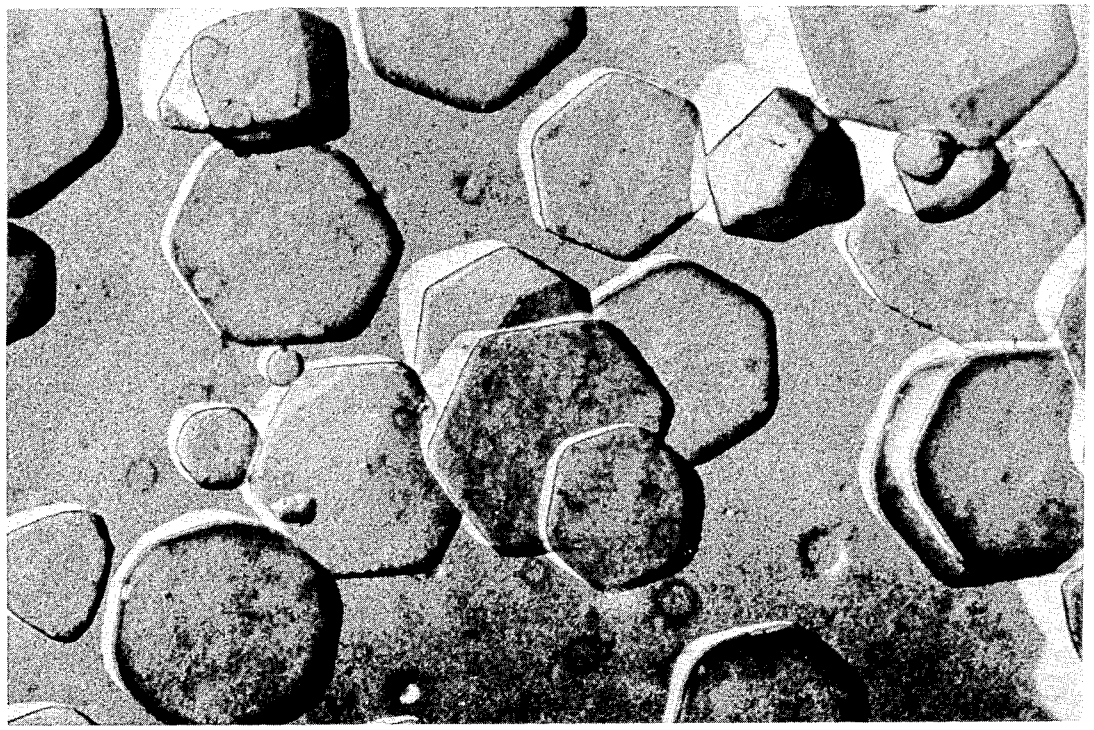

Emulsions were prepared in the same way as Emulsions 105-1 and 105-2 but changing the amount of 1N sulfuric acid from 24 cc to 10 cc. These emulsions, 105-3 and 105-4, are shown in FIGS. 9 and 10. Both of these emulsions comprising tabular silver halide crystal grains of high aspect ratio. (Both comparative emulsions)

Figure 11:
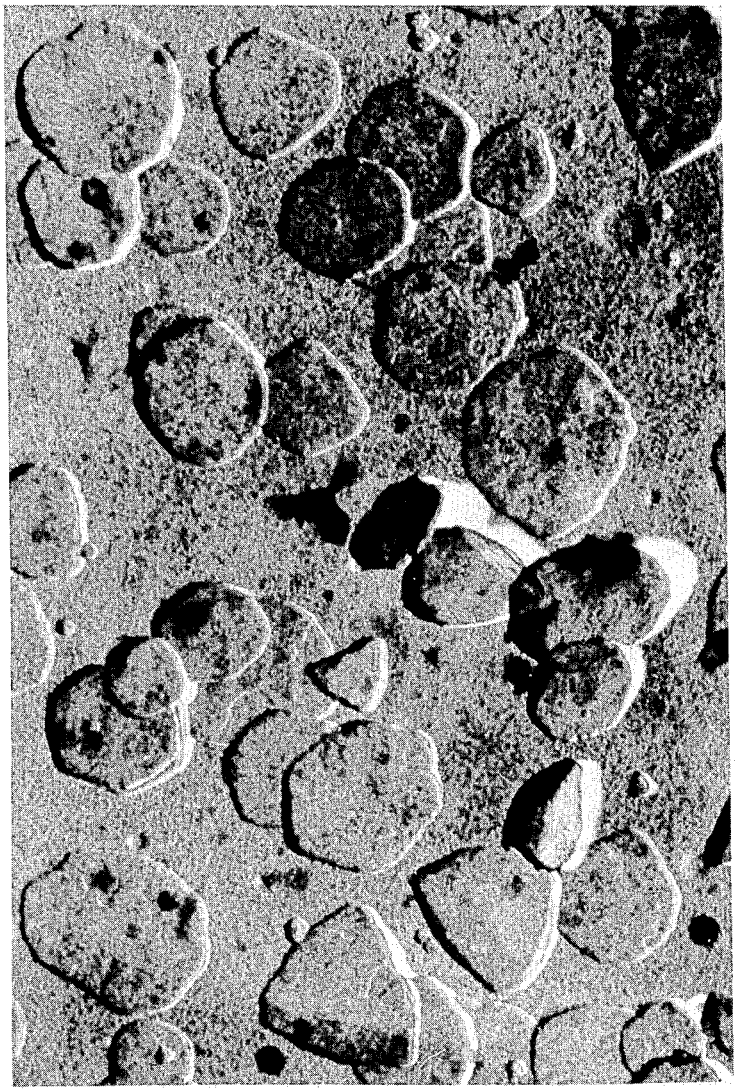
Figure 12:
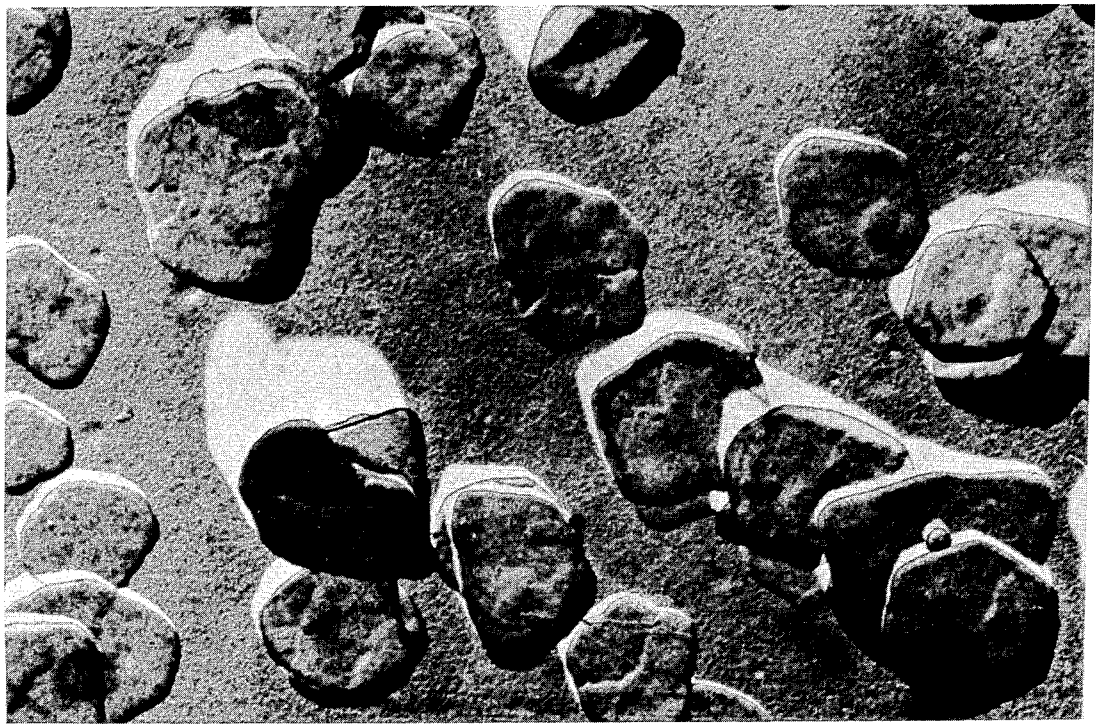

Emulsions were also prepared by changing the amount added of 1N sulfuric acid to 5.4 cc and Emulsions 106-5 and 105-6 were obtained. These are shown in FIGS. 11 and 12. These emulsions also comprising tabular silver halide crystal grains of high aspect ratio and they resembled Emulsions 105-3 and 105-4. (Both comparative emulsions).

Figure 13:
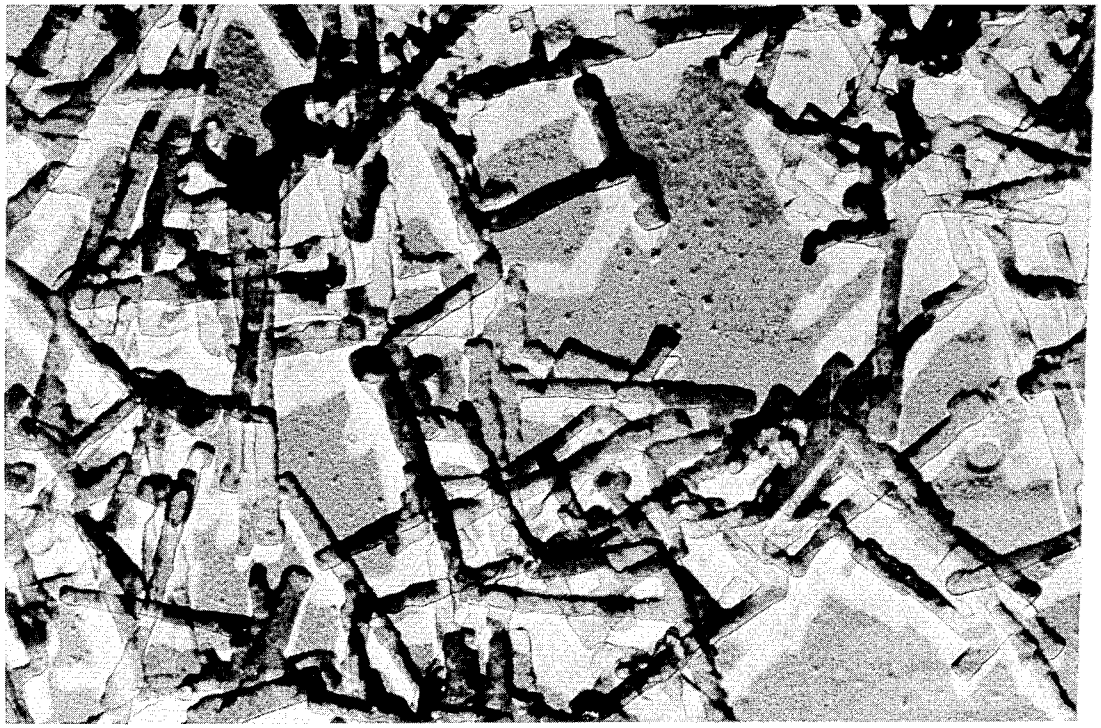
Figure 14:
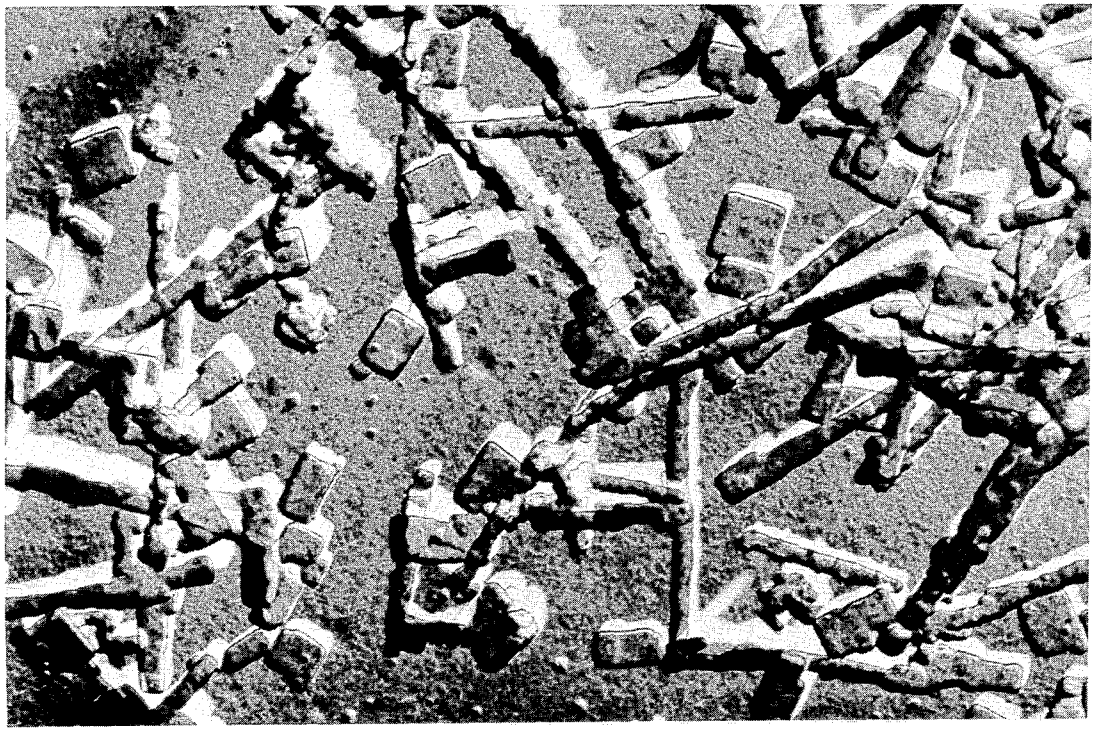

Emulsions 105-7 and 105-8 were prepared in the same way but adding 0.6 g of sodium hydroxide instead of the 1N sulfuric acid. The emulsions obtained contained rod-like silver halide crystal grains as shown in FIGS. 13 and 14. (Both emulsions of this invention)

Figure 15:
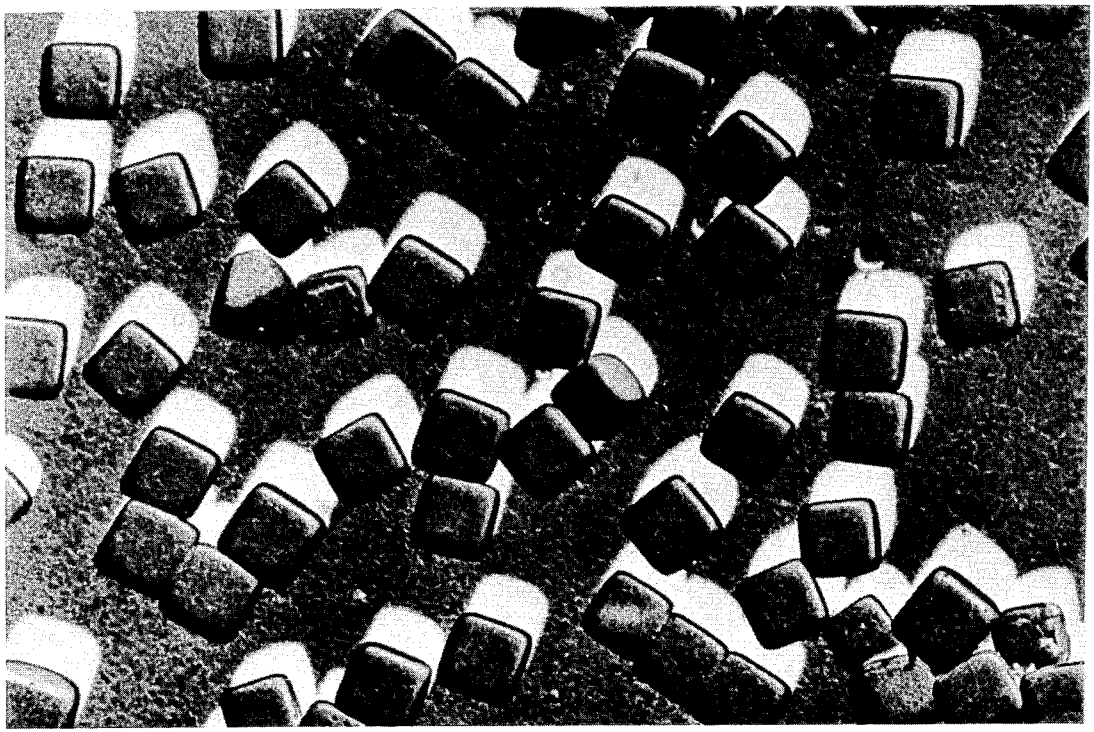
Figure 16:
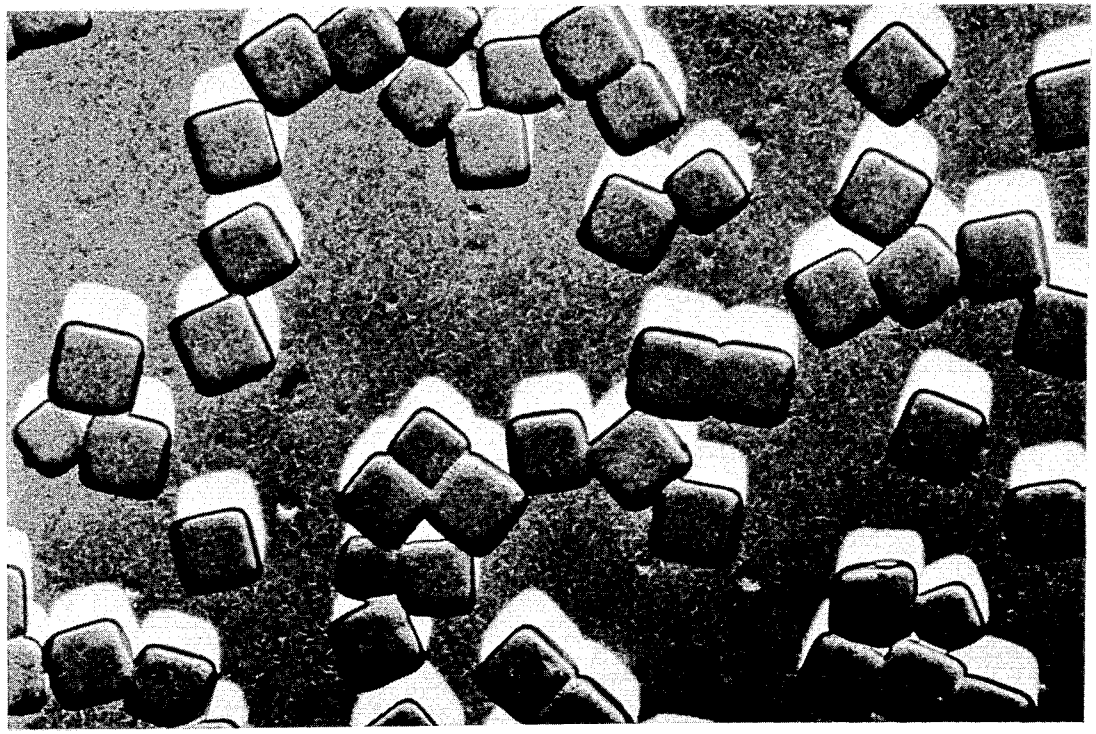

Silver halide crystal grains having forms like those described above were not obtained when the adenine was omitted during the preparation of these emulsions, the emulsions in such cases comprising monodispersed cubic crystal grains of an average grain size of about 0.46 μm. Emulsions prepared with the addition of 24 cc of 1N sulfuric acid and with the addition of 0.6 g of sodium hydroxide were shown as Emulsions 105-9 and 105-10, respectively, in FIGS. 15 and 16. (Both comparative emulsions)

From these results it is clear that when adenine is used the rod-like silver halide crystal grains of this invention can only be formed under conditions of fairly high pH.

Figure 17:
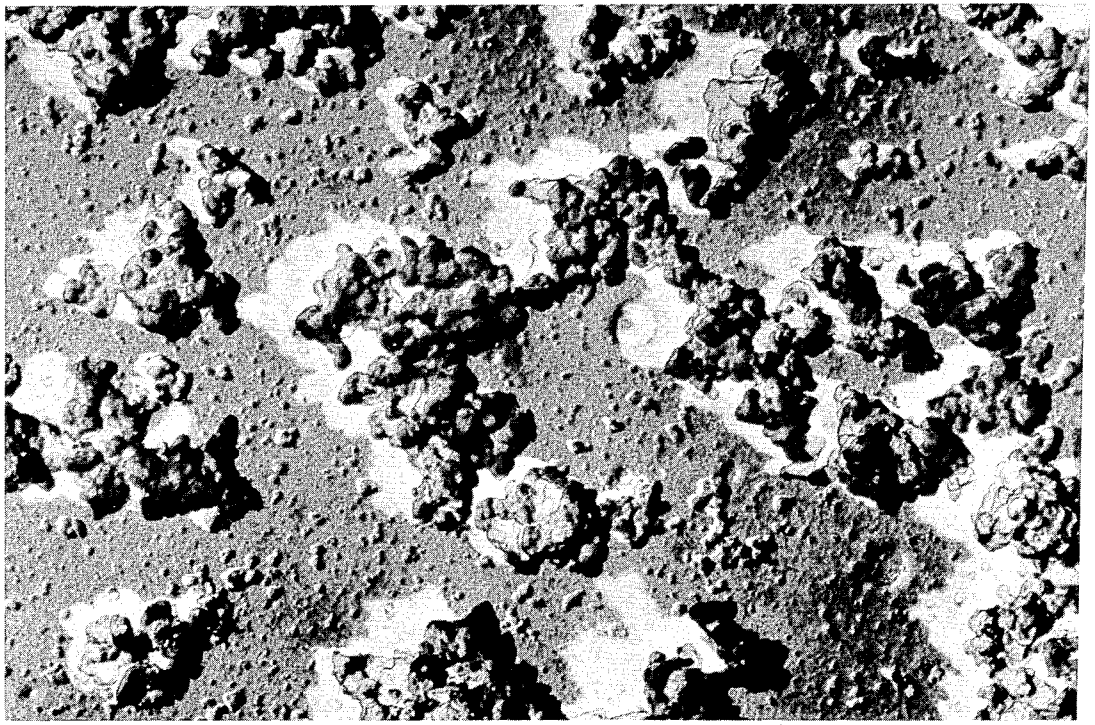
Figure 18:
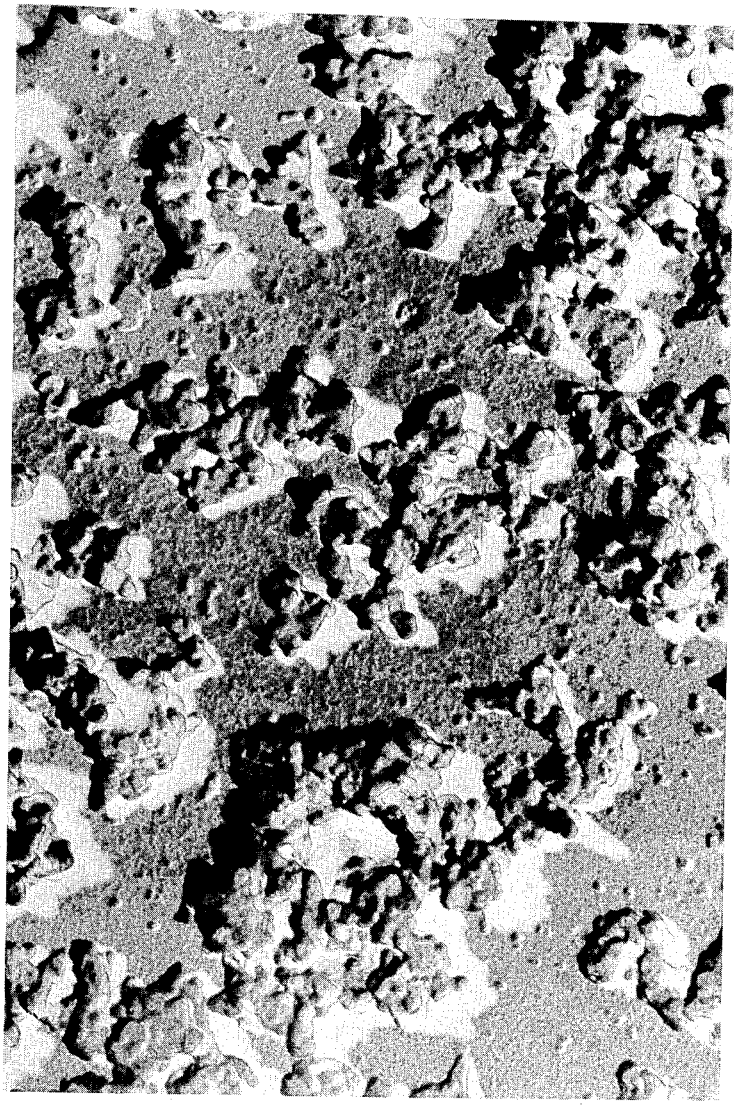

However, even if a certain pH range is selected in the presence of adenine, rod-like silver halide crystal grains of this invention are not always formed, and when the amount of adenine added was doubled to 0.54 g in the preparation of Emulsions 105-7 and 105-8 described above, for example, emulsions which contained silver halide grains of the form shown in FIGS. 17 and 18 (Emulsions 105-11, 105-12) were obtained. These could hardly be called rod-like grains of this invention.

EXAMPLE 6

Figure 19:
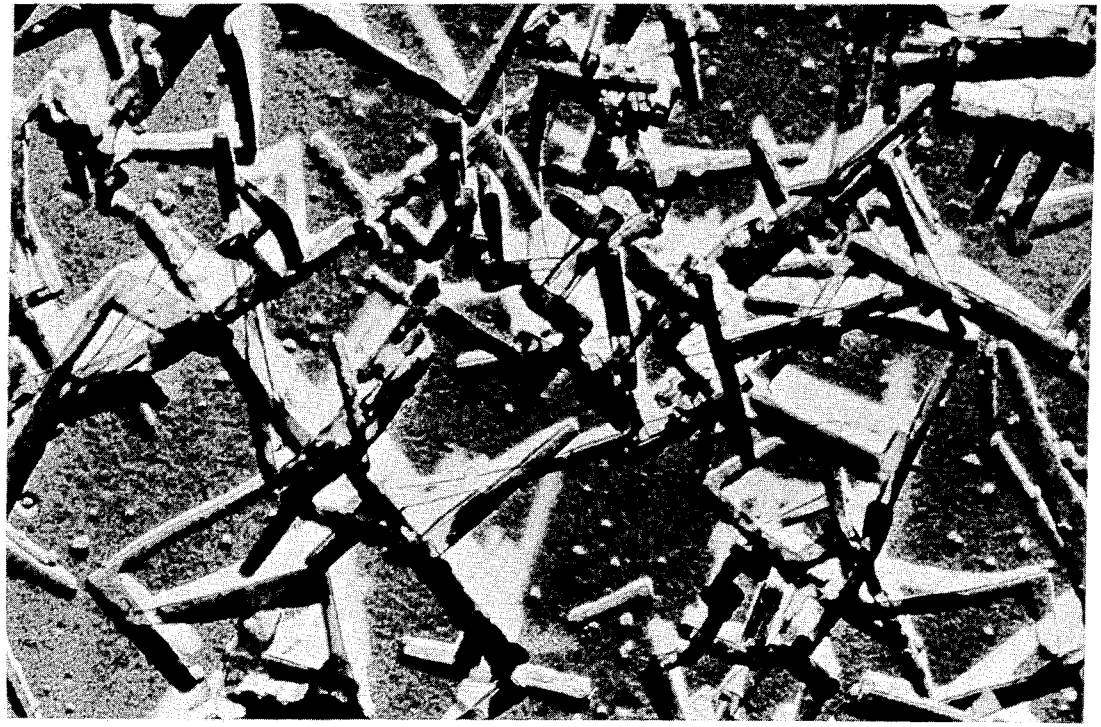

Thirty grams of lime-treated gelatin was added to 1 liter of distilled water and dissolved at 40° C., after which 6.5 g of sodium chloride, 0.29 g of sodium hydroxide, 0.02 g of N,N'-dimethylethylenethiourea and 0.30 g of guanine were added and the temperature was raised to 52.5° C. A solution of 62.5 g of silver nitrate in 750 cc of distilled water and a solution of 21.5 g of sodium chloride in 500 cc of distilled water were added to and mixed with the above-mentioned solution over a period of 40 minutes while maintaining the temperature of 52.5° C. The emulsion so obtained was examined using an electron microscope, and it was found that the emulsion contained rod-like silver halide crystals as shown in FIG. 19. (Emulsion 106-1 of this invention)

Figure 20:
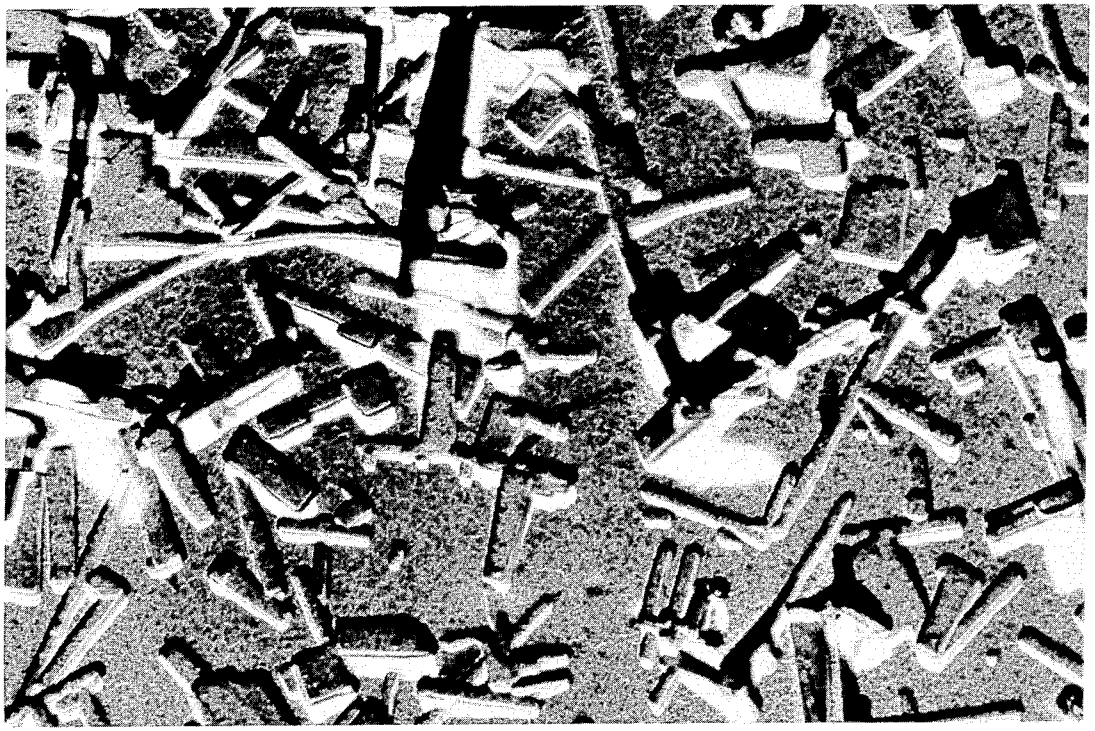

A solution of 62.5 g of silver nitrate in 500 cc of distilled water and a solution of 21.5 g of sodium chloride in 300 cc of distilled water were added to and mixed with this emulsion over a period of 20 minutes at a temperature of 52.5° C. The emulsion so obtained was examined using an electron microscope, and it was found that the emulsion contained rod-like silver halide crystals as shown in FIG. 20. (Emulsion 106-2 of this invention)

EXAMPLE 7

Some of the conditions for forming the rod-like grains when guanine is used are given in this example.

Figure 21:
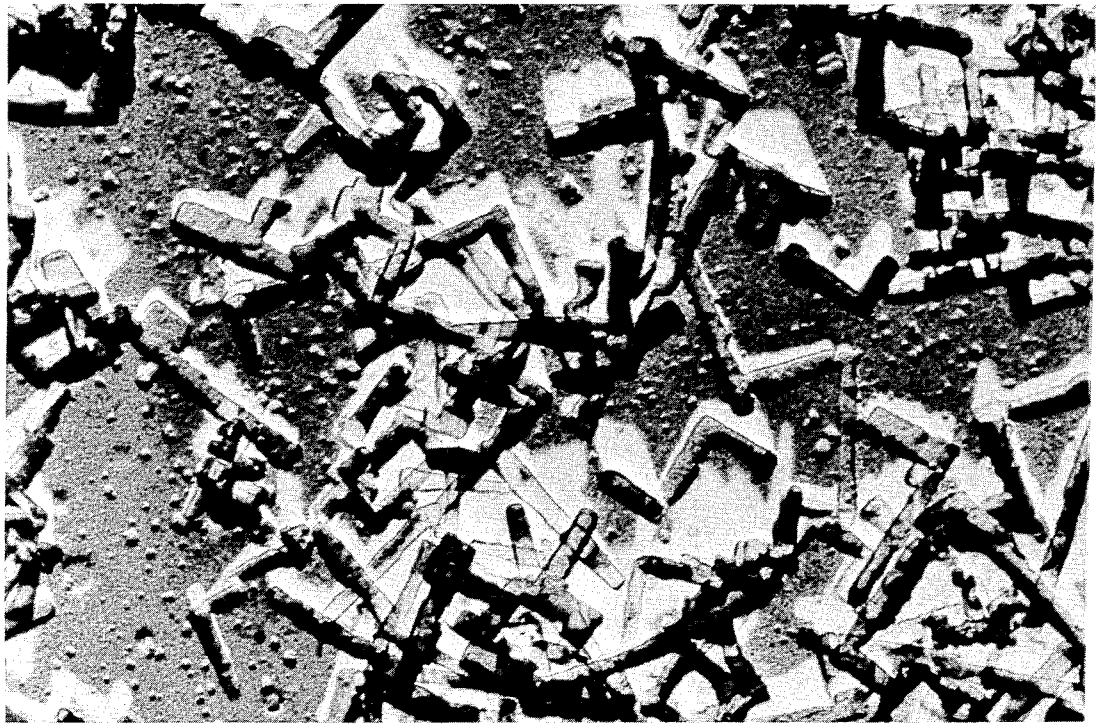
Figure 22:
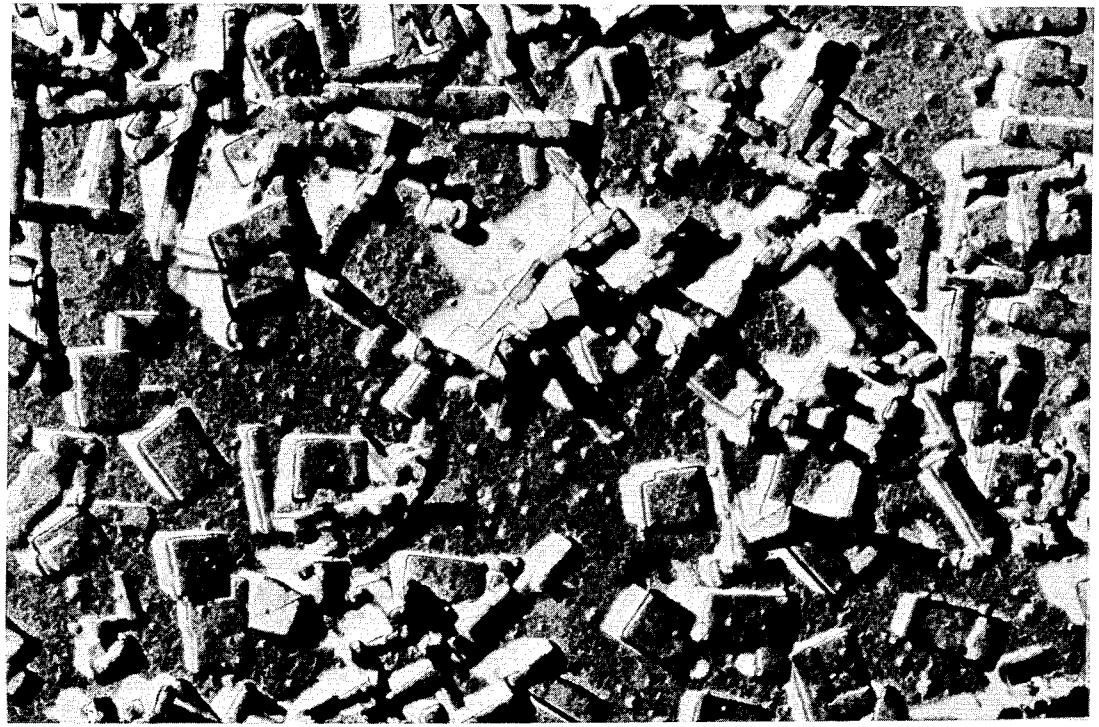

Emulsions 107-1 and 107-2 were prepared in the same way as in Example 6 except that the amount of guanine used in the preparation of Emulsions 106-1 and 106-2 in Example 6 was doubled to 0.6 g. In this case, unlike the case of adenine used in Example 5, rod-like silver halide crystal grains were formed when the amount of guanine was doubled. These emulsions are shown in FIGS. 21 and 22. (Both emulsions of this invention)

Figure 23:
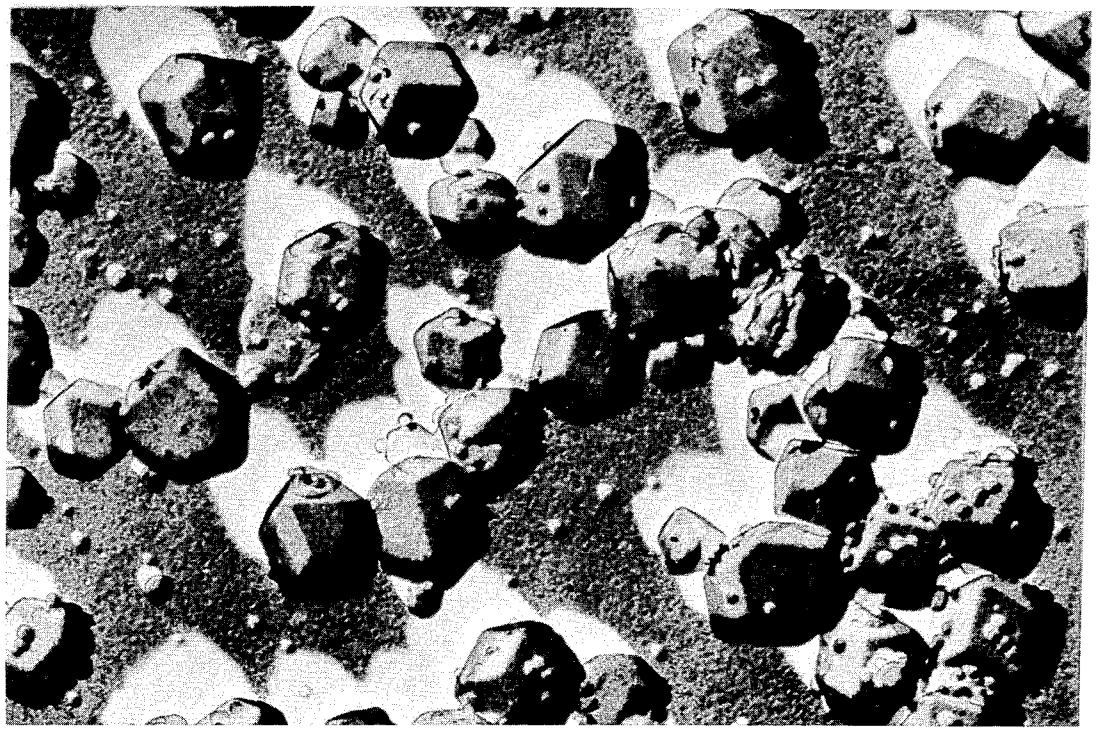
Figure 24:
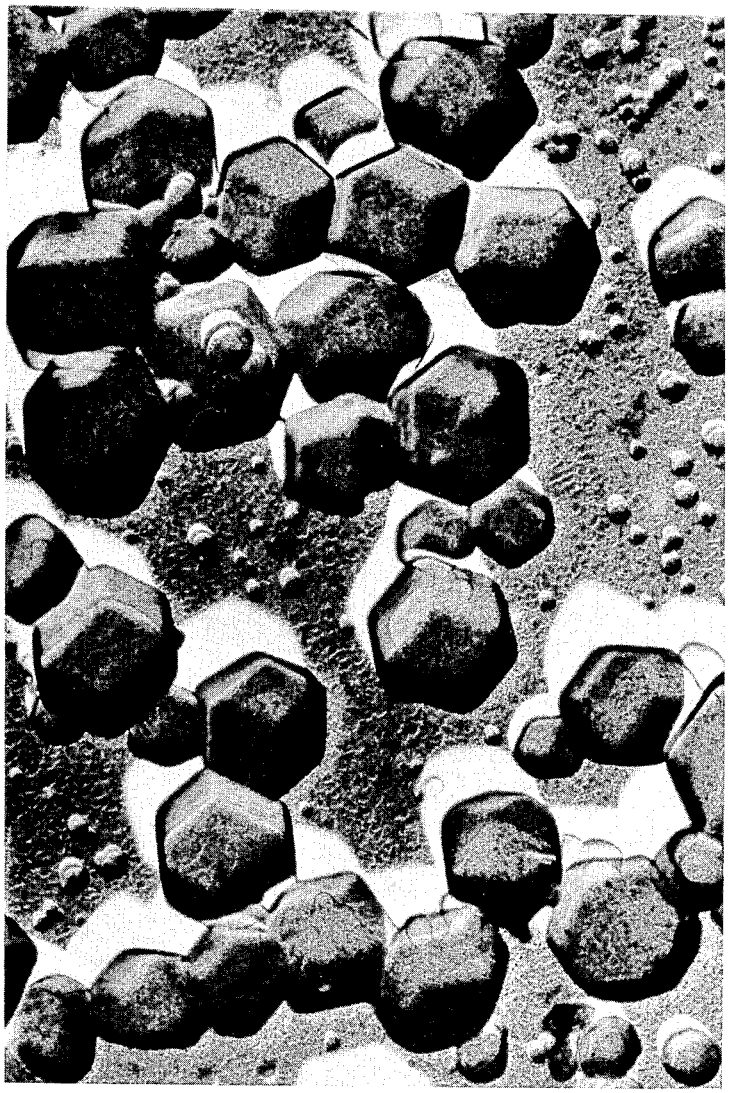

Emulsions 107-3 and 107-4 were prepared in the same way as in Example 6 except that 11.5 cc of 1N sulfuric acid was added in place of 0.29 g of sodium hydroxide used in the preparation of Emulsions 106-1 and 106-2 of this invention in Example 6. Electron micrographs of these emulsions are shown in FIGS. 23 and 24 and they contained rhombic dodecahedral silver halide crystals formed mainly from the (110) face, not rod-like grains. (Comparative emulsions)

Figure 25:
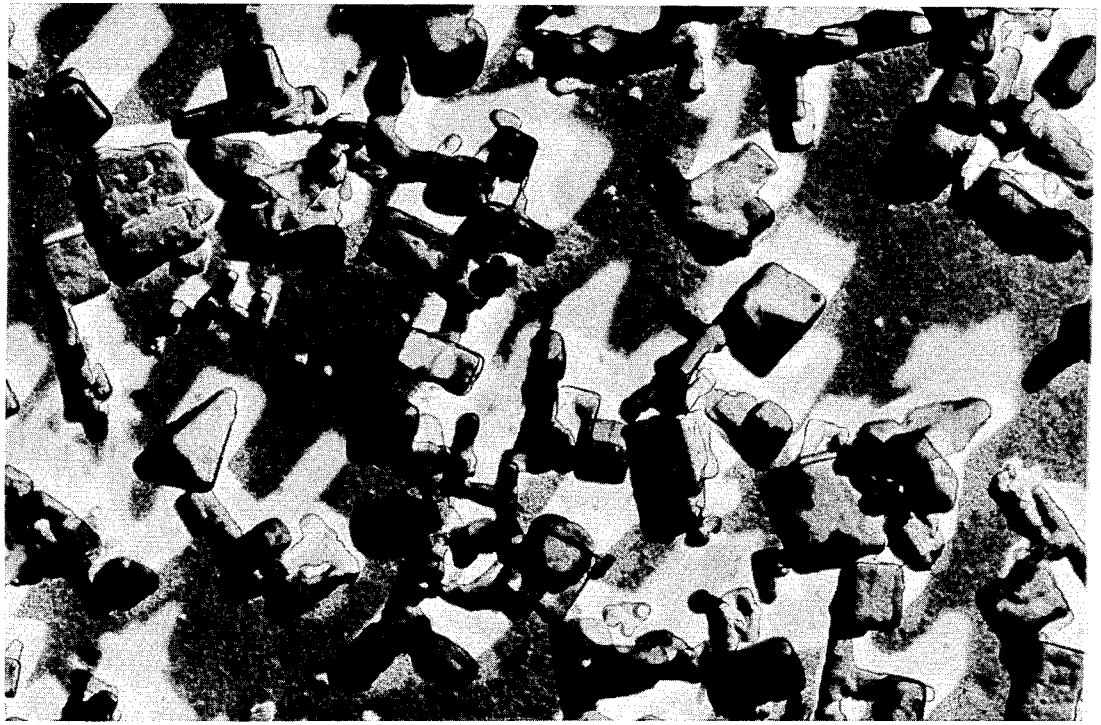
Figure 26:
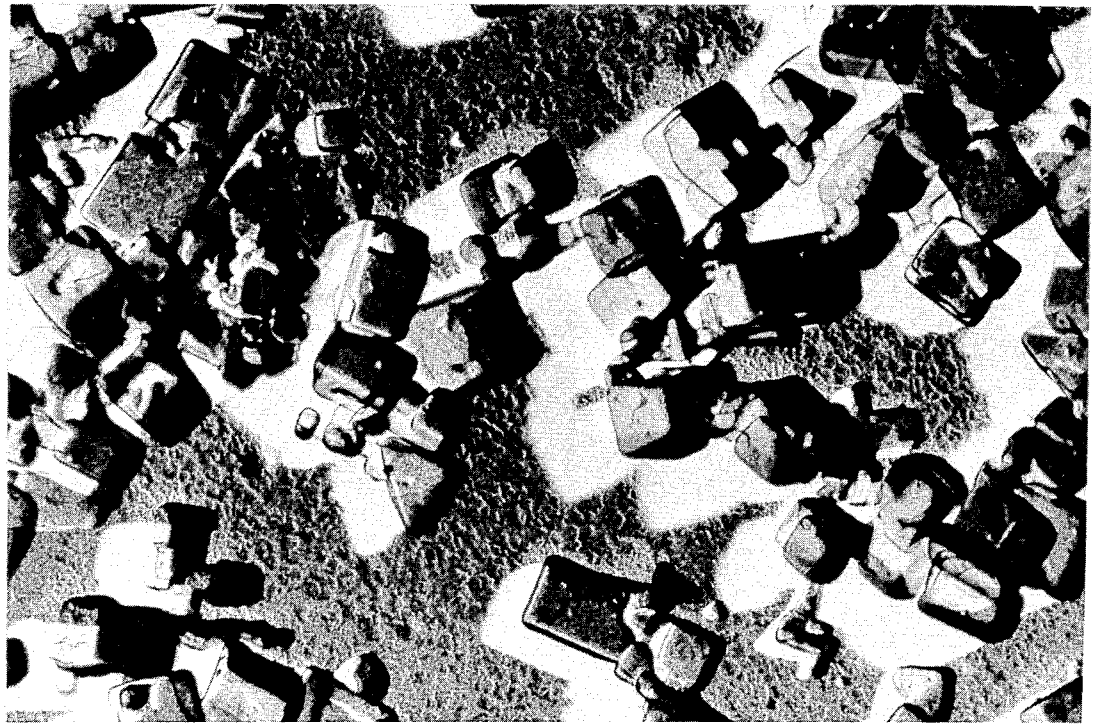

Furthermore, Emulsions 107-5 and 107-6 were prepared in the same way except that the amount of sodium hydroxide used in the preparation of Emulsions 106-1 and 106-2 was increased from 0.29 g to 0.85 g. Electron micrographs of these emulsions are shown in FIGS. 25 and 26, and although Emulsion 107-5 can be said to have rod-like silver halide crystal grains of this invention, Emulsion 107-6 cannot be said to comprise rod-like grains.

However, the fact that rod-like grains of this invention were not formed in Emulsion 107-6 is not due simply to the fact that the emulsion was prepared under conditions of high pH, and it should be possible to obtain rod-like silver halide crystal grains of this invention if the rates of addition of the aqueous silver salt and halide solutions, the silver ion concentration in the reaction system, the reaction temperature and the amount of guanine added were adjusted.

It is clear from this example and Example 5 that emulsions which contain rod-like silver halide crystal grains of this invention can be obtained if the silver halide crystals are formed under conditions of comparatively high pH in the presence of adenine or guanine. It is thought that this condition is related to the acid dissociation constant of adenine and guanine, but the conditions for the formation of rod-like silver halide crystal grains of this invention cannot be defined, as a general rule, as being dependent on the pH.

EXAMPLE 8

Figure 27:
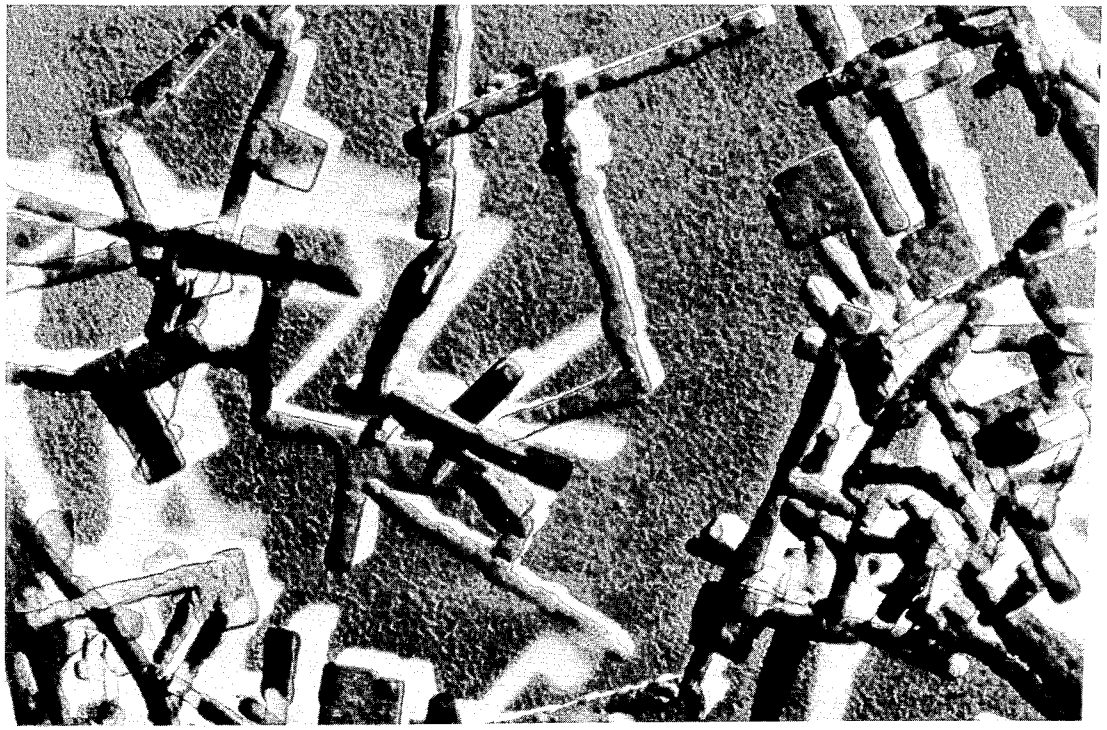

Thirty grams of lime-treated gelatin was added to 1 liter of distilled water and dissolved at 40° C., after which 6.5 g of sodium chloride, 0.65 g of sodium hydroxide, 0.02 g of N,N'-dimethylethylenethiourea and 0.135 g of adenine were added and the temperature was raised to 52.5° C. A solution of 62.5 g of silver nitrate in 750 cc of distilled water and a solution of 21.5 g of of sodium chloride in 500 cc of distilled water were added to and mixed with the above-mentioned solution over a period of 40 minutes while maintaining the temperature of 52.5° C. The emulsion so obtained was examined using an electron microscope, and it was found that the emulsion contained rod-like silver halide crystals as shown in FIG. 27. (Emulsion 108-1 of this invention)

Figure 28:
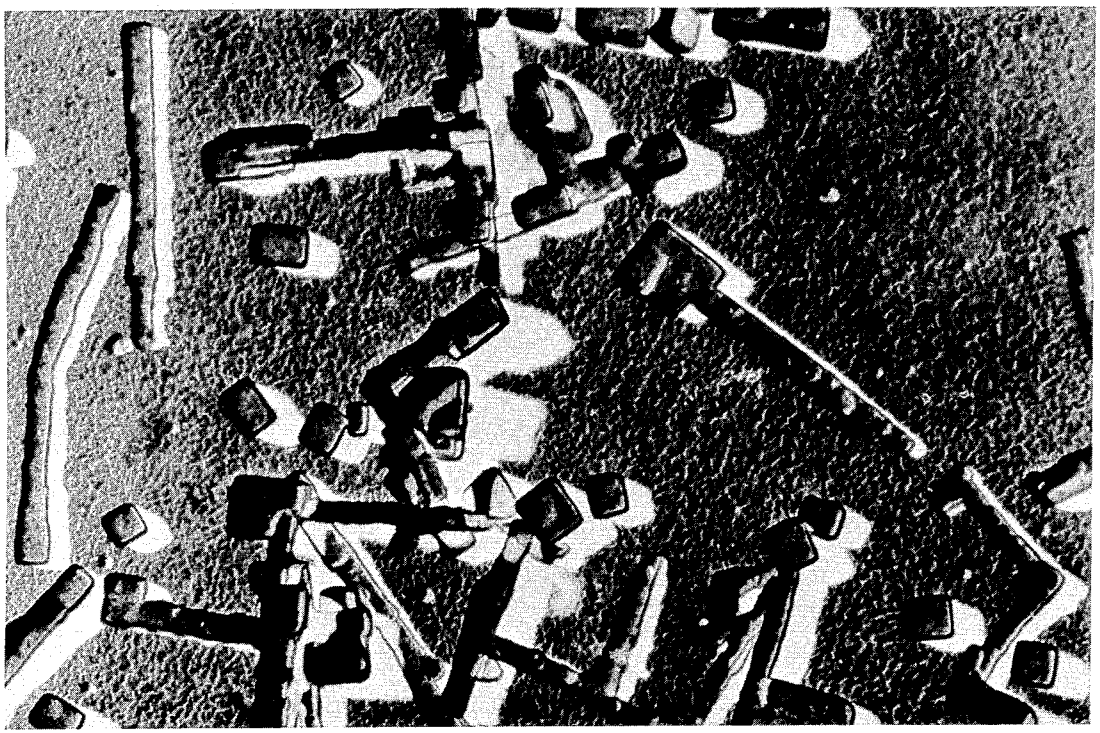

Moreover, a solution of 62.5 g of silver nitrate in 500 cc of distilled water and a solution of 21.5 g of sodium chloride in 300 cc of distilled water were added to and mixed with this emulsion over a period of 20 minutes at a temperature of 52.5° C. The emulsion so obtained was examined using an electron microscope, and it was found that the emulsion contained rod-like silver halide crystals as shown in FIG. 28. (Emulsion 108-2 of this invention)

EXAMPLE 9

Figure 29:
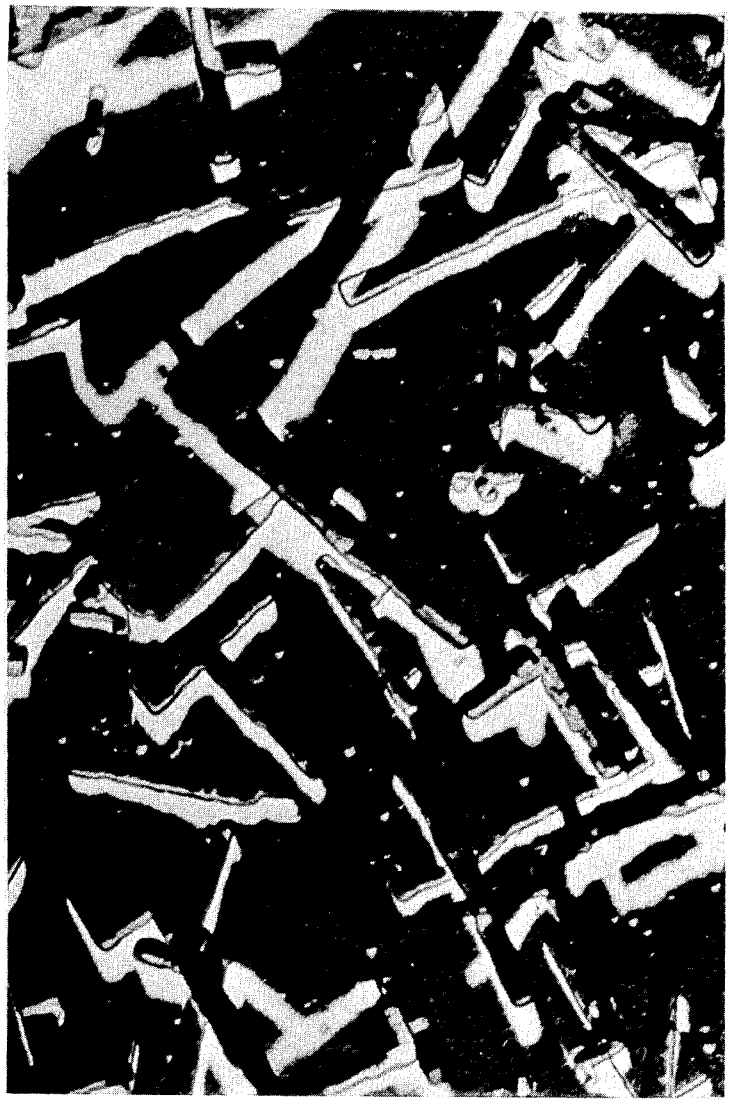

Thirty grams of lime-treated gelatin was added to 1 liter of distilled water and dissolved at 40° C., after which 6.5 g of sodium chloride, 0.65 g of sodium hydroxide, 0.02 g of N,N'-dimethylethylenethiourea and 0.135 g of adenine were added, and the temperature was raised to 52.5° C. A solution of 62.5 g of silver nitrate n 750 cc of distilled water and a solution of 21.5 g of sodium chloride in 500 cc of distilled water were added to and mixed with the above-mentioned solution over a period of 40 minutes while maintaining the temperature of 52.5° C. The emulsion so obtained was examined using an electron microscope, and it was found that the emulsion contained rod-like silver halide crystals as shown in FIG. 29. (Emulsion 109-1 of this invention)

Figure 30:
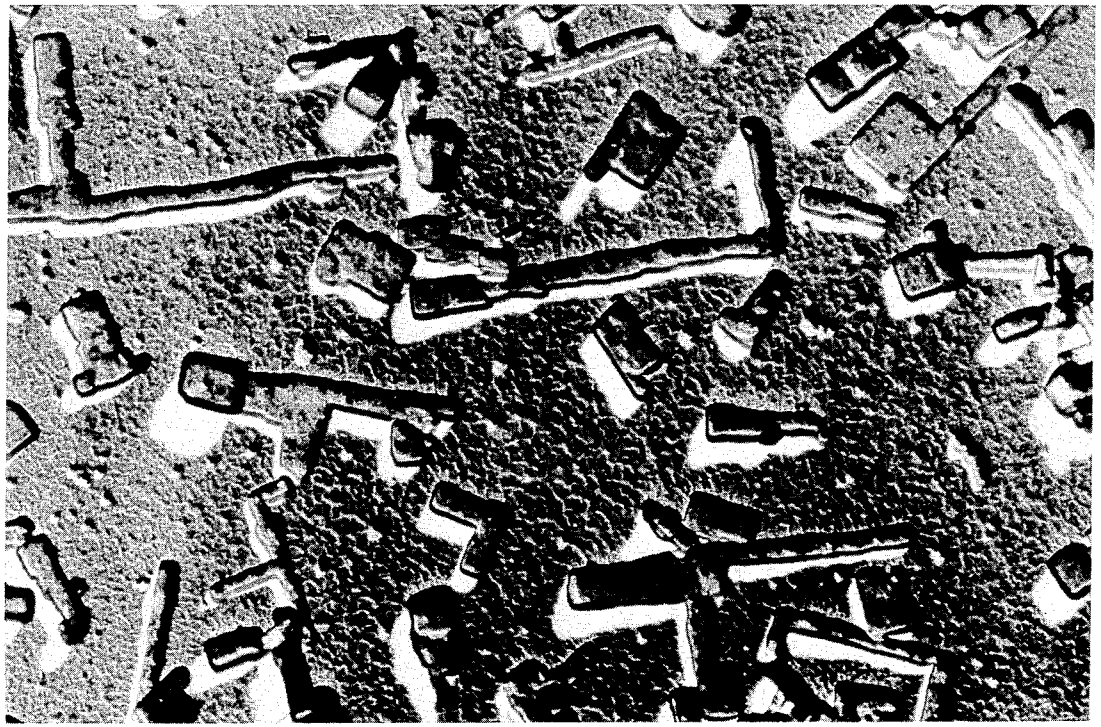

Next, 0.135 g of adenine was added to and dissolved in this emulsion, and then a solution of 62.5 g of silver nitrate in 500 cc of distilled water and a solution of 21.5 g of sodium chloride in 300 cc of distilled water were added to and mixed with the emulsion over a period of 20 minutes at a temperature of 52.5° C. The emulsion so obtained was examined using an electron microscope, and it was found that the emulsion contained rod-like silver halide crystals as shown in FIG. 30. (Emulsion 109-2 of this invention)

EXAMPLE 10

Figure 31:
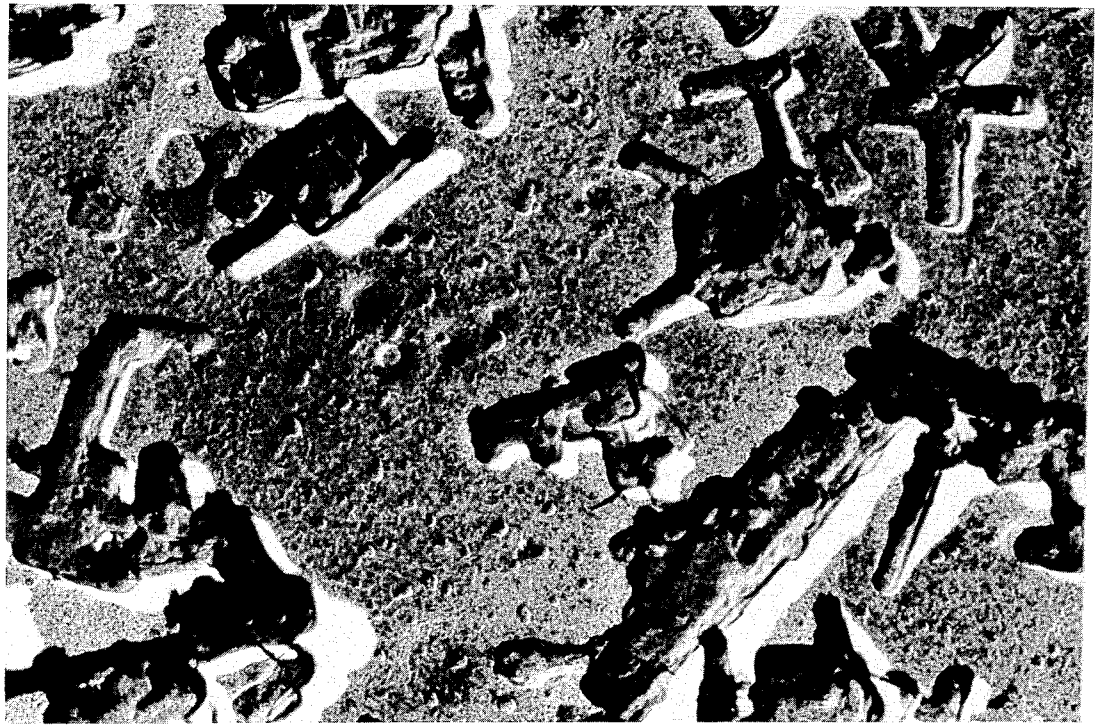

Thirty grams of lime-treated gelatin was added to 1 liter of distilled water and dissolved at 40° C., after which 6.5 g of sodium chloride, 0.65 g of sodium hydroxide, 0.02 g of N,N'-dimethylethylenethiourea and 0.27 g of adenine were added and the temperature was raised to 70° C. A solution of 62.5 g of silver nitrate in 750 cc of distilled water and a solution of 30.6 g of potassium bromide and 6.5 g of sodium chloride in 500 cc of distilled water were added to and mixed with the above-mentioned solution over a period of 40 minutes while maintaining the temperature of 70° C. The emulsion so obtained was examined using an electron microscope, and it was found that the emulsion contained silver halide crystals of a form in which rod-like grains had aggregated as shown in FIG. 31. (Emulsion 110-1 of this invention)

Figure 32:
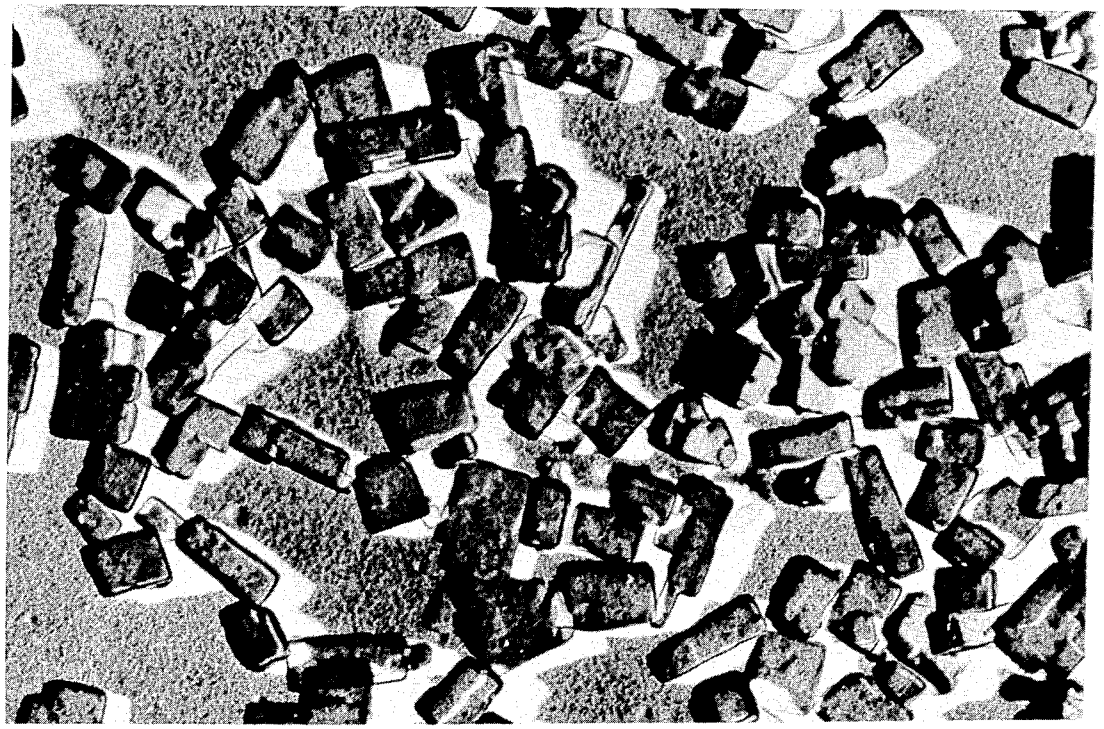

Moreover, a solution of 62.5 g of silver nitrate in 500 cc of distilled water and a solution of 30.6 g of potassium bromide and 6.5 g of sodium chloride in 300 cc of distilled water were added to and mixed with this emulsion over a period of 20 minutes at a temperature of 70° C. The emulsion so obtained was examined using an electron microscope, and it was found that the emulsion contained rod-like silver halide crystals which had form lumps as shown in FIG. 32. (Emulsion 110-2 of this invention)

EXAMPLE 11

Figure 33:
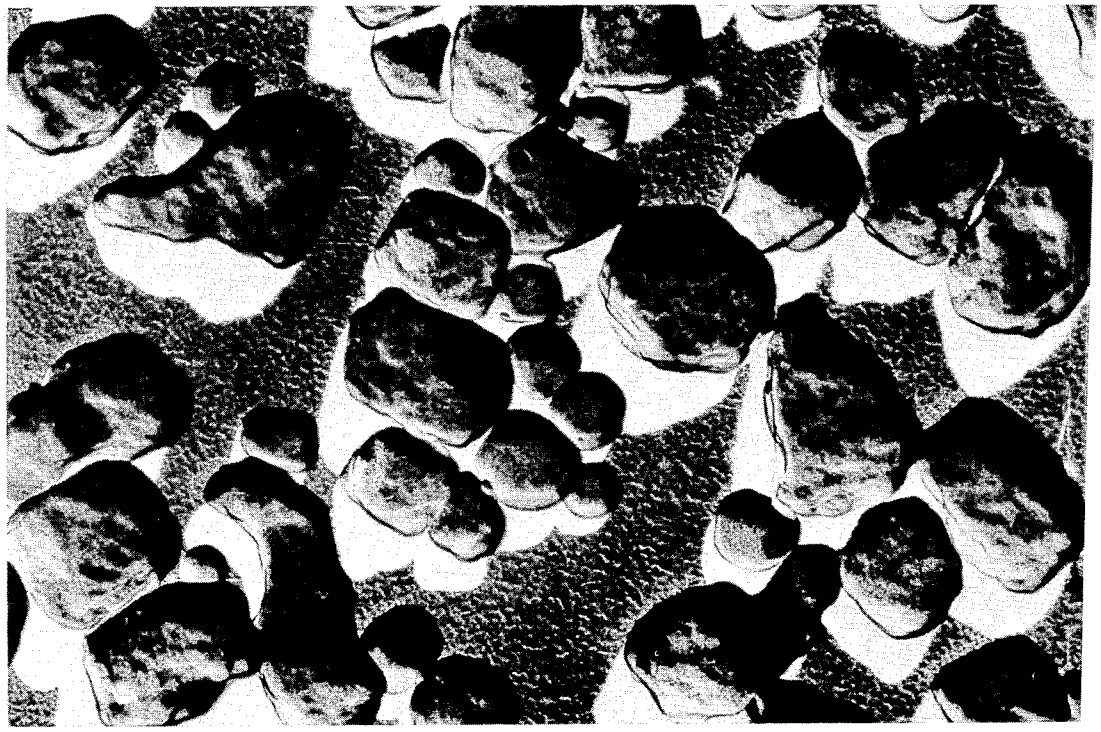

Thirty grams of lime-treated gelatin was added to 1 liter of distilled water and dissolved at 40° C., after which 6.5 g of sodium chloride, 0.65 g of sodium hydroxide, 0.02 g of N,N'-dimethylethylenethiourea and 0.27 g of adenine were added and the temperature was raised to 77.5° C. A solution of 62.5 g of silver nitrate in 750 cc of distilled water and a solution of 43.75 g of potassium bromide in 500 cc of distilled water were added to and mixed with the above-mentioned solution over a period of 40 minutes while maintaining the temperature of 77.5° C. The emulsion so obtained was examined using an electron microscope, and it was found that the emulsion contained silver halide crystals of a somewhat angular irregular form as shown in FIG. 33. (Comparative emulsion 111-1)

Figure 34:
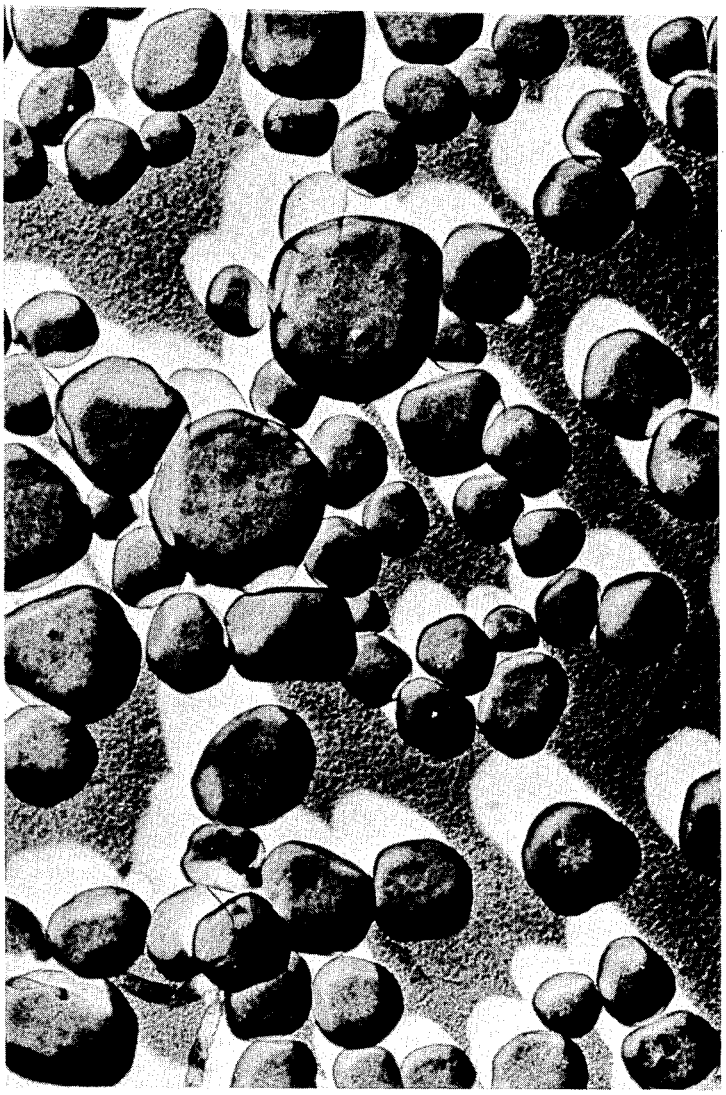

Moreover, a solution of 62.5 g of silver nitrate in 500 cc of distilled water and a solution of 43.75 g of potassium bromide in 300 cc of distilled water were added to and mixed with this emulsion over a period of 20 minutes at a temperature of 77.5° C. The emulsion so obtained was examined using an electron microscope, and it was found that the emulsion contained irregular silver halide crystal grains as shown in FIG. 34. (Emulsion 111-2 of this invention)

On the basis of this example and the examples described so far, it is clear that although rod-like silver halide crystal grains of this invention can be formed, in cases where the halogen composition has a high silver bromide content, and especially when the silver bromide content exceeds about 70 mol %, emulsions which properly satisfy the rod-like silver halide crystal grain requirements of this invention cannot be prepared satisfactorily.

However, it is possible to prepare emulsions which contain rod-like silver halide crystal grains of which the overall silver bromide content is in excess of 70 mol % by subjecting rod-like grains which satisfy the requirements of the invention prepared with a silver bromide content of less than 70 mol %, to halogen exchange with a water-soluble bromide, etc., or by adding an aqueous solution of halide and an aqueous solution of silver salt which has a high silver bromide content successively and depositing silver chlorobromide which has a silver bromide content in excess of 70 mol %.

It is also possible to form rod-like silver halide crystal grains of this invention and to carry out halogen exchange in the same way with a water-soluble iodide, to form rod-like silver halide crystal grains consisting of silver iodochloride or silver iodochlorobromide. Of course, small amounts of silver iodide can also be included in the initial stage of the rod-like silver halide crystal grains. Furthermore, halogen exchange with both bromide and iodide can be carried out simultaneously or consecutively.

In any case, if these methods are employed, it is possible to prepare easily emulsions which contain rod-like silver halide crystal grains of this invention in which the silver iodide and silver bromide content are comparatively high.

Silver halide emulsions of this invention in which preparative methods of this type are used are described in the following examples.

EXAMPLE 12

Figure 35:
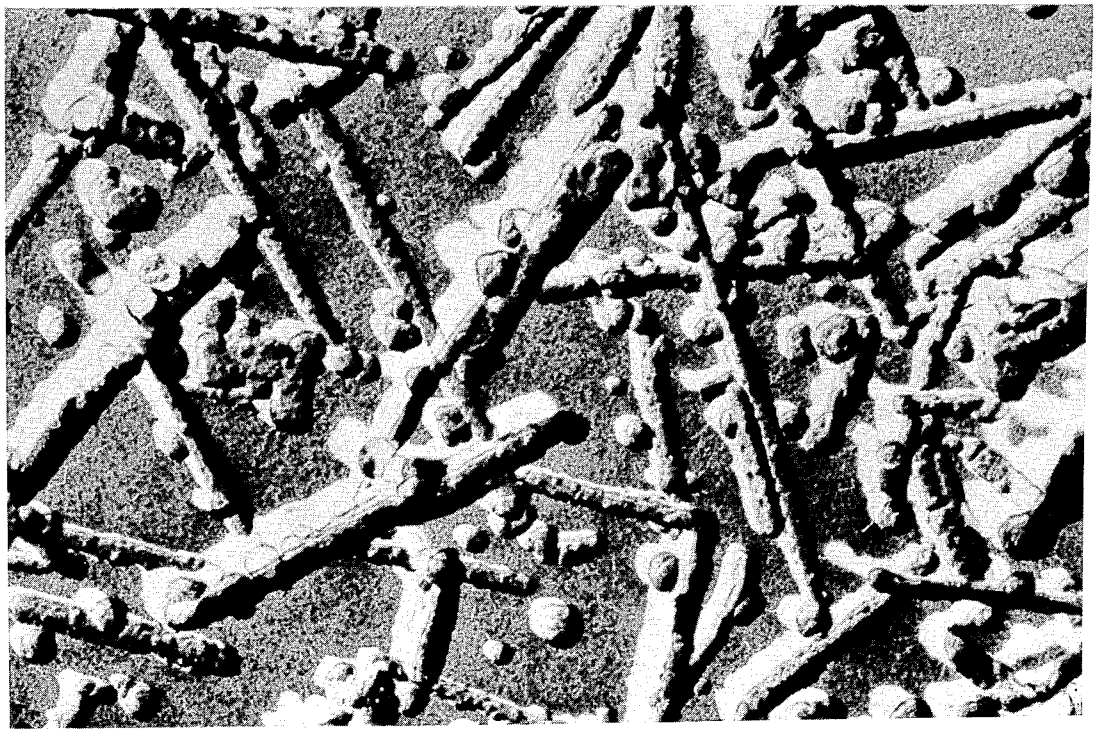

A 10% solution of potassium bromide (219 cc) was added and thoroughly mixed 2 minutes before the completion of the second addition of the aqueous silver salt solution and the aqueous halide solution in the preparation of a similar emulsion to Emulsion 102-2 as prepared in Example 2, halogen exchange took place and Emulsion 112 was obtained. The emulsion so obtained was examined using an electron microscope, and it was found that silver halide crystals containing rod-like grains had many convexities and concavities on the surface as shown in FIG. 35. The average silver bromide content of this silver halide emulsion was 75 mol %. (An emulsion of this invention)

This emulsion had a higher silver bromide content than that of Emulsions 110-1 or 110-2 prepared in Example 10, which contained rod-like silver halide crystals in the form of block having the average silver bromide content of 70 mol %, but even so it displayed a more distinct rod-like grain form.

EXAMPLE 13

Figure 36:
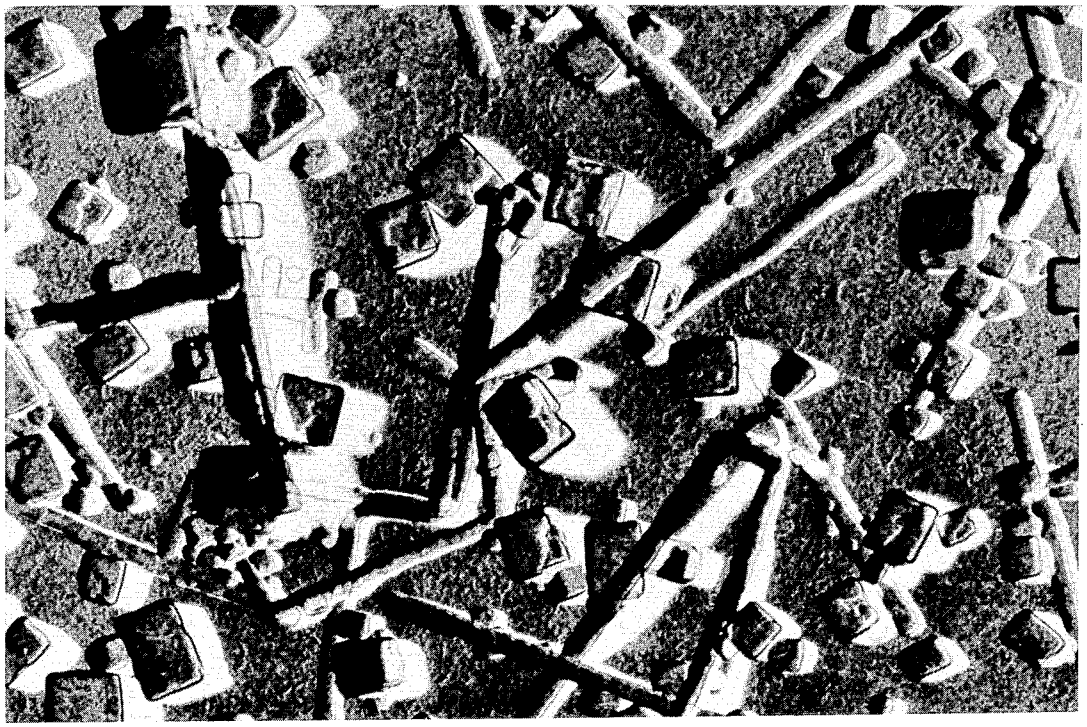

A solution of 62.5 g of silver nitrate in 500 cc of distilled water and a solution of 43.8 g of potassium bromide in 300 ml of distilled water were added to and mixed with Emulsion 102-1 prepared in Example 2 over a period of 20 minutes at a temperature of 77.5° C. The emulsion so obtained was examined using an electron microscope, and it was found that Silver Halide Emulsion 113 contained rod-like crystal grains, but the rate of formation of the grains was low, as shown in FIG. 36. The average silver bromide content of this silver halide emulsion was 75 mol %. (An emulsion of this invention)

Although Emulsion 113 had a higher silver bromide content than that of Emulsion 110-1 or 110-2 which contained rod-like silver halide crystals in the form of block having the average silver bromide content of 70 mol % prepared in Example 10, as in the case of Emulsion 112 of this invention prepared in Example 12, the grains displayed a more distinct rod-like form.

EXAMPLE 14

Figure 37:
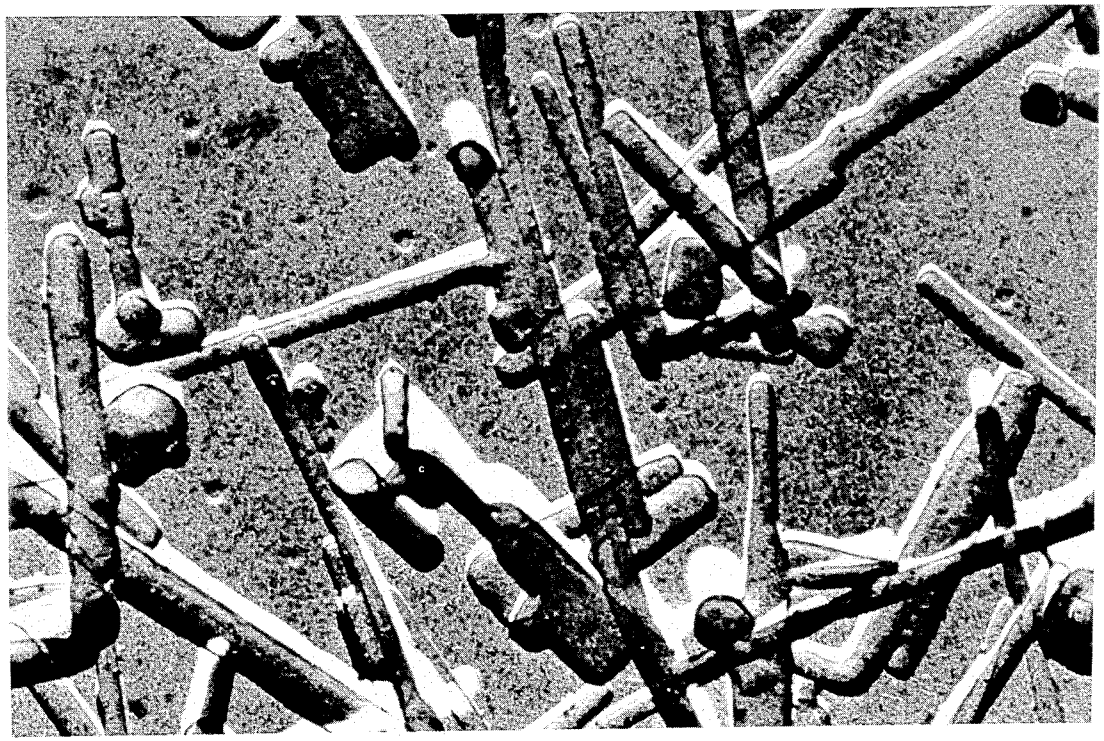

Emulsion 101 of this invention prepared in Example 1 was desalted and washed, delimed gelatin was added thereto and the pH was adjusted to 6.2. The temperature was then raised to 58° C., triethylthiourea was added and chemical sensitization was carried out in the presence of nucleic acid. 4-Hydroxy-6-methyl-1,3,3a,7-tetraazaindene was added at the end of the chemical sensitization. This was Emulsion 114-1 and an electron micrograph of the crystals is shown in FIG. 37.

A sample was prepared by coating Emulsion 114-1 on a cellulose triacetate support such that the weight of silver coated was 5.0 g/m$^2$ and the weight of gelatin coated was 1.57 g/m$^2$. This coated sample was designated as Sample A.

For comparison, Emulsions 105-9 and 105-10 prepared in Example 105 were chemically sensitized in the same way as for Sample 114-1, to form Emulsions 114-2 and 114-3, and coated Samples B and C were prepared in the same way as for Sample A. These samples were subjected to a white light exposure (5,400° K.) through an optical wedge and then they were processed for 5 minutes at 20° C. using the development bath indicated below. The photographic densities obtained were measured using an optical densitometer. The results were as shown in Table 1. The speed is indicated as a relative speed obtained by taking the reciprocal of the exposure required to obtain a density of (0.2+fog density) for Sample B, as 100.

| Development Bath: | |
|---|---|
| p-Methylaminophenol | 2.5 g |
| L-Ascorbic Acid | 10.0 g |
| Sodium Carbonate | 10.0 g |
| Potassium Bromide | 1.0 g |
| Water to make | 1 liter |

TABLE 1

| Sample | Speed | Fog | Remarks |
|---|---|---|---|
| A | 256 | 0.20 | This Invention |
| B | 100 | 0.05 | Comparative Example |
| C | — | 4.10 | Comparative Example |

Although Sample A of this invention had slightly more fog than Sample B, it had a higher speed, and it was excellent by having a very low fog when compared to Sample C which was obtained using Emulsion 114-3 prepared under the same very high pH as in Emulsion 114-1 for Sample A, and contained all the fogged grains.

Furthermore, on measuring the amounts of developed silver at a density of 1.0 in Samples A and B, that in Sample A was found to be 86% of that in B, and the emulsion of Sample A clearly had a higher covering power.

EXAMPLE 15

A solution containing 10 g of 1-(2,4,6-trichlorophenyl)-3-(2-chloro-5-tridecanamido)anilino2-pyrazolin-5-one as a magenta coupler, 1.2 g of 2,5-di-t-hexylhydroquinone as an agent for rendering colored image fast, 1.6 g of 1,1,1′, 1′-tetramethyl-5,5′,6,6′-tetrapropoxyspiroindane as also an agent for rendering colored image fast was obtained using 6 g of tricresyl phosphate and 6 g of tri(2-ethylbenzyl)phosphate as solvent, and ethyl acetate as auxiliary solvent. An emulsion was prepared by mechanically dispersing this solution in gelatin, using sodium dodecylbenzenesulfonate. This emulsion was mixed with emulsions prepared by adding anhydro-3,3′-disulfoethyl-5,5′-diphenyl-9-ethyloxacarbocyanine hydroxide as a spectral sensitizing dye to Emulsions 114-1 and 114-2 prepared in Example 14 with a molar ratio of silver to coupler of 4.5. The mixture was applied in an amount of 0.3 g of silver per square meter on paper supports laminated with polyethylene containing finely divided titanium oxide. These samples were designated as Samples D and E, respectively.

These samples were subjected to a green exposure through an optical wedge and developed in the way indicated below.

The magenta densities of the processed samples were measured using a reflection type optical densitometer. The results are shown in Table 2. The reflection optical densities measured for the development times of 1 minute 30 seconds and 7 minutes after exposure which provided a density of 1.0 at a development time of 3 minutes 30 seconds are shown as observed D1 and D3, respectively.

| Process | Temperature (°C.) | Time |
|---|---|---|
| Color Development | 33 | 1 min 30 sec |
| | | 3 min 30 sec |
| | | 7 min 00 sec |
| Bleach-Fix | 33 | 1 min 30 sec |
| Water Wash | 24–34 | 3 min |
| Drying | 70–80 | 1 min |

The compositions of the processing baths were as follows:

| | |
|---|---|
| Color Development Bath: | |
| Water | 800 cc |
| Diethylenetriaminepentaacetic Acid | 1.0 g |
| Nitrilotriacetic Acid | 1.5 g |
| Benzyl Alcohol | 15.0 cc |
| Diethylene Glycol | 10.0 cc |
| Sodium Sulfite | 2.0 g |
| Potassium Bromide | 0.5 g |
| Sodium Carbonate | 30.0 g |
| N-Ethyl-N-(β-methanesulfonamidoethyl)-3-methyl-4-aminoaniline Sulfate | 5.0 g |
| Hydroxylamine Sulfate | 4.0 g |
| Fluorescent Whitener (Whitex 4B, made by Sumitomo Chemicals) | 1.0 g |
| Water to make | 1 liter |
| pH (25° C.) | 10.20 |
| Bleach-Fix Bath: | |
| Water | 400 cc |
| Ammonium Thiosulfate (70%) | 150 cc |
| (Ethylenediaminetetraacetato) Iron(III) Ammonium Salt | 55.0 g |
| Disodium Ethylenediaminetetra-acetate | 5.0 g |
| Water to make | 1 liter |
| pH (25° C.) | 6.70 |

TABLE 2

| Sample | D1 | D3 | Remarks |
|---|---|---|---|
| D | 0.74 | 1.22 | This Invention |
| E | 0.47 | 1.39 | Comparative Example |

The sample of this invention clearly developed more quickly and a high color density was obtained even with a short development time. Furthermore, the change in density was small when development was pushed and the sample of this invention was clearly superior. Furthermore, the amounts of dye formed at an optical reflection density of 1.0 were compared by extraction using dimethylformamide and water. It was found that the amount of dye formed in Sample D of this invention was about 6% less than the amount formed in Comparative Sample E, confirming that in terms of dye density the sample of this invention had a higher covering power.

Figures 1, 38:
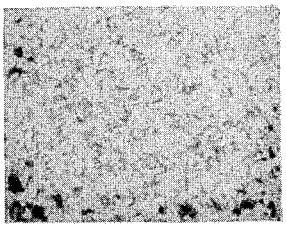
Figures 2, 38:
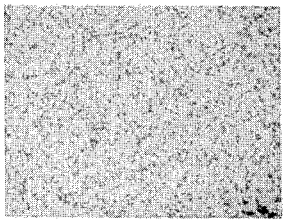
Figure 39:
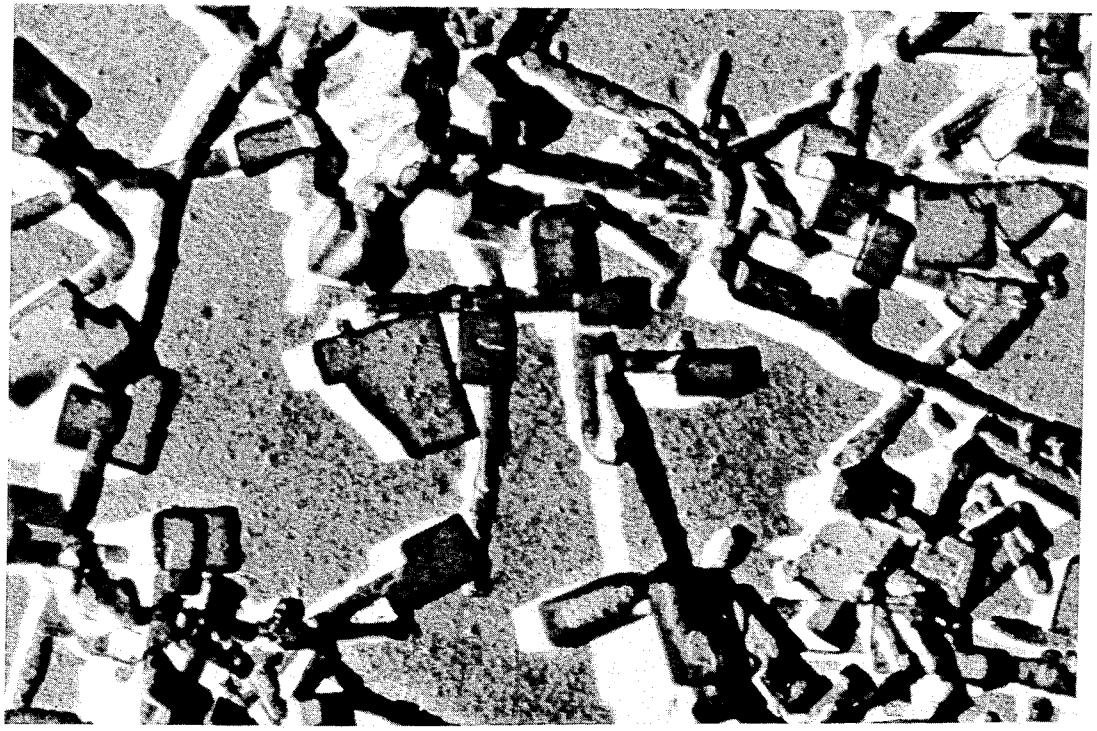
Figure 40:
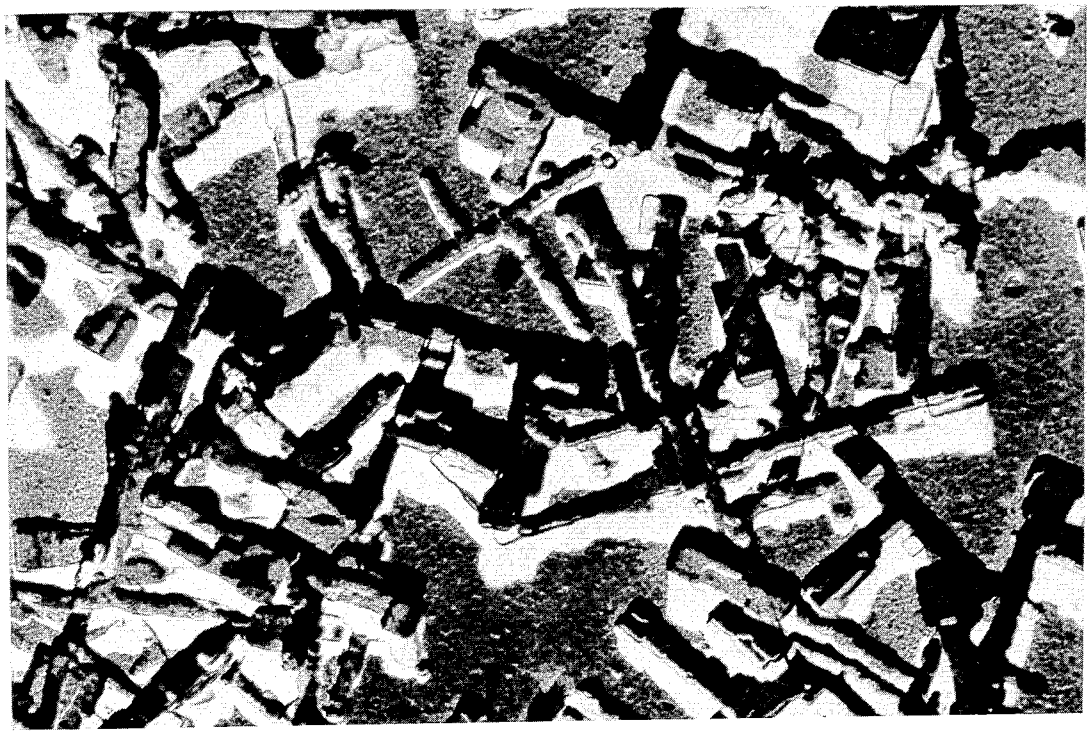
Figure 41:
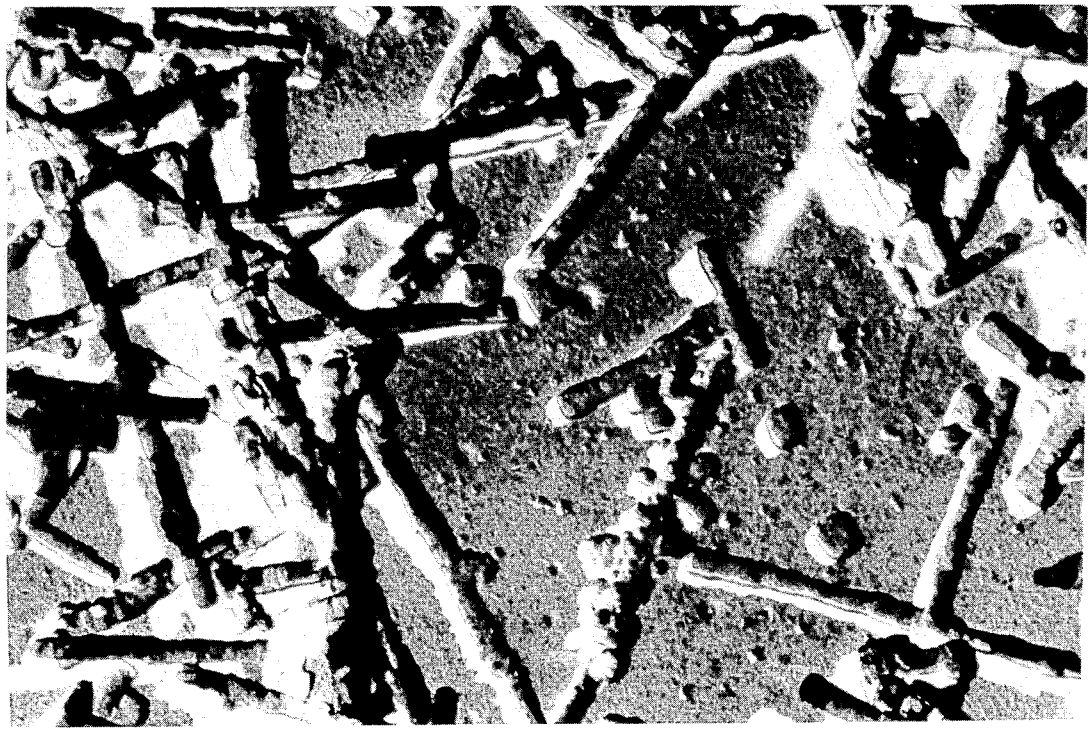
Figure 42:
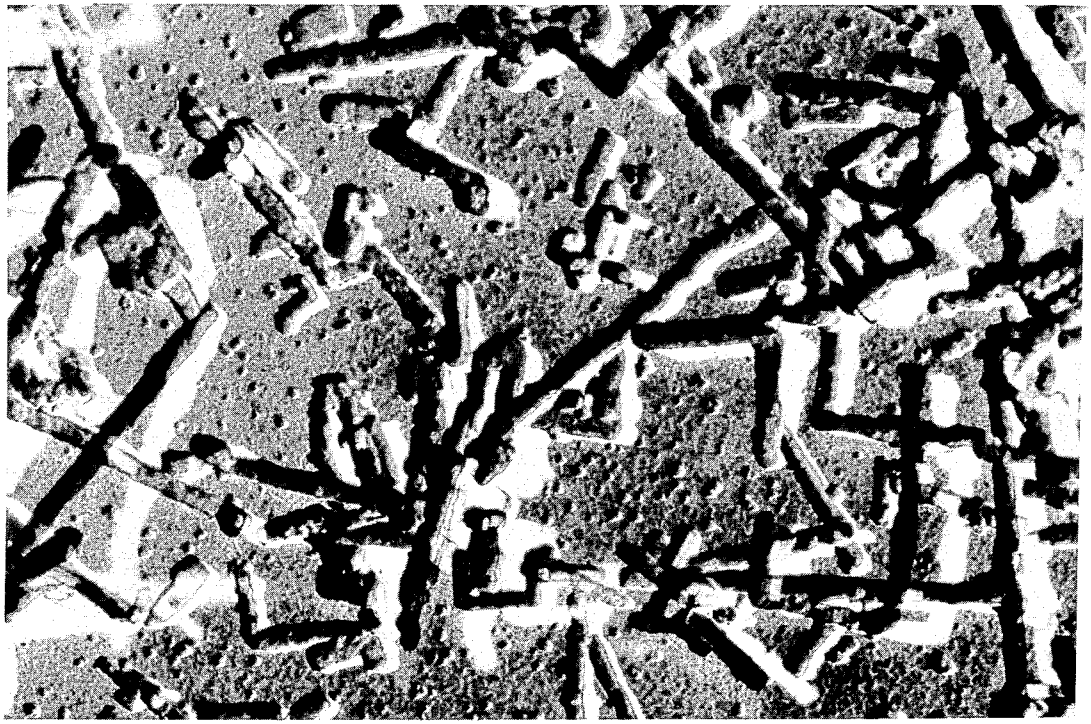
Figure 43:
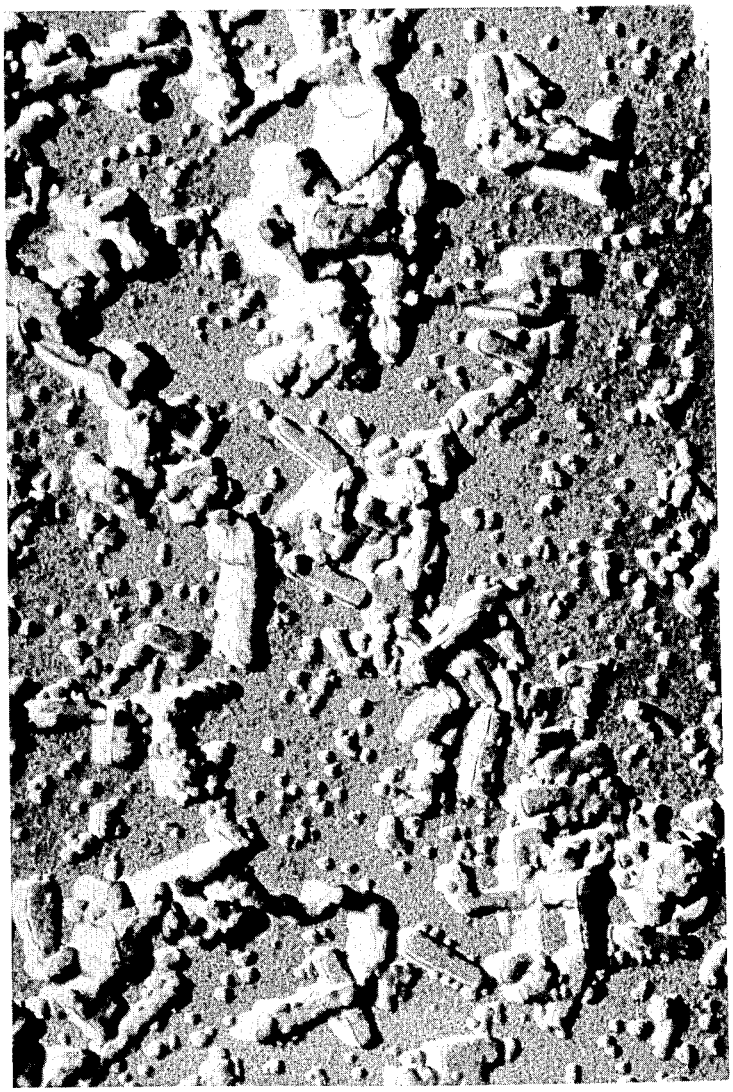
Figure 44:
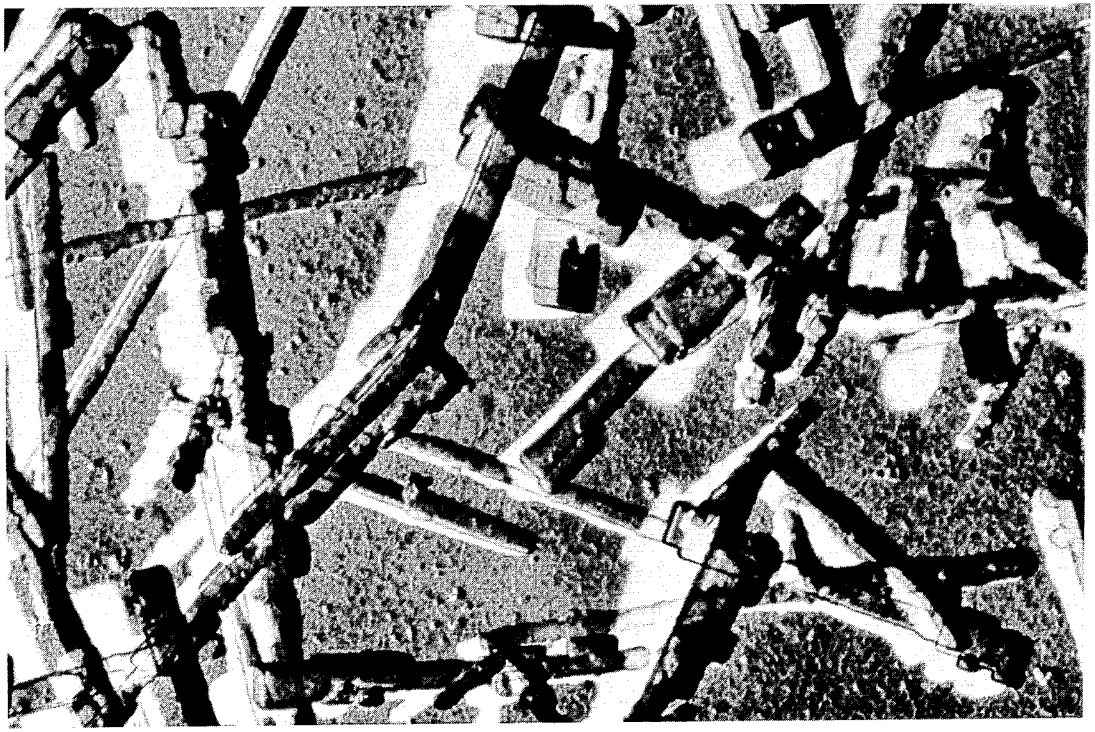
Figure 45:
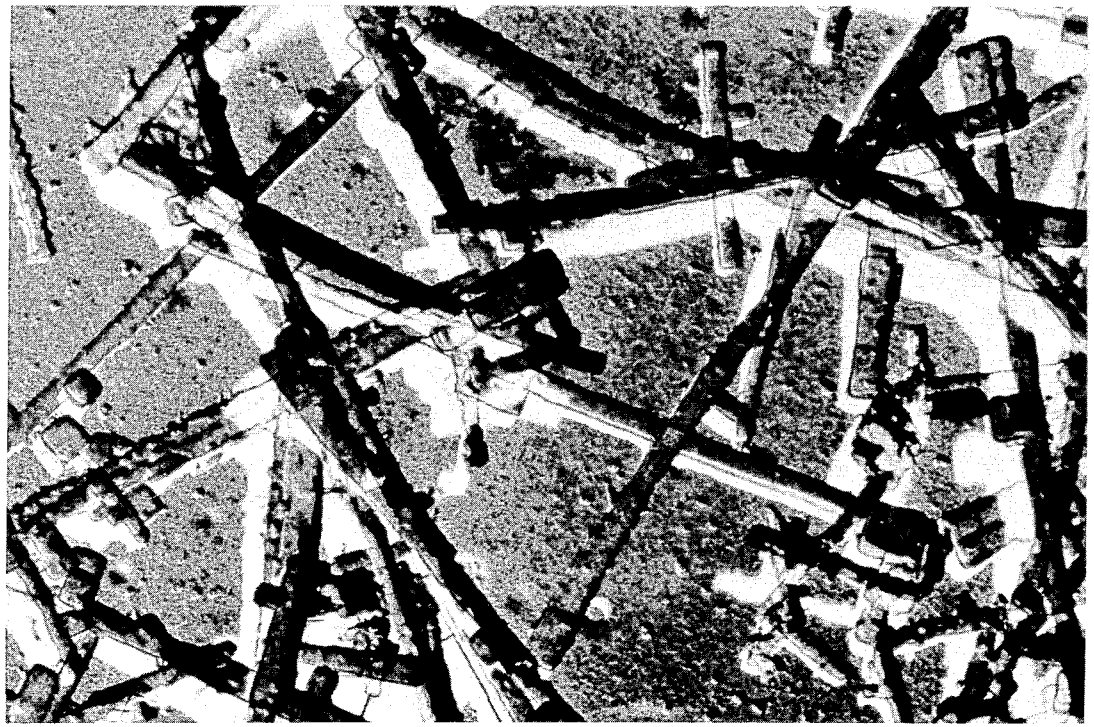
Figure 46:
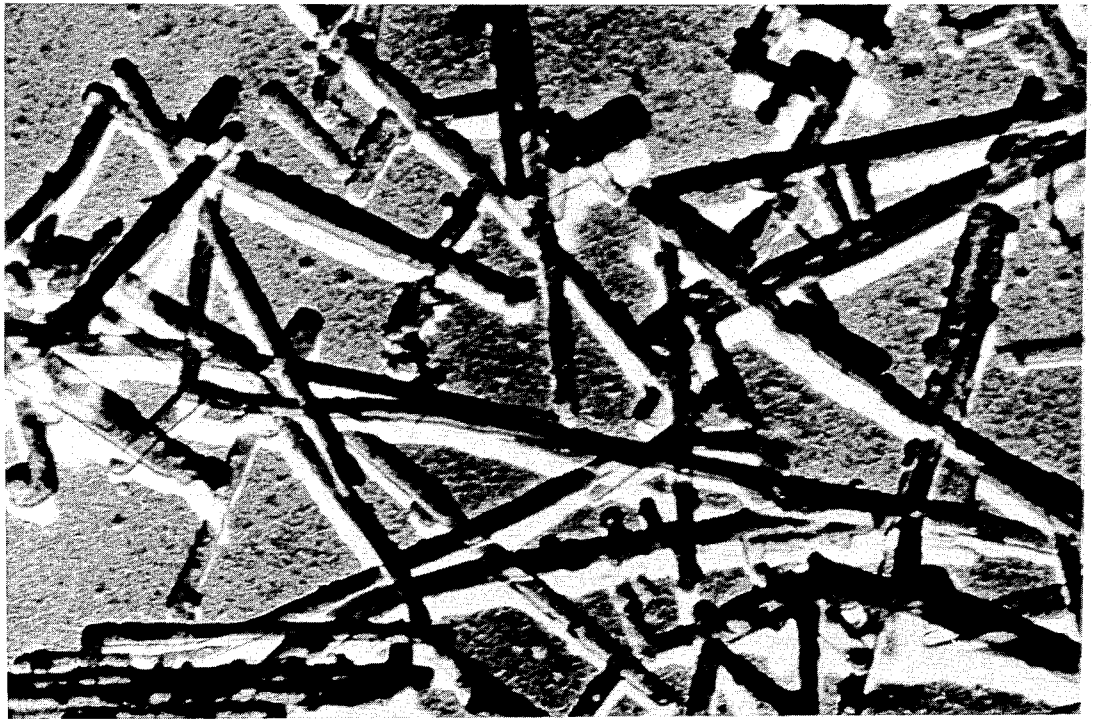
Figure 47:
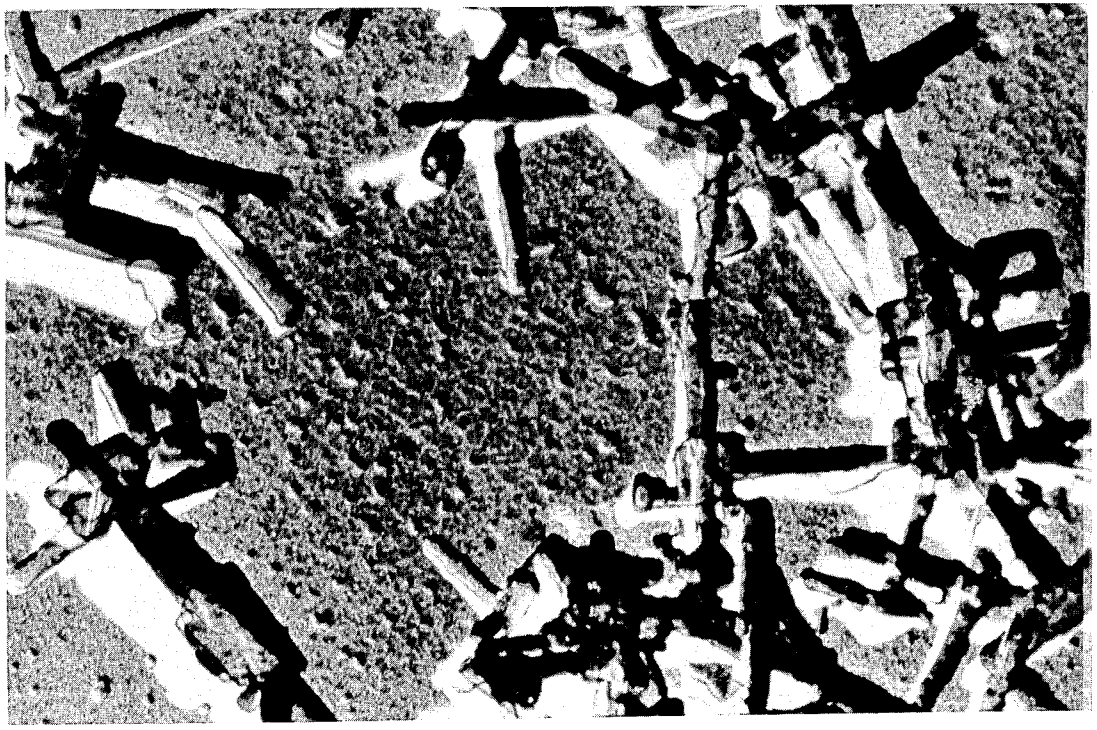
Figure 48:
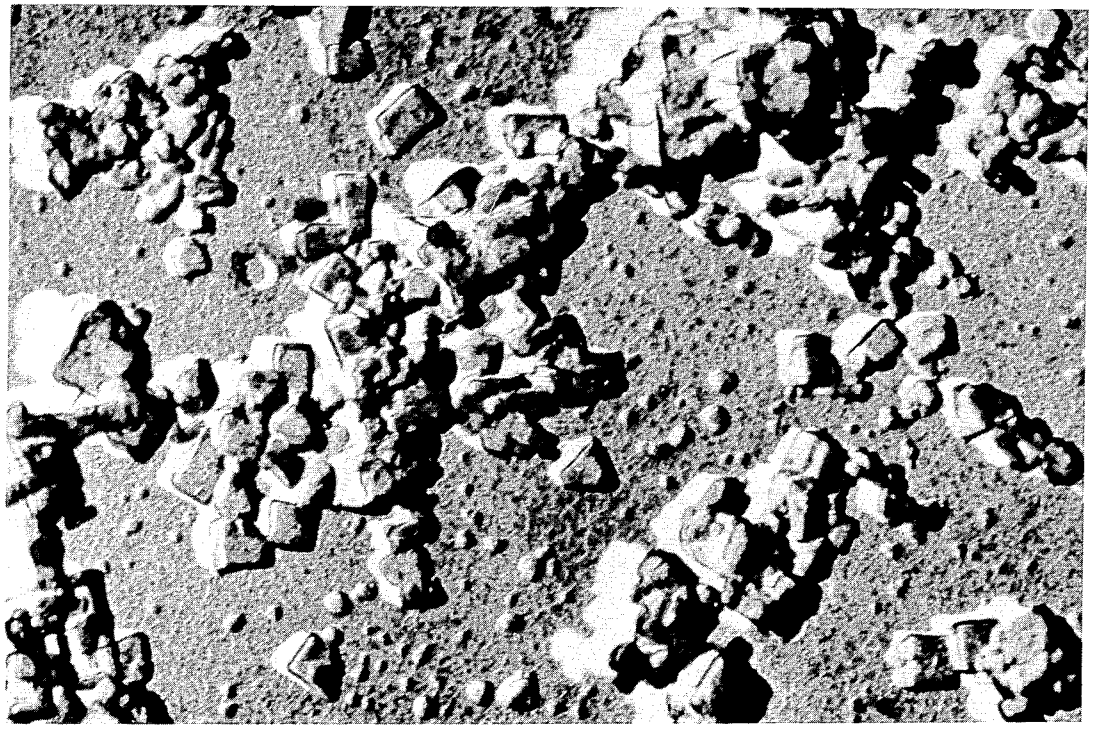

For reference, Samples D and E which had been fixed without passing through the bleach-fix bath after color development in the process described above were prepared, and the developed silver was examined using an optical microscope at a magnification of 600 times. Photographs of the developed silver crystals are shown in FIGS. 38-1 and 38-2. It is clear from FIG. 38-1 that the form of the rod-like grains before development was retained even after the conversion of the grains into developed silver.

Furthermore, on similarly examining bleach-fixed samples, the colored dye was seen to have been formed around the edges of the developed silver in more or less the same way.

EXAMPLE 16

Samples D and E prepared in Example 15 were processed in the following way. A similar comparison to that of Example 15 was carried out. The results indicated that the sample using the emulsion of this invention developed more quickly and had a higher covering power.

| Process | Temperature (°C.) | Time (sec) |
|---|---|---|
| Color Development | 35 | 30 |
| | | 45 |
| | | 60 |
| Bleach-Fix | 30–35 | 45 |
| Rinse (1) | 30–35 | 20 |
| Rinse (2) | 30–35 | 20 |
| Rinse (3) | 30–35 | 20 |
| Rinse (4) | 30–35 | 30 |
| Drying | 70–80 | 60 |

(Four-tank counter flow system from rinse (4) to rinse (1))

The compositions of the processing baths were as follows:

| | |
|---|---|
| Color Development Bath: | |
| Water | 800 cc |
| Ethylenediamine-N,N,N',N'-tetramethylene-phosphonic Acid | 1.5 g |
| 1,4-Diazabicyclo[2,2,2]octane | 7.5 g |
| Sodium Chloride | 1.4 g |
| Potassium Carbonate | 25.0 g |
| N-Ethyl-N-(β-methanesulfonamidoethyl)-3-methyl-4-aminoaniline Sulfate | 5.0 g |
| N,N-Diethylhydroxylamine | 4.2 g |
| Fluorescent Whitener (4,4'-diamino-stilbene based) | 2.0 g |
| Water to make | 1 liter |
| pH (25° C.) | 10.10 |
| Bleach-Fix Bath: | |
| Water | 400 cc |
| Ammonium Thiosulfate (70%) | 100 cc |
| Sodium Sulfite | 18.0 g |
| (Ethylenediaminetetraacetato) Iron(III) Ammonium Salt | 55.0 g |
| Disodium Ethylenediaminetetra-acetate | 3.0 g |
| Ammonium Bromide | 40.0 g |
| Glacial Acetic Acid | 8.0 g |
| Water to make | 1 liter |
| pH (25° C.) | 5.50 |
| Rinse Bath: | |
| Ion exchange water (both calcium and magnesium being less than 3 ppm.) | |

EXAMPLE 17

Emulsion 102-2 of this invention prepared in Example 2 was desalted and washed, delimed gelatin was added thereto and the pH was adjusted to 6.6, after which the temperature was raised to 58° C., triethylthiourea was added and chemical sensitization was carried out in the presence of nucleic acid and anhydro-3,3'-disulfobutyl-5,5'-dichloro-9-ethyloxacarbocyanine hydroxide. 4-Hydroxy-6-methyl-1,3,3a,7-tetraazaindene and 1-(methylureidophenyl)-5-mercaptotetrazole were added at the end of the chemical sensitization. This emulsion was designated as Emulsion 117. Tests were carried out in the same way as in Examples 14 and 15 using this emulsion. It was confirmed that this emulsion was also superior in respect of processing characteristics to an emulsion containing cubic grains of the same halogen composition.

Furthermore, it was also confirmed that the developing characteristics of the photographic materials using emulsions of this invention, their color sensitization speed and their covering power were superior when yellow or cyan couplers such as α-pivaloyl-α-(1-benzyl-5-ethoxyhydantoin-3-yl)-2-chloro-5-[α-(2,4-di-t-amylphenoxy)butanamido]acetanilide or 2-[α-(2,4-di-t-pentylphenoxy)butanamido]-4,6-dichloro-5-ethylphenol were combined with the emulsion of Example 14 or the emulsion of this example.

Moreover, multilayer coated samples which had red, green and blue sensitivity were prepared by suitably combining each of these cyan, magenta and yellow couplers. On similarly investigating the properties it was found that the advantages such as those of the aforementioned samples of this invention were retained.

EXAMPLE 18

Thirty grams of lime-treated gelatin was added to 1 liter of distilled water and dissolved at 40° C. after which 6.5 g of sodium chloride, 0.65 g of sodium hydroxide and 0.27 g of adenine were added and the temperature was raised to 52.5° C. A solution of 62.5 g of silver nitrate in 750 cc of distilled water and respective solutions of 16.2 g, 17.5 g, 21.5 g, 27 g and 38 g of sodium chloride in 500 cc of distilled water were added to and mixed with the above-mentioned solution over a period of 40 minutes while maintaining the temperature of 52.5° C. Five types of emulsions were obtained. These emulsions were examined using an electron microscope, and it was found that emulsions contained rod-like silver halide crystals as shown in FIGS. 39 to 43. (Emulsions 118-1 to 118-5 of this invention)

It is clear that rod-like grains of different forms are formed when the silver ion concentration differs during the formation of the silver halide grains.

EXAMPLE 19

Thirty grams of lime-treated gelatin was added to 1 liter of distilled water and dissolved at 40° C., after which 6.5 g of sodium chloride, 0.65 g of sodium hydroxide and 0.27 g of adenine were added and the temperature was raised to 65° C. A solution of 62.5 g of silver nitrate in 750 cc of distilled water and solutions of 21.9 g of potassium bromide and 5.5 g, 6.8 g, 10.8 g, 16.3 g and 27.3 g of sodium chloride in 500 cc of distilled water were added to and mixed with the above-mentioned solution over a period of 40 minutes while maintaining the temperature of 65° C. The emulsions obtained were examined using an electron microscope. It was found that the emulsions contained silver halide crystals as shown in FIGS. 44 to 48 had been prepared. The silver halide grains in FIGS. 44 to 47 are rod-like grains but the silver halide grains in FIG. 48 cannot be called rod-like grains. (Emulsions 119-1 to 119-4 of this invention and Comparative Example 119-5).

Emulsions which contain large numbers of silver halide grains having a novel form and a method for the preparation of these emulsions are provided by this invention. Moreover, silver halide photographic materials which develop quickly and which have a high covering power can be provided by using these emulsions.

While the invention has been described in detail and with reference to specific embodiments thereof, it will be apparent to one skilled in the art that various changes and modifications can be made therein without departing from the spirit and scope thereof.

What is claimed is:

1. A silver halide emulsion containing at least 20 wt %, on the basis of the total silver halide, of rod-like or needle-like crystal grains and/or crystal grains each formed by at least two grains of said rod-like or needle-like crystal grains joined at right angles or in parallel, said rod-like or needle-like crystal grains each being defined by crystal planes consisting essentially of (100) faces, wherein, when the ratio of length of the edges along which said planes intersect is taken as 1:m:n in the order of from the smallest to the largest, m and n satisfy the following relationships (I) and (II):

$$1 \leqq m \leqq 7 \quad \text{(I)}$$

$$n \geqq 7m \quad \text{(II)}$$

2. A silver halide emulsion as in claim 1, wherein m satisfies the following relationship:

$$1 \leqq m \leqq 3 \quad \text{(III)}$$

3. A silver halide emulsion as in claim 1, wherein m satisfies the following relationship:

$$1 \leqq m \leqq 1.5 \quad \text{(IV)}$$

4. A silver halide emulsions as in claim 1, 2 or 3, wherein crystal grains which satisfy relationships (I) and (II) or relationship (III) or (IV) account for at least 40 wt % of all the silver halide.

5. A silver halide emulsion as in any one of claims 1, 2, or 3, wherein the average length of the shortest edge of the crystal grains which satisfy relationships (I) and (II) or relationship (III) or (IV) is within the range from 0.05 μm to 1.5 μm.

6. A silver halide emulsion as in any one of claims 1, 2, or 3, wherein the average length of the shortest edge of the crystal grains which satisfy relationships (I) and (II) or relationship (III) or (IV) is within the range from 0.1 μm to 1.0 μm.

7. A silver halide emulsion in any one of claims 1, 2 or 3, wherein the silver halide is an essentially silver iodide-free silver chloride or silver chlorobromide.

8. A silver halide emulsion as in claim 7, wherein the silver chlorobromide emulsion contains at least 10 mol % of silver chloride.

9. A silver halide emulsion as in claim 7, wherein the silver chlorobromide contains at least 30 mol % of silver chloride.

10. A silver halide emulsion as in any one of claims 1, 2 or 3 wherein a crystal form controlling agent is present during the formation of the silver halide crystal grains.

11. A silver halide emulsion as in claim 10, wherein the crystal form controlling agent is a nucleic acid or a degradation product thereof.

12. A silver halide emulsion as in claim 10, wherein the crystal form controlling agent is an aminoazaindene compound.

13. A silver halide photographic material having, on a support, at least one photosensitive layer containing a silver halide emulsion according to any one of claims 1, 2 or 3.

14. A silver halide emulsion as in claim 4, wherein the average length of the shortest edge of the crystal grains which satisfy relationships (I) and (II) or relationship (III) or (IV) is within the range from 0.05 μm to 1.5 μm.

15. A silver halide emulsion as in claim 4, wherein the average length of the shortest edge of the crystal grains which satisfy relationships (I) and (II) or relationships (III) or (IV) is within the range from 0.1 μm to 1.0 μm.

16. A silver halide emulsion as in claim 4, wherein the silver halide is an essentially silver iodide-free silver chloride or silver chlorobromide.

17. A silver halide emulsion as in claim 16, wherein the silver chlorobromide emulsion contains at least 10 mol % of silver chloride.

18. A silver halide emulsion as in claim 16, wherein the silver chlorobromide contains at least 30 mol % of silver chloride.

19. A silver halide emulsion as in claim 4, wherein a crystal form controlling agent is present during the formation of the silver halide crystal grains.

20. A silver halide emulsion as in claim 5, wherein a crystal form controlling agent is present during the formation of the silver halide crystal grains.

21. A silver halide emulsion as in claim 6, wherein a crystal form controlling agent is present during the formation of the silver halide crystal grains.

22. A silver halide emulsion as in claim 7, wherein a crystal form controlling agent is present during the formation of the silver halide crystal grains.

23. A silver halide emulsion as in claim 8, wherein a crystal form controlling agent is present during the formation of the silver halide crystal grains.

24. A silver halide emulsion as in claim 9, wherein a crystal form controlling agent is present during the formation of the silver halide crystal grains.

25. A silver halide emulsion as in claim 19, wherein the crystal form controlling agent is a nucleic acid or a degradation product thereof.

26. A silver halide emulsion as in claim 20, wherein the crystal form controlling agent is a nucleic acid or a degradation product thereof.

27. A silver halide emulsion as in claim 21, wherein the crystal form controlling agent is a nucleic acid or a degradation product thereof.

28. A silver halide emulsion as in claim 22, wherein the crystal form controlling agent is a nucleic acid or a degradation product thereof.

29. A silver halide emulsion as in claim 23, wherein the crystal form controlling agent is a nucleic acid or a degradation product thereof.

30. A silver halide emulsion as in claim 24, wherein the crystal form controlling agent is a nucleic acid or a degradation product thereof.

31. A silver halide emulsion as in claim 19, wherein the crystal form controlling agent is an aminoazaindene compound.

32. A silver halide emulsion as in claim 20, wherein the crystal form controlling agent is an aminoazaindene compound.

33. A silver halide emulsion as in claim 21, wherein the crystal form controlling agent is an aminoazaindene compound.

34. A silver halide emulsion as in claim 22, wherein the crystal form controlling agent is an aminoazaindene compound.

35. A silver halide emulsion as in claim 23, wherein the crystal form controlling agent is an aminoazaindene compound.

36. A silver halide emulsion as in claim 24, wherein the crystal form controlling agent is an aminoazaindene compound.

37. A silver halide photographic material having, on a support, at least one photosensitive layer containing a silver halide emulsion according to claim 4.

38. A silver halide photographic material having, on a support, at least one photosensitive layer containing a silver halide emulsion according to claim 5.

39. A silver halide photographic material having, on a support, at least one photosensitive layer containing a silver halide emulsion according to claim 6.

40. A silver halide photographic material having, on a support, at least one photosensitive layer containing a silver halide emulsion according to claim 7.

41. A silver halide photographic material having, on a support, at least one photosensitive layer containing a silver halide emulsion according to claim 8.

42. A silver halide photographic material having, on a support, at least one photosensitive layer containing a silver halide emulsion according to claim 9.

43. A silver halide photographic material having, on a support, at least one photosensitive layer containing a silver halide emulsion according to claim 10.

44. A silver halide photographic material having, on a support, at least one photosensitive layer containing a silver halide emulsion according to claim 11.

45. A silver halide photographic material having, on a support, at least one photosensitive layer containing a silver halide emulsion according to claim 12.

* * * * *